US009403394B2

(12) United States Patent
Rosner et al.

(10) Patent No.: US 9,403,394 B2
(45) Date of Patent: Aug. 2, 2016

(54) MODULAR SUBLIMATION TRANSFER PRINTING APPARATUS

(71) Applicant: The Hillman Group, Inc., Cincinnati, OH (US)

(72) Inventors: Brian Rosner, Phoenix, AZ (US); Gary Edward Will, Gold Canyon, AZ (US); Bryan Keith Solace, Chandler, AZ (US)

(73) Assignee: The Hillman Group, Inc., Cincinnati, OH (US)

( * ) Notice: Subject to any disclaimer, the term of this patent is extended or adjusted under 35 U.S.C. 154(b) by 89 days.

(21) Appl. No.: 14/261,202

(22) Filed: Apr. 24, 2014

(65) Prior Publication Data

US 2015/0029289 A1 Jan. 29, 2015

Related U.S. Application Data

(63) Continuation-in-part of application No. 13/951,127, filed on Jul. 25, 2013, and a continuation-in-part of application No. 13/951,150, filed on Jul. 25, 2013, and a continuation-in-part of application No. 13/951,175, (Continued)

(51) Int. Cl.

| | |
|---|---|
| ***B41M 5/00*** | (2006.01) |
| ***B41M 5/035*** | (2006.01) |
| ***B41J 2/315*** | (2006.01) |
| ***B41F 16/00*** | (2006.01) |

(Continued)

(52) U.S. Cl.

CPC ..... *B41M 5/0358* (2013.01); *B41F 16/008* (2013.01); *B41F 16/0046* (2013.01); *B41J 2/315* (2013.01); *B44C 1/162* (2013.01); *G07F 11/70* (2013.01); *B41M 5/0094* (2013.01)

(58) Field of Classification Search

CPC combination set(s) only.
See application file for complete search history.

(56) References Cited

U.S. PATENT DOCUMENTS

| | | | |
|---|---|---|---|
| 4,059,471 | A | 11/1977 | Haigh |
| 4,174,250 | A | 11/1979 | Durand |

(Continued)

FOREIGN PATENT DOCUMENTS

| | | |
|---|---|---|
| DE | 10 1011 012833 A1 | 9/2012 |
| EP | 2000303 | 10/2008 |

(Continued)

OTHER PUBLICATIONS

"Mug Sublimation," YouTube, http://www.youtube.com/watch?v=XI_DB3TVAws, uploaded Jan. 21, 2008.

(Continued)

*Primary Examiner* — Huan Tran
(74) *Attorney, Agent, or Firm* — Finnegan, Henderson, Farabow, Garrett & Dunner, LLP

(57) ABSTRACT

A safe, integrated dye sublimation transfer printer apparatus is disclosed. The apparatus is configured to print one or more images onto transfer media, then align the transfer media onto a substrate. A selected product to receive the sublimated image is positioned on top of the transfer media, and the apparatus brings the transfer media and one or more heating platens into contact to sublimate the image. The heating platen is configured to sublimate one or more opposing sides of a product substantially simultaneously in a single thermal cycle. In some embodiments, the apparatus may be incorporated into a fully-enclosed vending machine to provide on-demand personalized sublimated products and accessories for a consumer.

44 Claims, 42 Drawing Sheets

Related U.S. Application Data filed on Jul. 25, 2013, now Pat. No. 9,120,326, and a continuation-in-part of application No. 13/951,196, filed on Jul. 25, 2013.

(60) Provisional application No. 61/911,928, filed on Dec. 4, 2013.

(51) Int. Cl.
*B44C 1/16* (2006.01)
*G07F 11/70* (2006.01)

(56) References Cited

U.S. PATENT DOCUMENTS 4,202,663 A 5/1980 Haigh et al.
4,242,092 A 12/1980 Glover
4,253,838 A 3/1981 Mizuno et al.
4,314,814 A 2/1982 Deroode
4,412,292 A 10/1983 Sedam et al.
4,465,728 A 8/1984 Haigh et al.
4,662,966 A 5/1987 Sumi et al.
4,664,672 A 5/1987 Krajec et al.
4,670,084 A 6/1987 Durand
4,873,643 A 10/1989 Powell et al.
4,933,315 A 6/1990 Kanto et al.
4,943,555 A 7/1990 Nakamoto et al.
4,990,485 A 2/1991 Egashira et al.
5,122,499 A 6/1992 Janssens et al.
5,135,905 A 8/1992 Egashira et al.
5,202,176 A 4/1993 Higuchi et al.
5,244,234 A 9/1993 Oshima et al.
5,246,518 A 9/1993 Hale
5,248,363 A 9/1993 Hale
5,252,530 A 10/1993 Nakamura
5,254,523 A 10/1993 Fujimura et al.
5,302,223 A 4/1994 Hale
5,308,426 A 5/1994 Claveau
5,344,807 A 9/1994 Nakamura
5,346,877 A 9/1994 Nakamura
5,354,401 A 10/1994 Asahi et al.
5,431,501 A 7/1995 Hale et al.
5,432,145 A 7/1995 Oshima et al.
5,468,714 A 11/1995 Oshima et al.
5,487,614 A 1/1996 Hale
5,488,907 A 2/1996 Xu et al.
5,513,116 A 4/1996 Buckley et al.
5,522,317 A 6/1996 Hale et al.
5,546,316 A 8/1996 Buckley et al.
5,550,098 A 8/1996 Aso et al.
5,555,813 A 9/1996 Hale et al.
5,559,714 A 9/1996 Banks et al.
5,574,829 A 11/1996 Wallace et al.
5,575,877 A 11/1996 Hale et al.
5,580,410 A 12/1996 Johnston
5,590,600 A 1/1997 Hale et al.
5,601,023 A 2/1997 Hale et al.
5,615,123 A 3/1997 Davidson et al.
5,623,581 A 4/1997 Attenberg
5,630,894 A 5/1997 Koch et al.
5,634,731 A 6/1997 Kita et al.
5,640,180 A 6/1997 Hale et al.
5,642,141 A 6/1997 Hale et al.
5,643,387 A 7/1997 Berghauser et al.
5,644,988 A 7/1997 Xu et al.
5,710,887 A 1/1998 Chelliah et al.
5,734,396 A 3/1998 Hale et al.
5,822,423 A 10/1998 Jehnert et al.
5,830,263 A 11/1998 Hale et al.
5,959,278 A 9/1999 Kobayashi et al.
5,962,368 A 10/1999 Poole
5,997,677 A 12/1999 Zaher
6,038,491 A 3/2000 McGarry et al.
6,085,126 A 7/2000 Mellgren, III et al.
6,103,041 A 8/2000 Wagner et al.
6,105,502 A 8/2000 Wagner et al.
6,110,316 A 8/2000 Kobayashi et al.
6,118,545 A 9/2000 Kawai et al.
6,149,754 A 11/2000 Ogata et al.
6,165,938 A 12/2000 Narita et al.
6,249,297 B1 6/2001 Lion
6,339,731 B1 1/2002 Morris et al.
6,341,856 B1 1/2002 Thompson et al.
6,344,103 B1 2/2002 Cheng et al.
6,348,939 B1 2/2002 Xu et al.
6,392,680 B2 5/2002 Akada et al.
6,402,313 B1 6/2002 Xu et al.
6,425,331 B1 7/2002 Xu et al.
6,439,710 B1 8/2002 Hale et al.
6,447,629 B1 9/2002 Thompson et al.
6,450,098 B1 9/2002 Hale et al.
6,474,230 B2 11/2002 Corrado
6,486,903 B1 11/2002 Wagner et al.
6,488,370 B2 12/2002 Hale et al.
6,505,095 B1 1/2003 Kolls
6,535,294 B1 3/2003 Arledge, Jr. et al.
6,535,791 B1 3/2003 Wang
6,540,345 B1 4/2003 Wagner et al.
6,587,839 B1 7/2003 McIntyre et al.
6,594,642 B1 7/2003 Lemchen
6,606,602 B1 8/2003 Kolls
6,618,066 B2 9/2003 Hale et al.
6,623,677 B1 9/2003 Smith et al.
6,631,984 B2 10/2003 Thompson et al.
RE38,295 E 11/2003 Kobayashi et al.
6,649,317 B2 11/2003 Wagner et al.
6,673,503 B2 1/2004 Wagner et al.
6,686,314 B2 2/2004 Xu et al.
6,718,237 B1 4/2004 Murray et al.
6,814,831 B2 11/2004 Drake
6,816,752 B1 11/2004 Wang
6,840,614 B2 1/2005 Wagner et al.
6,849,370 B2 2/2005 Wagner et al.
6,887,640 B2 5/2005 Zhang et al.
6,915,273 B1 7/2005 Parulski
6,941,276 B2 9/2005 Haeberli
6,957,125 B1 10/2005 Rifkin
6,961,076 B2 11/2005 Wagner et al.
6,966,643 B2 11/2005 Hale et al.
RE38,952 E 1/2006 Hale et al.
6,998,005 B2 2/2006 Magee et al.
7,001,649 B2 2/2006 Wagner et al.
7,041,424 B2 5/2006 Xu et al.
7,137,426 B2 11/2006 Neri et al.
7,154,630 B1 12/2006 Nimura et al.
7,156,566 B2 1/2007 Johnson et al.
7,166,191 B2 1/2007 Suzuki et al.
7,167,892 B2 1/2007 Defosse et al.
7,212,308 B2 5/2007 Morgan
7,218,991 B2 5/2007 Walker et al.
7,267,737 B2 9/2007 Neri et al.
7,337,130 B2 2/2008 Ito et al.
7,524,048 B2 4/2009 Xu
7,527,655 B1 5/2009 Wagner et al.
7,563,341 B2 7/2009 Ferguson et al.
7,593,897 B1 9/2009 Kolls
7,654,660 B2 2/2010 Hale et al.
7,810,538 B2 10/2010 Magee et al.
7,870,824 B2 1/2011 Helma et al.
7,880,599 B2 2/2011 Murray et al.
8,024,231 B2 9/2011 Taratino et al.
8,029,883 B2 10/2011 Xu et al.
8,060,247 B2 11/2011 Kaplan et al.
8,191,779 B2 6/2012 Illingworth et al.
8,214,247 B2 7/2012 Murray et al.
8,253,549 B2 8/2012 Murray et al.
8,265,605 B2 9/2012 Marett et al.
8,268,546 B2 9/2012 Kobayashi et al.
8,283,290 B2 10/2012 Langan et al.
8,308,891 B2 11/2012 Drake et al.
8,337,006 B2 12/2012 Hale et al.
8,343,574 B2 1/2013 Downs et al.
8,349,114 B2 1/2013 Green
8,373,558 B2 2/2013 Sagady et al.
8,387,673 B2 3/2013 Spengler

(56) References Cited

U.S. PATENT DOCUMENTS

| | | | |
|---|---|---|---|
| 8,392,279 | B2 | 3/2013 | Reichhart |
| 8,398,224 | B2 | 3/2013 | Hale et al. |
| 8,400,485 | B2 | 3/2013 | Hirota |
| 8,405,694 | B2 | 3/2013 | Hsu et al. |
| 8,425,029 | B2 | 4/2013 | Xu |
| 8,509,944 | B1 | 8/2013 | Kranyec |
| 8,626,614 | B2 | 1/2014 | Barber et al. |
| 8,688,764 | B2 | 4/2014 | Chauvin et al. |
| 2001/0049636 | A1 | 12/2001 | Hudda et al. |
| 2001/0051876 | A1 | 12/2001 | Seigel et al. |
| 2002/0040374 | A1 | 4/2002 | Kent |
| 2002/0066378 | A1 | 6/2002 | Almblad et al. |
| 2002/0186402 | A1 | 12/2002 | Jackson et al. |
| 2003/0033054 | A1 | 2/2003 | Yamazaki |
| 2003/0086123 | A1 | 5/2003 | Torrens-Burton |
| 2003/0140017 | A1 | 7/2003 | Patton et al. |
| 2004/0050279 | A1 | 3/2004 | Ibarra et al. |
| 2004/0143914 | A1 | 7/2004 | Flaherty |
| 2004/0165218 | A1 | 8/2004 | Fredlund et al. |
| 2004/0172325 | A1 | 9/2004 | Blanco et al. |
| 2005/0043011 | A1 | 2/2005 | Murray et al. |
| 2005/0070434 | A1 | 3/2005 | Drake |
| 2005/0182649 | A1 | 8/2005 | Parulski |
| 2005/0248649 | A1 | 11/2005 | Farrell et al. |
| 2006/0031128 | A1 | 2/2006 | Lamitie |
| 2007/0136125 | A1 | 6/2007 | Godwin et al. |
| 2007/0164554 | A1 | 7/2007 | Krone et al. |
| 2007/0181253 | A1 | 8/2007 | Xu et al. |
| 2008/0095940 | A1 | 4/2008 | Lee et al. |
| 2008/0249657 | A1 | 10/2008 | Wendland et al. |
| 2010/0129621 | A1 | 5/2010 | Langan et al. |
| 2010/0266817 | A1 | 10/2010 | Hirst |
| 2010/0277758 | A1 | 11/2010 | Reichhart |
| 2011/0111188 | A1 | 5/2011 | Xu et al. |
| 2011/0180202 | A1 | 7/2011 | Hirst et al. |
| 2012/0044312 | A1 | 2/2012 | Hirst |
| 2012/0219652 | A1 | 8/2012 | Simons |
| 2012/0297041 | A1 | 11/2012 | Momchilov |
| 2012/0301122 | A1 | 11/2012 | Chao et al. |
| 2012/0320136 | A1 | 12/2012 | Xu |
| 2012/0327257 | A1 | 12/2012 | O'Keefe et al. |
| 2013/0036018 | A1 | 2/2013 | Dickerson |
| 2013/0045341 | A1 | 2/2013 | Ramsden |
| 2014/0108188 | A1 | 4/2014 | Comstock et al. |
| 2015/0028094 | A1 | 1/2015 | Will et al. |
| 2015/0029285 | A1 | 1/2015 | Will et al. |
| 2015/0029288 | A1 | 1/2015 | Will et al. |
| 2015/0032528 | A1 | 1/2015 | Will et al. |

FOREIGN PATENT DOCUMENTS

| | | | |
|---|---|---|---|
| GB | 2 130 144 | A | 5/1984 |
| WO | WO 95/05609 | A2 | 2/1995 |
| WO | WO 96/06729 | A1 | 3/1996 |
| WO | WO 97/09180 | A1 | 3/1997 |
| WO | WO 99/48085 | A1 | 9/1999 |
| WO | WO 99/50801 | A2 | 10/1999 |
| WO | WO 00/07822 | A1 | 2/2000 |
| WO | WO 2005/105470 | | 11/2005 |
| WO | WO 2008/144839 | | 12/2008 |
| WO | WO 2009/053721 | A1 | 4/2009 |
| WO | WO 2011/003125 | | 1/2011 |
| WO | WO 2011/039785 | | 4/2011 |
| WO | WO 2012/141985 | A1 | 10/2012 |

OTHER PUBLICATIONS

All American Mfg & Supply Co., "iNeo Smartphone Case Designer Brochure," Philadelphia, PA, USA, available at http://www.screenprintsupply.com/downloads/ineo/INEO-Brochure.pdf, 2 pages.

All American Mfg & Supply Co., "iNeo, A Smart Phone Case Printer," http://www.screenprintsupply.com/i-neo-a-smart-phone-case-printer/, 7 pages.

Edwards, "Vending Machines Go Cellular," *Las Vegas Review-Journal,* Oct. 13, 1996, pp. 1F-2F, Las Vegas, NV, USA.

Lopez de Ipina et al., "GPRS-based Real-Time Remote Control of MicroBots with M2M Capabilities," *The Fourth International Workshop on Wireless Information Systems,* May 2005, pp. 42-51, Miami, FL, USA.

Cherkassky et al., "The E-volution of Wireless Vending." *Beverage World,* Feb. 15, 2000, 13 pages.

Kasavana et al., "Kiosk technology will give vending new capabilities," *Automatic Merchandiser,* Dec. 1, 2007, 7 pages.

European Patent Office, International Search Report for PCT Application No. PCT/US2014/047396, Dec. 16, 2014, 6 pages.

European Patent Office, Written Opinion of the International Searching Authority for PCT Application No. PCT/US2014/047396, Dec. 16, 2014, 7 pages.

European Patent Office, International Search Report for PCT Application No. PCT/US2014/046944, Dec. 15, 2014, 6 pages.

European Patent Office, Written Opinion of the International Searching Authority for PCT Application No. PCT/US2014/046944, Dec. 15, 2014, 9 pages.

European Patent Office, International Search Report for PCT Application No. PCT/US2014/047527, Feb. 12, 2015, 3 pages.

European Patent Office, Written Opinion of the International Searching Authority for PCT Application No. PCT/US2014/047527, Feb. 12, 2015, 7 pages.

European Patent Office, International Search Report for PCT Application No. PCT/US2014/045719, Feb. 13, 2015, 3 pages.

European Patent Office, Written Opinion of the International Searching Authority for PCT Application No. PCT/US2014/045719, Feb. 13, 2015, 9 pages.

European Patent Office, International Search Report for PCT Application No. PCT/US2014/047142, Feb. 19, 2015, 3 pages.

European Patent Office, Written Opinion of the International Searching Authority for PCT Application No. PCT/US2014/047142, Feb. 19, 2015, 9 pages.

Office Action, U.S. Appl. No. 13/951,127, Mar. 17, 2015, 7 pages.

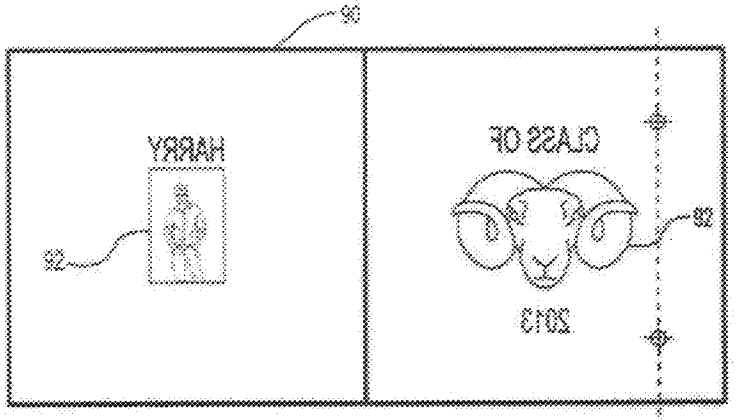
FIG. 9A
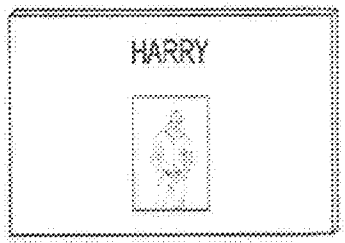
FIG. 9B
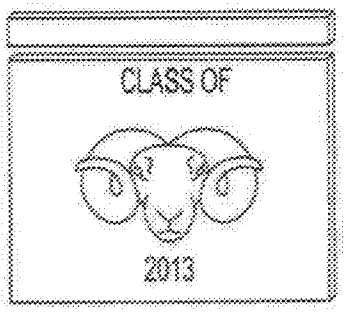
FIG. 9C
FIG. 9D
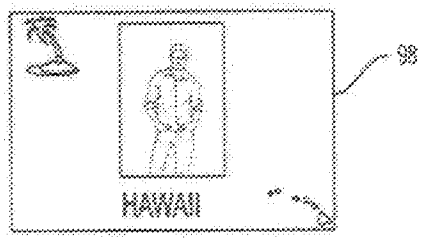
FIG. 9E
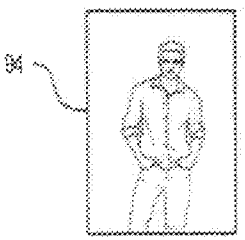
FIG. 9F

MODULAR SUBLIMATION TRANSFER PRINTING APPARATUS

CROSS-REFERENCE TO RELATED APPLICATIONS

This application claims priority under 35 U.S.C. §119 to U.S. Provisional Application No. 61/911,928, filed on Dec. 4, 2013, and is a continuation-in-part under 35 U.S.C. §120 of U.S. application Ser. No. 13/951,127, filed Jul. 25, 2013; a continuation-in-part of U.S. application Ser. No. 13/951,150, filed Jul. 25, 2013; a continuation-in-part of U.S. application Ser. No. 13/951,175, filed Jul. 25, 2013; and a continuation-in-part of U.S. application Ser. No. 13/951,196, filed Jul. 25, 2013; each of which is expressly incorporated herein by reference in its entirety.

FIELD

The present disclosure generally relates to dye sublimation transfer printing, and more particularly, to an apparatus for sublimating an image on a product capable of incorporating sublimation dye.

BACKGROUND

Dye sublimation is a process employing heat and pressure to convert solid dyes into gaseous form without entering an intermediate liquid phase. Such a process can infuse colored dye into certain compatible materials, such as polyester or ceramics, to create a permanent printed image on the material.

Two primary types of dye sublimation printing systems exist in the marketplace. In a "direct" sublimation system, the printing system is configured to sublimate an image directly onto a compatible surface. Alternatively, in "transfer" systems, the images to be sublimated are first printed on an intermediate media, such as a coated paper or ribbon, and then transferred to a compatible surface using heat and pressure. In traditional systems of both types, images are transferred onto only one side of a product.

Advances in printing technology and materials have made dye sublimation printing systems more accessible to the general public. Markets are developing for personalized, customized goods with sublimated graphics, but limitations of current printing solutions have prevented further integration and saturation within the marketplace. Safety is a concern, as many printing systems may present pinching hazards, expose users to potentially dangerous stored energy sources, and necessarily employ high levels of heat and pressure that could injure an untrained operator. Many systems also have large footprints that prevent ready deployment in a retail setting. Finally, the printing process can be complex, with multiple loading, aligning, and transporting steps. Development of a compact, automated sublimation printing system is needed in the art.

Several features are desirable in an integrated sublimation printing system designed for a retail environment. As discussed, a safe, automated system operable by an untrained operator, or even a customer would increase deployment possibilities. Sublimation systems deployed in a retail setting must strike several critical balances to achieve market success. The device must be capable of drawing enough power in order to apply the necessary sublimation temperature and pressure to a product, and must be able to ramp up the electrical current to do so on short notice. Additionally, the system must perform these tasks in a manner that is compatible with the existing electrical wiring configuration of the host retail establishment. Retail customers are frequently unwilling to wait at a point-of-sale for a long warm-up and calibration cycle followed by a several minute long sublimation transfer process. Consequently, a successful retail sublimation system must be capable of on-demand production and heat generation while eschewing potential burn hazards or uncomfortably heating the ambient air of the rest of the store.

Expediting and streamlining the printing and sublimation process would increase efficiency, quality, repeatability, and profitability. One means of speeding up sublimation printing is by configuring the system to simultaneously print on multiple surfaces of a three-dimensional product. Optimization in this manner not only reduces the time of the process but is safer (since flipping the product for printing on the other side is not required) and reduces material waste. Additionally, a modular apparatus comprising various subsystems would be desirable, because it could be configured to meet particular needs or applications of a user in a cost-effective manner. Furthermore, such an apparatus could be designed to fit a variety of physical footprints, widening potential marketing possibilities.

One attempt at a dye sublimation printer system capable of printing on multiple surfaces of a product is described in U.S. Pat. No. 7,563,341 (the '341 patent) issued to Ferguson, et al. on Jul. 21, 2009. In particular, the '341 patent discloses a dye transfer sublimation system in which a three-dimensional object for sublimation is placed on a structural base topped with a molded, heat-resistant surface such as silicone rubber. An image carrier sheet pre-printed with dye images is placed onto the product, and a "flexible membrane" is then lowered onto the sheet and secured with vacuum pressure. Flexible heating elements, such as an electrical circuit etched in a metal foil, are integrated into either the image carrier sheet or the flexible membrane. The system is heated in a manner that the top and possibly the side surfaces of an object may be sublimated with the printed images.

Although the systems and methods disclosed in the '341 patent may assist an operator in sublimating onto multiple surfaces of a product, the disclosed system is limited. The '341 system does not easily lend itself to streamlined automation, as no integrated system is disclosed, and the components must be manually placed and aligned. The system components are open to the air, and thus could present a safety hazard, particularly to an untrained operator. Finally, although the top and smaller sides of a three-dimensional object can be printed using this system, there is no capability for printing onto the top side of an object and the bottom side simultaneously. The system would not be readily adaptable to multiple types of products, as a membrane that fits one object well may not conform satisfactorily to fit the shape of another oddly-sized or shaped object, leading to lower transfer quality. The '341 system contains significant safety and efficiency limitations that would not make it ideal for a merchant, such as a retail outlet, seeking to add a dye sublimation system to provide and market personalized products to consumers.

The disclosed system is directed to overcoming one or more of the problems set forth above and/or elsewhere in the prior art.

SUMMARY

The present invention is directed to an improved modular integrated sublimation transfer printing apparatus. The advantages and purposes of the invention will be set forth in part in the description which follows, and in part will be apparent from the description, or may be learned by practice of the invention. The advantages and purposes of the invention will be realized and attained by the elements and combinations particularly pointed out in the appended claims.

In accordance with one aspect of the invention, a method for sublimating images on a product is disclosed. The method comprises printing one or more images identified by a customer for the product on a transfer media. The method further comprises positioning the transfer media on a substrate, and positioning at least one product onto the transfer media. The method includes folding the transfer media to substantially surround the product, wherein at least one printed image is positioned onto one or more opposing sides of the product to be sublimated. The method also includes configuring a single thermal cycle for a single heating platen such that the images will be sublimated substantially simultaneously onto each side of the product in a single thermal cycle, and bringing the single heating platen and transfer media into contact. Finally, the method comprises sublimating at least one image from the transfer media to each side of the product using the configured single thermal cycle of the single heating platen.

In another aspect, the invention is directed to an automated sublimation apparatus for sublimating an image on a product. The apparatus comprises a dye sublimation transfer printer configured to receive a digital image file representing an image, and further configured to print the received image on a transfer media. The apparatus further comprises a substrate configured to receive the transfer media. Additionally, the apparatus includes one or more heating platens configured to sublimate the printed image onto one or more opposing sides of the selected product. The apparatus also includes a housing substantially enclosing the dye sublimation transfer printer, substrate, and one or more heating platens in a manner that prevents a user from contacting the enclosed components. Finally, the apparatus comprises a user interface device configured to permit the user to determine an image for printing.

In yet another aspect, the invention is directed to a vending apparatus for providing a user with a customized sublimated product. The vending apparatus comprises a dye sublimation transfer printer which is configured to receive a digital image file representing an image from the user, and further configured to print the received image on a transfer media. The vending apparatus further comprises a substrate configured to receive the transfer media. The vending apparatus includes one or more product storage containers configured to store a plurality of products. Additionally, the vending apparatus comprises a robotic transport mechanism configured to place the transfer media on the substrate, retrieve a selected product from a storage container, and position the product on the transfer media. The vending apparatus includes one or more heating platens configured to engage the transfer media and sublimate the printed image onto one or more opposing sides of the selected product in a single thermal cycle. Also, the vending apparatus includes a cooling system configured to cool the sublimated product to at least about an ambient temperature. The vending apparatus further comprises a delivery opening configured to provide the cooled article to the user. The vending apparatus also includes a housing substantially enclosing the dye sublimation transfer printer, substrate, one or more product storage containers, robotic transport mechanism, one or more heating platens, and cooling system in a manner that prevents a user from contacting the enclosed components. Finally, the vending apparatus comprises a user interface device configured to permit the user to determine one or more images for printing, select one of the plurality of products on which to sublimate the one or more images, and facilitate payment by the user for the sublimated product.

Additional objects and advantages of the invention will be set forth in part in the description which follows, and in part will be apparent from the description, or may be learned by practice of the embodiments. The objects and advantages of the invention will be realized and attained by the elements and combinations particularly pointed out in the appended claims.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate various embodiments and aspects of the disclosed embodiments and, together with the description, serve to explain the principles of the disclosed embodiments. In the drawings:

FIGS. 9A-9F are diagrammatic illustrations of customized images produced by an integrated dye sublimation transfer printing vending machine consistent with disclosed embodiments;

DETAILED DESCRIPTION

Figure 1A:
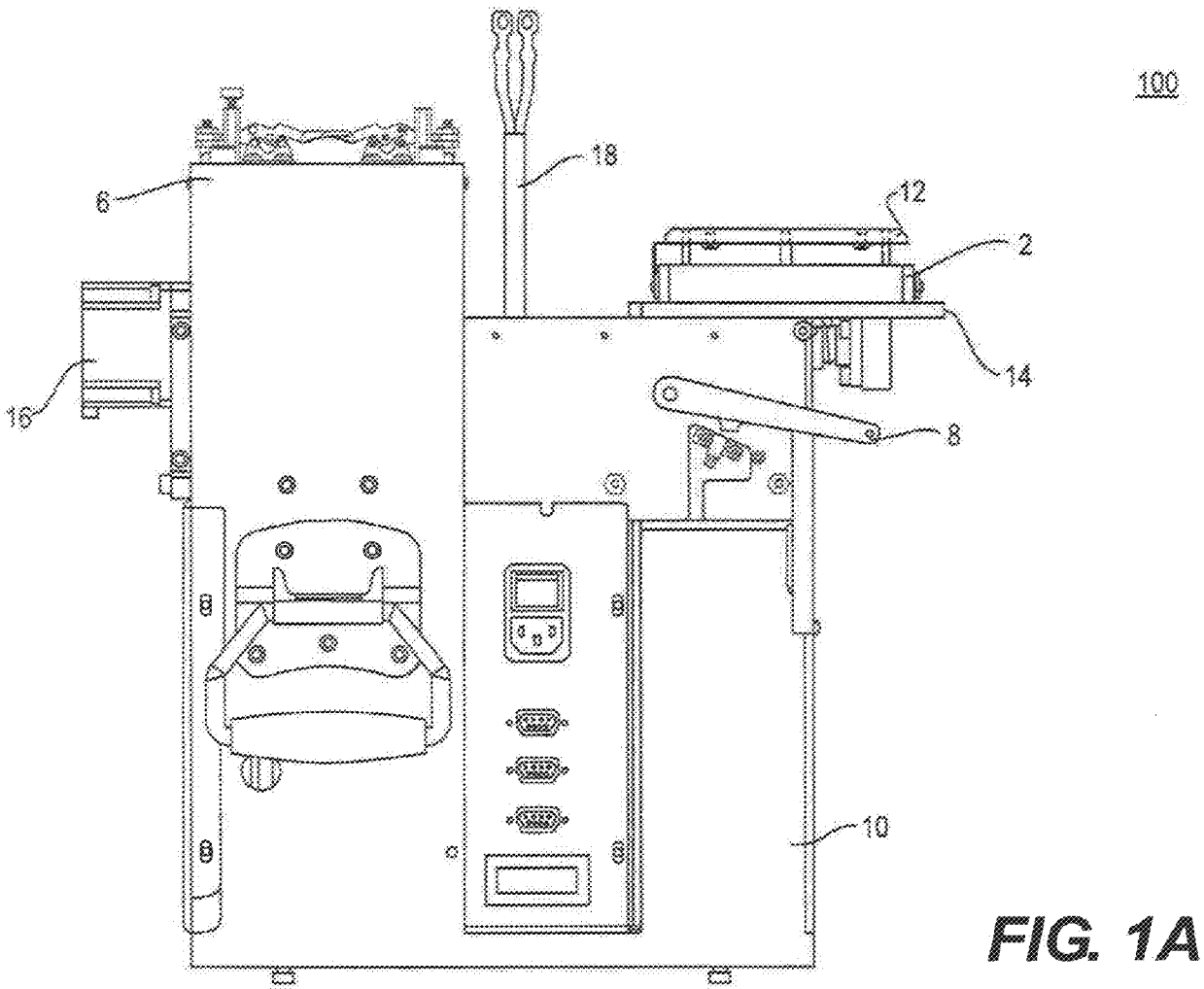
FIG. 1A is a pictorial front view of an exemplary dye sublimation transfer printing apparatus consistent with disclosed embodiments.

Reference will now be made in detail to various embodiments, examples of which are illustrated in the accompanying drawings. Wherever possible, the same reference numbers will be used throughout the drawings to refer to the same or like parts.

FIGS. 1A-1C and 2 illustrate an exemplary dye sublimation transfer printing apparatus 100. Apparatus 100 may contain various interchangeable modular fixtures configured to complete printing and sublimation tasks. As used herein, "modular" is not used in a manner requiring a completely separate modular arrangement. Rather, "module" is used more generally to refer to the components necessary to provide the required functionality. In effect, the noted modules are subsystems within the integrated apparatus. Depending upon the applications and requirements of a given customer, the integrated apparatus can be customized to include only the desired subsystems. As such, FIGS. 1A-1C and 2 illustrate but one example of an apparatus within the scope of the invention.

Apparatus 100 may be configured in a variety of ways depending on the needs and applications of the user. In some embodiments, apparatus 100 may be configured as a full kiosk, in which most if not all components of the apparatus are fully enclosed. In such embodiments, all components may be fully automated and an untrained user may be capable of operating the entire apparatus. An added advantage is that the untrained user faces no risk of injury from heat, clamping, pinching, or moving parts since the kiosk is fully enclosed.

In other embodiments, apparatus 100 may be configured as a clerk-operated kiosk with an offboard inventory of products to be sublimated. In this configuration, a subset of the automated modules discussed above may be substituted with manual variations operable by an operator such as a clerk or employee of a retail establishment. A clerk-operated kiosk may be situated in a retail establishment in a location accessible to employees of the establishment, such as behind a counter or in a restricted area. In the clerk-operated kiosk configuration, apparatus 100 may or may not have all components enclosed.

In still other embodiments, apparatus 100 may be configured as a customer-operated kiosk with an offboard inventory of products to be sublimated. In this configuration, a subset of the automated modules discussed above may be substituted with manual variations operable by an untrained operator such as a customer of a retail establishment. A customer-operated kiosk with an offboard inventory of products to be sublimated may be situated in a retail establishment in a location potentially accessible both to customers of the establishment and to employees of the establishment. In the customer-operated kiosk configuration, apparatus 100 may or may not have all components enclosed. The non-enclosed components may not be fully accessible to the customer. In some embodiments, apparatus 100 may be configured as a hybrid kiosk with offboard inventory, with some modules configured to be operable by a clerk, and some configured to be operable by a customer.

Apparatus 100 may interface with a printer (not shown for simplicity in FIGS. 1A-1C and 2) for printing images onto transfer media. The associated printer may be electronically configured to receive a digital image file from an operator or a customer. The digital image file may represent images such as pictures, text, stylized text, or a combination of these elements. In some embodiments, the printer may receive the digital image file directly, and may include digital media input interface components. In other embodiments, the printer may be linked via a physical or a network connection to a distinct interface device or module (not shown) which is configured to receive the digital image file and/or permit a user to determine a digital image file for printing. For purposes of this disclosure, "determining" an image file for printing may comprise simply confirming or verifying a submitted image, if the user wishes to print the exact image that was submitted, or may further comprise modifying the submitted image or adding features to the image as described herein.

Apparatus 100 and an associated printer may be configured to receive a digital image file from a user in various ways, including but not limited to receiving insertion of flash memory or a USB drive, connecting via a USB or Firewire® cable, receiving image files by email, receiving image files uploaded via a mobile application, retrieving user-submitted image files from an online library or website, etc. In some embodiments, apparatus 100 may include a scanner, which can receive a physical image from a user, convert it into a digital image file, and provide it to the printer. The scanner may be further configured to enhance or alter the acquired digital image file before providing it to the printer. Examples of image file enhancements may include, but are not limited to, changing the size of the image, rotating, reversing, or translating the image, altering color brightness, reducing blur, de-skewing, cropping, etc. Therefore, printing the received image may comprise printing the exact image submitted by the user, or may comprise printing a modified version of the received image. In these embodiments, the modifications may include the image file enhancements discussed above, or may further comprise additions to the received image such as pictures, text, or stylized text as described above.

In some embodiments, apparatus 100 may be configured to detect that a submitted image file is of low resolution, and may sublimate at low quality at a particular size or on a particular object desired by the user. In these embodiments, apparatus 100 may provide a textual or audible warning to the user (either a clerk operator or a customer) via an associated user interface device (such as that described below in association with FIG. 5). The user may be prompted to submit a new image, or to choose a different image size or product. In some embodiments, apparatus 100 may be configured to not proceed with the sublimation task if the image is of low resolution. In other embodiments, apparatus 100 may present the warning to the user, but may proceed with the sublimation task anyway. In these embodiments, apparatus 100 may prohibit further modification of the image, such as enlargement, if the image is of low resolution. Apparatus 100 may additionally provide a printed receipt or other memorialization that the digital image file submitted was of insufficient resolution to produce a quality sublimated image.

In other embodiments, the associated printer may be configured to receive a digital image file selected at the point of sale by a user from a library or database containing a plurality of preloaded stock image files. In still other embodiments, the printer may be configured to receive digital image file taken by a camera, which may be (but need not necessarily be) associated with apparatus 100. In yet other embodiments, apparatus 100 may be capable of receiving input in the form of text from a user, and may convert or incorporate the text into a printable digital image file for sublimation. The associated printer may be configured to utilize standard sublimation dyes known in the art to print the received digital image file onto suitable transfer media. The transfer media may comprise any material capable of receiving a printed dye image, including but not limited to coated or uncoated paper, card stock, film, resin, wax, ribbon, tape, etc.

In the illustrations shown in FIGS. 1A-1C and 2, an associated printer is configured to print images onto individual sheets of transfer media. In some embodiments, the printer may include or be connected to a bulk storage unit containing a plurality of sheets of transfer media. In other embodiments, individual sheets of the transfer media may be fed into the printer one sheet at a time. The printer may be configured to automatically feed the sheets of transfer media into proximity with the print head and sublimation dyes for printing. Alternatively, the printer may be configured as a manual, hand-fed printer in which an operator may introduce each sheet of transfer media into the printer. Some embodiments of apparatus 100 may be configured for both manual and automatic sheet feeding.

The associated printer may be configured to print a dye image on one side of each sheet of the transfer media, or alternatively may be capable of printing dye images on both sides of each sheet. The printer may be configured to print the images in a single pass, or may require two passes, such as for complex images, multiple colors, or multiple layers of images. For example, a printed dye image may include multiple distinct images superimposed into a single image. The printer may print the superimposed image in a single pass, or may print each constituent image in its own pass through the machine.

In some embodiments, the sheets of transfer media supplied to the printer associated with apparatus 100 may be configured to facilitate transfer of a printed image onto multiple surfaces of a product. The sheets of transfer media may contain pre-treatments or features that bisect the sheets and enhance the reliability and repeatability of folding. In some embodiments, the sheets may be pre-creased. In other embodiments, the sheets may be pre-scored. In yet other embodiments, the sheets may be perforated. In alternative embodiments, the bisecting feature may comprise a line pre-printed onto the transfer media that is configured to align with other components of the apparatus to assist with folding, which will be described in further detail below.

In some embodiments, apparatus 100 may employ mechanical or optical non-contact sensing elements to assist with alignment of the pre-printed line. In these embodiments, an associated printer may print one or more images on either side of the bisecting feature of the sheet to correspond to images that will be sublimated onto various surfaces of a product. The pre-creasing, pre-scoring, pre-printing of a line, and/or perforation of the sheets readily enables proper alignment of the printed images with respect to each other, with respect to apparatus 100, and with respect to the products to be sublimated. In some embodiments, the bisecting feature may serve as a positional register for the apparatus, since its location is predictable on the sheets of transfer media. The pre-creasing, pre-scoring, pre-printing of a line, and/or perforation of the sheets of transfer media further facilitates sublimation of images onto opposing sides of a product. Apparatus 100 may include components (described in further detail below) that are configured to manipulate the transfer media at the bisecting feature (e.g. crease, score, line, or perforation), in a manner that substantially surrounds both sides of a product. For purposes of this disclosure, to "substantially surround" a product means covering two or more of its surfaces. In such embodiments, both sides can be sublimated substantially simultaneously with increased efficiency and reduced time, wear on the machine, and waste.

Transfer printers associated with disclosed embodiments may provide printed sheets of transfer media to other components of apparatus 100 in various ways. In some embodiments, gravity may assist providing of the printed sheets. When printing is complete, the sheet may naturally fall onto a tray or other staging area associated with the printer and interact with other components of apparatus 100. In other embodiments, components may assist the printed sheets of transfer media to interact with other components. For example, the printer may interface with a feed line comprising a series of guides and rollers that may lead the sheet to the next component of the apparatus. Additional detail regarding one such embodiment of an automated printer feeding system will be described below in association with FIG. 16.

In alternative embodiments, particularly clerk-operated kiosk embodiments with offboard inventory, apparatus 100 may be configured to simply allow an operator to place and transport the printed transfer media by hand to other parts of the system. In these embodiments, as illustrated in FIGS. 1 and 2A-2B, the associated printer may be disposed in a manner such that it is separate from the rest of the components of apparatus 100 and not enclosed in any kiosk or housing associated with the apparatus. For example, apparatus 100 and its associated printer or printers may not be physically connected to one another. In these embodiments, an operator may feed the sheet or sheets of transfer media into the printer for printing, and then manually place the transfer media, now containing the printed images, into the other components of apparatus 100. In still other embodiments, apparatus 100 may include an active transport mechanism to assist with positioning of the transfer media. In still other embodiments, a user may place the transfer media with a printed image directly onto a substrate within the housing.

Components of apparatus 100 will now be described in detail. Substrate 2 is a substantially flat platen configured to receive the transfer media and align and register it to prepare for the sublimation process. In some embodiments, substrate 2 may be a bare platen comprised of a metal (such as steel or aluminum), plastic, or composite product. In preferred embodiments, substrate 2 may be coated or covered with a thermally insulating material, such as a thermal neoprene or a foam rubber, to minimize unwanted heat transfer and loss during the sublimation process. In alternative embodiments, substrate 2 may be configured to provide heat to the sublimation process. Substrate 2 may include components that assist in positioning and securing the transfer media to ensure faithful transfer of the printed image to a desired product. In some embodiments, particularly the clerk-operated kiosk embodiments discussed above, an operator may place the printed transfer media directly onto substrate 2.

In some embodiments, substrate 2 may include a clamping system 12 comprising one or more clamps disposed on top of the substrate to secure the transfer media to the substrate for sublimation. Clamping system 12 will be described in further detail below in association with FIG. 22. In brief, one or more clamps may be situated onto substrate 2 that may be automatically engaged or released to secure the transfer media during sublimation. In some embodiments, the clamps may be spring-loaded. In preferred embodiments, two or more such clamps opposing one another may be used as part of clamping system 12. Each of the clamps may comprise one or more bolts penetrating the clamp arms themselves. A solenoid (for example, solenoid 26 in FIG. 2) may be energized to compress and lift the bolts, releasing the clamp pressure. At this point, the transfer media may be aligned onto the substrate, either manually or automatically. When properly aligned, solenoid 26 is de-energized, and the bolts lower back into the clamping arms of clamping system 12, compressing and securing the transfer media to substrate 2. In some embodiments, substrate 2 may include features, such as contact or non-contact sensors, to assist with the registration and alignment of the transfer media and/or the products that will receive the sublimated image. Further detail of exemplary mechanical and non-contact sensors is described below and illustrated in FIG. 11.

In alternative embodiments, substrate 2 may be disposed above a vacuum system (not shown) which provides light suction to secure a portion of the printed transfer media onto substrate 2. In clerk-operated kiosk embodiments discussed above, an operator may energize the vacuum system and enable it to pull the transfer media onto substrate 2 using negative pressure. In automated embodiments, a control unit for the apparatus (not shown) may energize the vacuum system upon placement of the transfer media onto substrate 2. A vacuum generator may be used to provide the negative pressure for the system. In some embodiments, the generator may be electric; in other embodiments, a pneumatic venturi system may provide the negative pressure. In some embodiments, one or more switches and/or pressure transducers may be placed on vacuum supply lines or other components of the vacuum system. In these embodiments, the switches and/or transducers may serve multiple functions, including providing feedback to the system and to an operator about the health and maintenance status of the vacuum generator and associated pumps, or any other components of the system. Additionally, the switches and/or transducers may play a feedback role in the sublimation process itself. For example, a control unit associated with the sublimation process may detect that the vacuum switch is not triggered, or that the pressure transducer is generating a reading outside of a pre-determined range. In these embodiments, an associated user interface device (not shown) may provide feedback to an operator or to a customer that the transfer media is either absent or not properly aligned, and apparatus 100 may pause until the problem is resolved.

In some embodiments, substrate 2 may be disposed on a linear motion stage 14. Whether apparatus 100 is deployed as a clerk-operated kiosk, or as an automated system, safety and efficiency are essential in a sublimation system. The placement of substrate 2 on a linear motion stage, such as stage 14, allows increased accessibility to the substrate by an operator or by components of an automated system. In these embodiments, substrate 2 may be conveyed to a "home position" that may be a pre-defined distance away from elements of the sublimation system associated with heat and pressure. The home position may be registered in a coordinate system or other such localization system, and may enable a controller for apparatus 100 to return substrate 2 to the proper home position before and/or after each sublimation cycle. Linear motion stage 14 facilitates proper placement and alignment of the transfer media by allowing more operational space for the system. In clerk-operated kiosks, an operator can place and align the transfer media without worry of danger from other system elements. In automated systems, robotic elements (described in further detail below) may be enabled to more precisely place and align the transfer media. In some embodiments, linear motion stage 14 may be powered by a stepper motor 16. In other embodiments, linear motion stage 14 may be powered by electric, hydraulic, or pneumatic components of apparatus 100, such as components of a hydraulic system as illustrated in FIGS. 1A-1C and 2.

Figure 1B:
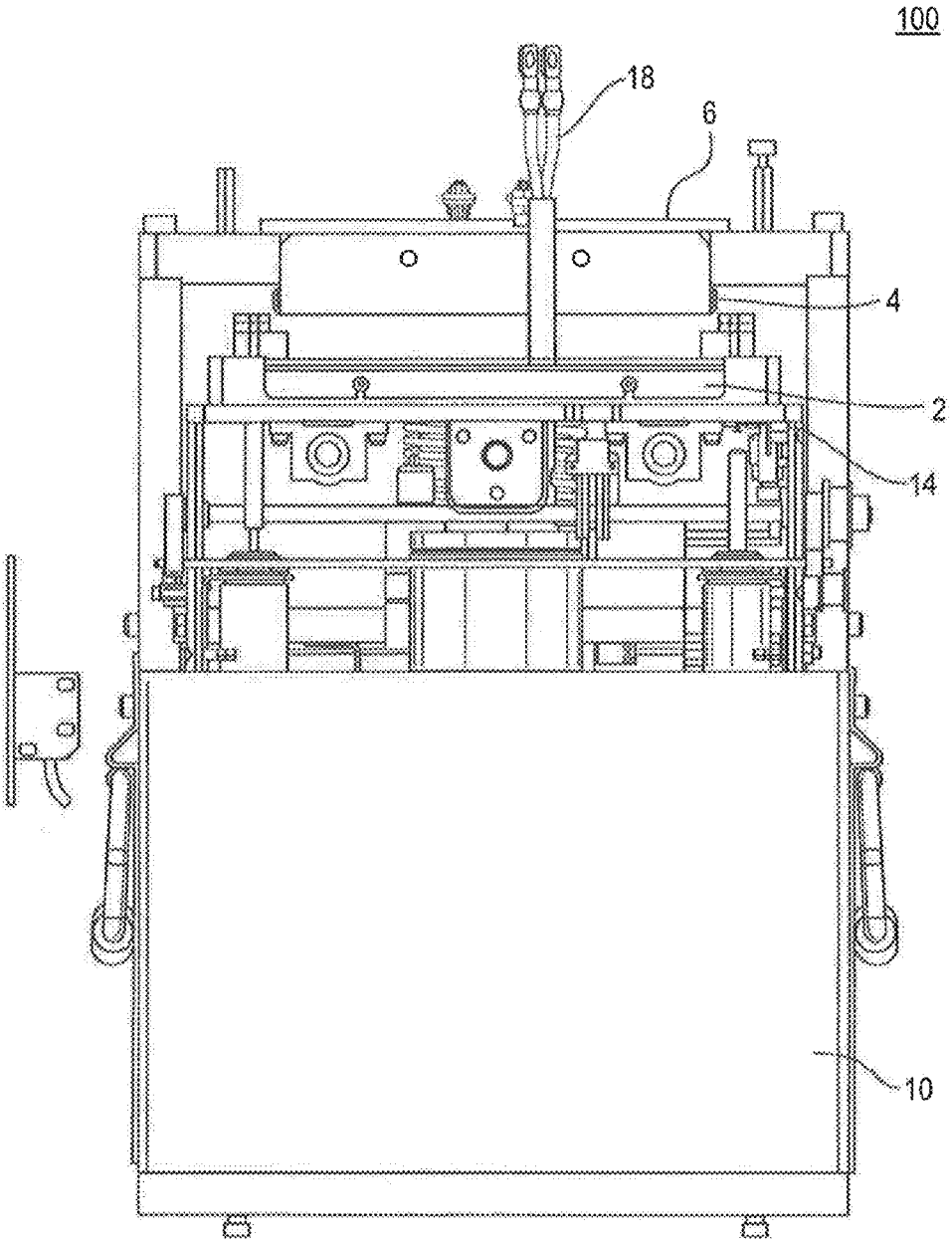
FIG. 1B is a side view of the dye sublimation transfer printing apparatus of FIG. 1A.
Figure 1C:
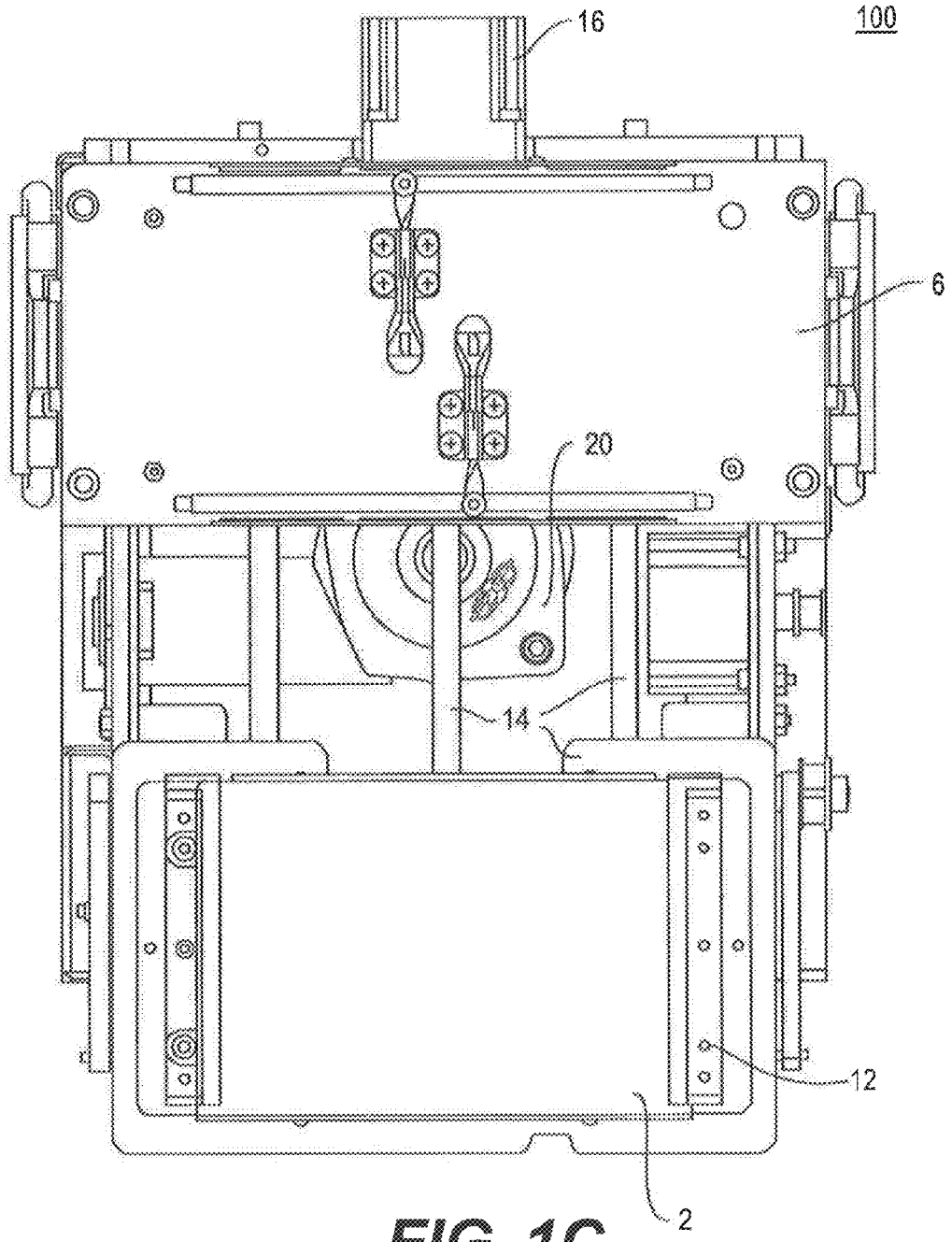
FIG. 1C is a top view of the dye sublimation transfer printing apparatus of FIG. 1A.

Apparatus 100 may include one or more components to assist with manipulating the transfer media once placed and secured on substrate 2. In some embodiments, apparatus 100 may comprise a motorized swing-arm mechanism 8 to mechanically assist in the folding, unfolding, and eventual disposal of the transfer media. Operation of swing-arm mechanism 8 will be described in further detail below in association with FIGS. 3A-3D. In brief, swing-arm mechanism 8 may be configured to move in a range of motion that performs various functions within apparatus 100. At the onset of the sublimation process, substrate 2 may be at its home position with respect to linear motion stage 14. After the transfer media is placed and secured onto substrate 2, swing-arm mechanism 8 may support a portion of the transfer media not engaged by the clamp system described above. As can be seen in FIGS. 1A-1C, swing-arm mechanism 8 may comprise a bar situated in a fixed position between two mechanical arms. The assembly may be put in motion by a stepper motor, and motion may be governed by one or more drive belts (not shown). At a pre-defined time, swing-arm mechanism 8 may begin clockwise motion via an associated stepper motor to fold the transfer media to substantially surround the product to be sublimated. In embodiments where multiple sides of a product are to be sublimated, swing-arm mechanism 8 may position at least one printed image onto each side of the product to be sublimated. Upon completion of the sublimation process (described in further detail below), swing-arm mechanism 8 may engage an end of the folded-over transfer media, and begin a counter-clockwise motion to unfold the transfer media. After the sublimated product is removed from substrate 2, either by an operator or by automated system components, swing-arm mechanism 8 may be moved by an associated stepper motor to engage the transfer media left behind and remove it from substrate 2 after clamp pressure is released by clamping system 12. In some embodiments, the transfer media may be removed into a waste bin within the housing that may be periodically emptied by an operator. In other embodiments, the transfer media may be removed onto a section of the floor of the housing that may open in the manner of a trap door to dispose of the transfer media. In other embodiments, the used transfer media may be directed into a shredder (not shown). Alternatively, a robotic transport mechanism such as the one described below in association with FIGS. 6A-6B and 7 may remove the used transfer media from substrate 2 and dispose of it.

Apparatus 100 may sublimate the printed images on the transfer media to selected products using heating platen 4. Apparatus 100 may contain one or more heating platens. In the embodiment illustrated in FIGS. 1A-1C and 2, apparatus 100 contains a single heating platen 4. However, in alternative embodiments, more than one heating platen may be employed in apparatus 100, and substrate 2 may constitute a second heating platen. In alternative embodiments, multiple heating platens may be placed in series, with non-heated platens such as substrate 2 opposing each heated platen. Heating platen 4 may be comprised of any heat-conductive material, such as metal or ceramic. In some embodiments, heating platen 4 is comprised of cast iron, aluminum, or zinc. Heating platen 4 may be surrounded by a heat shield 6, which may be comprised of a material that insulates the system and reduces heat transfer to the exterior surfaces and surrounding elements of apparatus 100. Heat shield 6 may be comprised of metal, plastic, ceramic, rubber, or any other suitable material.

Figure 2:
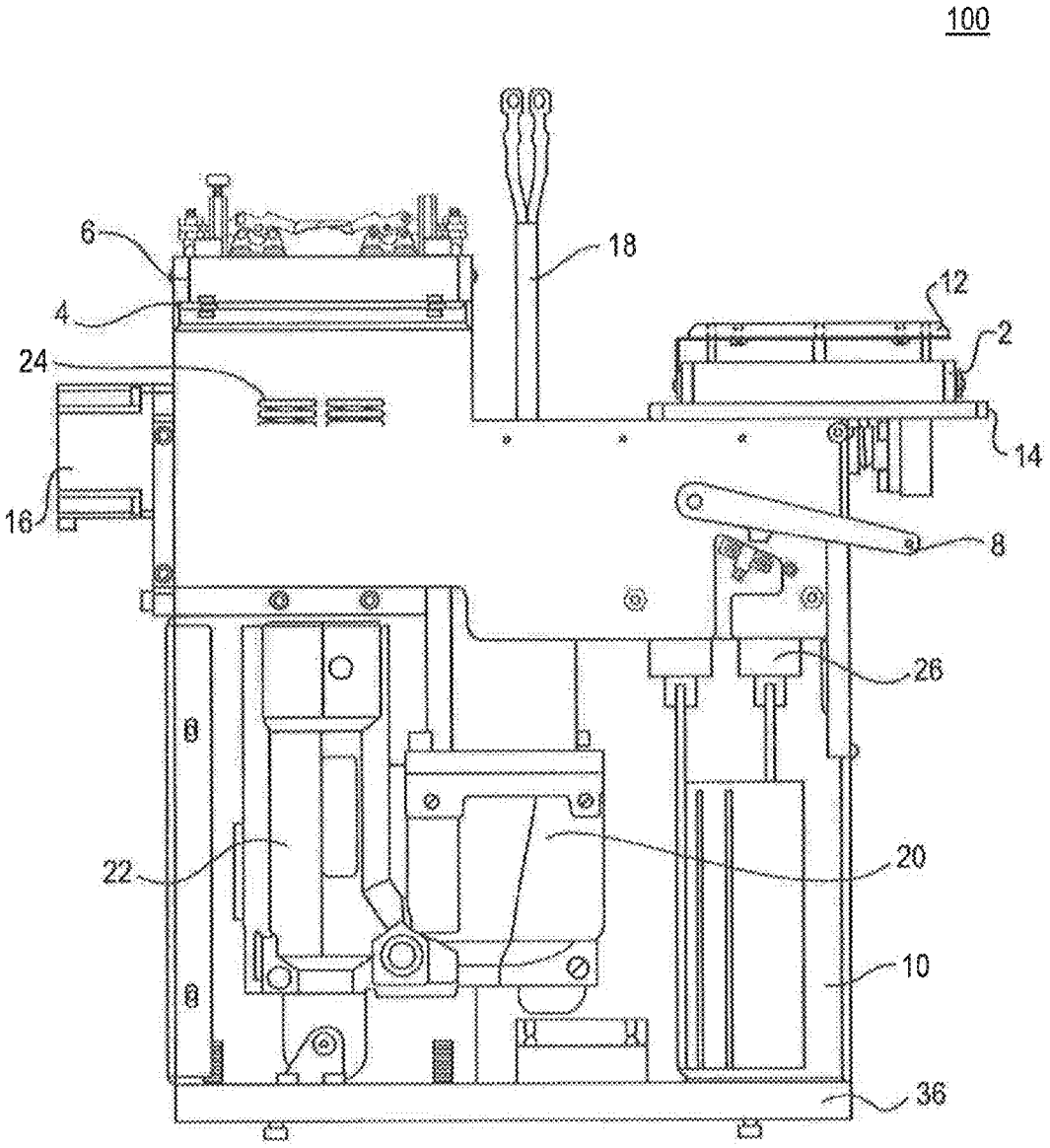
FIG. 2 is the dye sublimation transfer printing apparatus of FIG. 1A with part of the exterior housing removed to show detail.

As illustrated in FIG. 2, heating platen 4 and heat shield 6 are secured by one or more bolts or other such fasteners to press frame 36 of apparatus 100. Press frame 36 may be made of any suitable material capable of providing sufficient structural support for apparatus 100, such as a metal or a composite material. Frame 36 may be comprised of a material that reduces conductivity of heat and/or electricity to other components of apparatus 100. In some embodiments, frame 36 may be joined, by fasteners or by welding, to a press frame base plate (not shown). The press frame base plate may be comprised of metal, plastic, rubber, or any other suitable material that provides structural support and safety features to operators of apparatus 100. In some embodiments, the press frame base plate may be further joined to a press mounting match plate (not shown), which may permit mounting of apparatus 100 within a housing 10 that substantially encloses components of apparatus 100.

Heating platen 4 may additionally be coated with a compliant material. Such a coating may comprise a foam, rubber, or plastic possessing the ability to maintain structural integrity under high temperatures and pressures. The compliant nature of the platen coating assists in the application of an even heat and pressure across all surfaces to be sublimated. Maintaining consistency of heat and pressure results in higher quality sublimated products, and reduces the risk of damage to either the product or the platen. In some embodiments, substrate 2 may be similarly coated with such a compliant material, which will be described in further detail below. In some alternative embodiments, heating platen 4 itself may have inherent flexibility, and may be capable of deformation across a product during sublimation to ensure even application of heat and pressure.

In some embodiments, apparatus 100 may include one or more interchangeable modular fixtures (not shown) configured to further facilitate alignment of the transfer media and placement of a product onto substrate 2, and to serve as a staging position. The modular fixtures will be described in further detail below in association with FIG. 15. The modular fixtures, when present, may each constitute a platform, basin, magazine, or any structure/area that can receive and provide one or more products or accessories to be sublimated. When present, the modular fixtures may be constituent parts of apparatus 100, may be adjacent to the apparatus, or may be proximal to apparatus 100 but not in contact with its components. In some embodiments, the modular fixtures may be pre-configured to substantially match the dimensions of a selected product. For example, in some embodiments a modular fixture may include one or more dedicated areas or regions sized and shaped to readily fit one of each of a plurality of products available to the apparatus for sublimation. In other embodiments, a modular fixture may include a single area tailored to fit a single type of product. In still other embodiments, a modular fixture may include an area tailored to universally fit any product available to the apparatus for sublimation. The modular fixtures may be configured to receive products in an automated manner from other components of apparatus 100, or alternatively may be configured to receive products manually placed by a user (e.g., a store employee or a customer).

As part of the sublimation process, particularly in clerk-operated kiosk embodiments, one or more selected products for sublimation may be placed on a modular fixture for introduction into apparatus 100. The products may be originally packaged with the modular fixture, or may be placed there either manually or automatically for purposes of a sublimation task. Controlled orientation of the product to be sublimated is important for completion of a high-quality sublimation task. To that end, products for sublimation may comprise packaging or other external features that permit proper localization and registration of the products within the apparatus at all times. The products, whether packaged or unpackaged, may nest within one another or within the defined tailored areas of the modular fixtures. Products for sublimation may be comprised of various materials. In some embodiments, the products may be comprised of plastic. In other embodiments, the products may be comprised of metal, such as aluminum, brass, or steel. In alternative embodiments, the products may be comprised of a ceramic material, a fabric or textile material, wood, fiberglass, or glass. In some embodiments, the product, regardless of its constituent material, may be additionally coated with a material to enhance integration and permanence of the sublimation dye, such as a polyester material. The added coating may be introduced to the surface of the product in various ways, such as spraying, dipping, painting, etc.

Possible candidate products and accessories for use in apparatus 100 may include, but are not limited to, luggage tags, pet tags, bookmarks, identification tags, dog tags, gift tags, ornaments, picture frames, picture frame inserts, cases for a mobile device, inserts for cases for a mobile device, various types of jewelry, such as pendants, bracelets, watch bands, earrings, necklaces, etc., fabrics, such as clothing, banners, draperies, etc., and any item that could integrate sublimation dye and bear a sublimated image. In some embodiments, products for sublimation in apparatus 100 are flat plates with opposing surfaces. In some embodiments, the products for sublimation may include keys, key heads, or key blades. In other embodiments, products could be flat, three-dimensional shapes, such as cubes. In still other embodiments, curved surfaces are possible. In these embodiments, products such as coffee mugs, decorative glass products such as vases or barware, sports balls, and medical identification bracelets could be candidates for receiving sublimated images. Candidate products for sublimation may be provided by the user, or they may be disposed within or proximal to the printing apparatus. In some embodiments, described in further detail below, the apparatus may be configured as a vending apparatus and the products may be situated inside of the apparatus. In some configurations, the vending apparatus may be capable of receiving a product inserted into the machine by a user. The apparatus may be further configured to receive, sublimate, and/or dispense accessory items that match or accompany candidate products for sublimation. The accessories, in a similar manner to the products, may be contained within the apparatus, proximal to the apparatus, or may be inserted into the apparatus by a user. Examples may include, but not be limited to, picture frames, luggage tag holders, bracelets, jewelry, key chains, necklaces, key rings, etc. In some embodiments, the inserted accessory may be a pre-packaged accessory designed to accompany the customized sublimated product.

Apparatus 100 may be configured to bring heating platen 4 and the transfer media as situated on substrate 2 into contact in order to sublimate printed images onto a product. It is to be understood that various configurations of heating platen 4, substrate 2, and other components of apparatus 100 are possible, and that all such configurations are contemplated by the claims. In some embodiments, heating platen 4 may be moved into contact with substrate 2 and the transfer media (which remain stationary) by apparatus 100. In other embodiments, substrate 2 may be moved into contact with heating platen 4 (which remains stationary). In still other embodiments, both heating platen 4 and substrate 2 may be moved.

In preferred embodiments, after the transfer media is secured to substrate 2 using the clamping system 12 described above, substrate 2 may be translated on linear motion stage 14 from its programmed home position to a position aligned in the X and Y directions with heating platen 4. In some embodiments, the position aligned with heating platen 4 may also be pre-programmed into a control system for apparatus 100, such that substrate 2 is reliably moved to the correct position at the beginning of each sublimation task. In these embodiments, apparatus 100 may be configured to press substrate 2 upward such that it is brought into contact with heating platen 4. In some embodiments, substrate 2 may be pressed upward via a hydraulic system or pneumatic system.

In embodiments with a hydraulic system, such as the embodiment illustrated in FIGS. 1A-1C and 2, the upward pressing action on substrate 2 may be provided by a system comprising a hydraulic actuator, a pump, a regulator, a reservoir, one or more pressure transducers for feedback control, and one or more control valves within the system to control the direction of the press action. In the embodiment illustrated in FIG. 2, an electric motor (not shown) and a house fluidic system (not shown) linked to apparatus 100 by cables 18 powers a hydraulic pump 20 to generate pressing force. Pump 20 transfers the force to hydraulic actuator 22, which is coupled to press ram 24. Hydraulic actuator 22 provides upward pressing force to press ram 24, which may comprise one or more springs loaded by hydraulic actuator 22. The springs of press ram 24 may be configured to engage the underside of substrate 2 once the substrate has been translated into the proper heat press position proximal to heating platen 4 by linear motion stage 14. This assembly will be discussed below in further detail in association with FIG. 23.

Hydraulic system press embodiments may be useful for sublimating products of irregular or variable thickness. Regardless of product shape or composition, apparatus 100 may be configured to apply a pre-defined, measured physical force on the product of, for example, about 30 to 40 pounds per square inch (psi). In some embodiments, the pre-defined force may be calculable based on the spring constant of the one or more springs comprising press ram 24. In these embodiments, press ram 24 may further comprise one or more sensors configured to measure the spring displacement of the one or more springs comprising the spring bed. Apparatus 100 (via the user interface device) may be pre-configured with the surface area of each type of product to be sublimated by the apparatus. From the surface area, apparatus 100 may determine the force necessary to achieve 30-40 psi of pressure at the product surface, and then may further determine a hydraulic pressure necessary within the hydraulic system to achieve such a surface pressure using press ram 24. Alternatively, apparatus 100 may receive input of these necessary pressure parameters via the user interface device. Apparatus 100 may then configure the associated hydraulic system (namely hydraulic pump 20) to generate the required pressure. During operation of the system, the one or more pressure transducers associated with the hydraulic system may measure the generated hydraulic pressure, and may transmit feedback comprising the pressure values to a control either associated with the hydraulic system or with apparatus 100 generally. If the generated hydraulic pressure does not match the pressure required for the given product type to be sublimated, the control may configure hydraulic pump 20 to generate more or less hydraulic pressure. In some embodiments, the pressure transducers may further determine and transmit feedback indicating that there is a problem with the system requiring maintenance. The control may be configured to display a message to this effect to a user via the user interface device.

Alternatively, the upward press action exerted on substrate 2 may be achieved via a motor-driven cam system (not shown). In these embodiments, a cam mechanism with a defined stroke may be used to press substrate 2 upwards and generate the required force (as above, about 30-40 psi) on the surface(s) of the product to be sublimated. The motor-driven cam system may comprise a cam and an associated cam shaft. The cam may be operably connected to cam follower assembly, which is additionally linked to a guide bushing and one or more return springs. At the top of the assembly is a press ram. Said press ram may be made of any suitable material durable enough to withstand contact and pressure exertion, such as metal, rubber, wood, or hard plastic. In some embodiments, the press ram may be covered with an additional coating to reduce friction and increase durability. The press ram may be configured to interface with the underside of substrate 2, and press it upwards from linear motion stage 14 in order to bring the substrate (and attached transfer media) into contact with heating platen 4. The press ram may be a solid cylinder, or may be shaped in a manner (such as a forked shape) to allow it to move unencumbered around other components of apparatus 100, such as linear motion stage 14. The motion of the motor-driven cam system is produced and regulated by one or more gear motors, which may be stepper motors or any other suitable mechanism for propelling elements of the cam system. The cam system may additionally comprise one or more cam position sensors, which may be configured to detect the position of elements of the cam system and provide positional feedback to the one or more gear motors, enabling them to, for example, stop upward motion of the system components when the press ram, substrate 2, and heating platen 4 are sufficiently conjoined to produce the necessary pressure on the product to be sublimated. Similarly, the one or more cam position sensors may be configured to provide feedback to the one or more gear motors enabling them to halt downward motion of the cam system components when the system has returned to a home position.

In some embodiments, the cam may be configured to accommodate products for sublimation that have variable thickness. In these embodiments, particularly for products that have two or three areas or less of variable thickness, the cam may be configured with multiple "lobes" which each define the stroke of the cam system for each of the individual product thicknesses. In some embodiments, the lobe may be a wedge-type ramped lobe. A wedge-type ramped lobe may be employed by the cam to cover a continuum of different product thicknesses. In these embodiments, apparatus 100 may be configured with one or more controls as discussed previously that control the motion of the one or more gear motors. For example, the user interface device or another optical recognition system associated with apparatus 100 (not shown) may detect or receive an indication of the product to be sublimated, and may be configured to regulate motion of the cam based on the product dimensions or other properties. In these embodiments, the one or more cam position sensors may provide real-time feedback of the position of the cam lobe(s) to the control(s) and to the gear motor(s). The gear motor(s) may drive the cam system to a pre-determined set point for the particular product and product thickness(es), and then may reverse off of the cam's lobe ramp once the sublimation process is completed.

As discussed previously, to ensure that uniform pressure is exerted across the surface(s) of the product to be sublimated, substrate 2 may be covered with a heat resistant pad to equilibrate the force across multiple shapes and thicknesses. The pad may be comprised of silicone, or any other suitable heat-resistant, pliable material. In these embodiments, the stiffness of the pad may be calibrated such that when the product is pressed into the pad by the cam system, hydraulic system, or pneumatic system, the required pressure of about 30-40 psi is applied evenly across the product surface.

Regardless of the propulsion system associated with any particular embodiment of apparatus 100 (motor-driven cam, hydraulic, or pneumatic) the entire system may be configured such that substrate 2 only moves in a purely vertical dimension. Purely vertical motion may be important in apparatus 100 because in preferred embodiments, substrate 2 is separable from linear motion stage 14 for purposes of the vertical press motion described above. Movement of substrate 2 with positional fidelity is thus essential to proper removal and re-seating into linear motion stage 14. The associated propulsion system may therefore be configured with multiple bushings, guide rods, or other positional mechanical guides to enable controlled vertical motion of substrate 2 and successful return to linear motion stage 14.

Once heating platen 4 and substrate 2 are brought into contact by the press mechanism, heating platen 4 is operated by apparatus 100 in a single thermal cycle to sublimate the printed images from the transfer media onto the product. The single thermal cycle of heating platen 4 may be configured with a temperature, pressure, and duration sufficient to successfully transfer the image(s) to the selected product. The duration of the thermal cycle, measured as the dwell time of the platen on the transfer media, may vary based on the product to be sublimated, the transfer media, and the heating temperature of heating platen 4. In some embodiments, heating platen 4 is maintained at a temperature of about 400 degrees Fahrenheit for the entirety of the time that it is in contact with the transfer media. As discussed above, the pressure of the thermal cycle may be about 30 to 40 psi.

Depending on the configuration of apparatus 100, the linear distance traveled by one or both of substrate 2 and/or heating platen 4 may be monitored and programmed as part of the single thermal cycle in lieu of or in addition to the pressure. This monitoring may be performed, for example, by a cam position sensor as described above, or by one or more other configured sensors. Additionally, linear distance may be measured based on the compression force experienced by press ram 24, which will have a known spring constant permitting accurate force and distance calculations. Alternatively, a linear potentiometer, linear variable differential transformer (LVDT), or other linear measuring sensor may be utilized to monitor and control the press distance.

Controlling linear distances may be important for avoiding breakage of a sublimated product and/or damage to the heating platen or substrate. Such a measurement could be particularly useful in the sublimation of fragile, three-dimensional objects such as ornaments or jewelry. Linear distance may be measured in alternative embodiments as the distance between heating platen 4 and substrate 2. This linear distance may be preset for particular products based on their known dimensions. In such an embodiment, one or both of substrate 2 or heating platen 4 may be pre-configured (e.g. through software) to have a "hard stop" that achieves a desired linear distance while ensuring safety of users and preventing damage to system components. In some embodiments, the temperature, pressure, and duration of the cycle are governed by a control (not shown) and software that automatically configures these parameters for the heating platen for a particular sublimation task. In some embodiments, the control is disposed within a user interface device (not shown) which is configured to determine the parameters.

The temperature, duration, and pressure of a heating platen 4 single thermal cycle may be determined based on a variety of predetermined criteria. In some embodiments, the predetermined criteria may include properties of the product being sublimated, including but not limited to dimensions of the product, the material comprising the product, the product's shape or curvature, etc. In some embodiments, the predetermined criteria may include characteristics of the printed images, including but not limited to pixel intensity or density of the printed image, colors utilized in the image, size of the image, etc. In some embodiments, heating platen 4 may be configured to provide differential heating based on the predetermined criteria; for example, one or more regions on heating platen 4 may be heated to a different temperature than one or more other regions on the platen. In other embodiments, the differential heating may comprise one or more regions on heating platen 4 that transmit heat for a different duration of time than one or more other regions on the platen. Different pressures may also be utilized. Pressure as used herein may refer to a programmed force configured by the control and exerted as a pressing force by heating platen 4, or it may relate to a position in three dimensional space achieved by heating platen 4 during the thermal cycle.

The single thermal cycle of heating platen 4 may be further governed by external factors, such as conditions within the establishment hosting apparatus 100. As discussed above, it is ideal that apparatus 100 be capable of operating within a conventional electrical power configuration, utilizing either a standard 120 volt plug or a dedicated 240 volt plug, such as that used in larger household appliances. Apparatus 100 must be capable of heating relatively quickly without exceeding or draining the power capacity of its host establishment. Therefore, in some embodiments where available power is limited, apparatus 100 and heating platen 4 may be configured in the control software with alternate automated warm-up and cool-down cycles to permit successful sublimation within an existing electrical configuration. In these embodiments, the apparatus may be flexibly reconfigured via the control software to integrate into various deployment environments without the need to replace, alter, or custom design hardware components.

As discussed above, apparatus 100 may include a control unit to regulate the temperature of heating platen 4. In some embodiments, the control unit may be configured using software to automatically de-energize the heating platen in the event of heating platen failure or overheating over a threshold temperature. In these embodiments, the apparatus may further include a redundant secondary safety system independent of heating platen 4 and the control unit to de-energize the heating platen should both the heating platen and the control unit malfunction. In some embodiments, heating platen 4 may be consistently kept at its operating temperature. In other embodiments, heating platen 4 may be turned off and cooled down between each sublimation task. This configuration may be motivated by safety concerns or for energy efficiency. As an alternative, heating platen 4 may be configured to remain at an intermediate steady state temperature. In this embodiment, heating platen 4 may be configured to quickly increase its surface temperature from the steady state point to a sublimation temperature. Maintaining heating platen 4 at an intermediate holding temperature (e.g. 200 degrees Fahrenheit) that is between ambient temperature and sublimation temperatures (e.g. 350 degrees Fahrenheit) allows for quick ramping up to a sublimation temperature. Such a configuration may reduce the wait time to complete a sublimation task, which would lead to more profit-generating capability and more satisfied customers. The intermediate temperature should be selected such that the electronic and/or mechanical components of apparatus 100 internal to the housing are not adversely affected. To facilitate the variability of heating platen 4 temperatures, the control for heating platen 4 described above may be configured to execute warm-up and cool-down cycles for the platen as needed.

In some embodiments, the control unit for heating platen 4 and/or a user interface device associated with apparatus 100 may include a timer that governs the warm-up and cool-down cycles on a set schedule based on certain criteria. In some embodiments, the warm-up and cool-down cycles may be configured based on time of day or day of the week, to account for store traffic. For example, heating platen 4 may be kept at a higher steady state intermediate temperature (thus leading to a shorter warm-up cycle) on a Saturday afternoon versus a Tuesday morning because more traffic is likely in the host establishment on Saturdays. In other embodiments, the timer may monitor the time since the last sublimation task was completed, and may gradually cool down the platen accordingly. This functionality could be used to automatically shut down the heating platen at the closing time of the host establishment; the timer could be configured to shut the heating platen off completely after a certain number of hours have passed since the last sublimation job. Such a configuration promotes safety and energy efficiency without requiring constant supervision and monitoring of the platen temperature.

Heating platen 4 is configured to execute the single thermal cycle in a manner that sublimates printed images onto all desired sides of the selected product substantially simultaneously. Such a configuration streamlines and expedites the sublimation process, and provides the capability to provide a wide range of customized and personalized sublimation products. Advantages to printing opposing sides of a product simultaneously include increased efficiency, reliability, and repeatability of the process. Wear on the system is essentially halved, and thus the life of the machine should be increased and maintenance costs and down time should be reduced. The reduced time taken to sublimate a product for a customer enhances the attractiveness of the product offering in a retail environment; a customer is more likely to purchase a product if the product can be sublimated quickly. Moreover, quicker production time increases the revenue-generating capability of the machine, as less time per sublimation job means more jobs can be completed during operation hours. Sublimating both sides in a single thermal cycle is also an advantage because it increases the consistency of the transfer process. Again, reducing the number of processes and the complexity of such processes will extend the working life of a sublimation printing apparatus.

To facilitate double-sided sublimation in a single thermal cycle, the duration of the cycle may be altered depending on the thickness of the product. The programmed duration must account for thermal resistance within the material comprising the product, and must ensure that all surfaces of the product are exposed to a proper sublimation temperature of, for example, 350 degrees Fahrenheit without overheating, warping, or otherwise damaging the platen, the product, or the transfer media. In some embodiments, heating platen 4 may further comprise an intermediate sheet of material to further even out heat and pressure across the surface of the item to be sublimated. The intermediate sheet may help prevent the transfer media sticking to heating platen 4, which could smudge or blur the transferred image. The intermediate sheet may be comprised of a material capable of resisting high temperatures without losing structural integrity, such as a thermal tape, or a textile. When present, this intermediate sheet may protect both the product and the apparatus, and increase reliability and repeatability of the sublimation process. In some embodiments, the intermediate sheet may remain associated with heating platen 4, and may not be removed after each individual sublimation task. In other embodiments, the intermediate sheet may be transported to substrate 2 and aligned and registered on the substrate prior to initiating a sublimation task.

In some embodiments, apparatus 100 may include an optional cooling system. In some embodiments, the cooling system may be configured to cool the sublimated product to at least about an ambient temperature. The cooling process provides safety for handlers of the sublimated object, and also helps ensure the quality and permanence of the sublimation transfer by preventing smearing, blistering, etc. In some embodiments, the cooling system may constitute a heat sink. In other embodiments, the cooling system may incorporate a passive method of cooling a sublimated product, such as simply allowing the product to cool over time. In still other embodiments, the passive cooling system may include components or elements that are capable of cooling the product through convection.

In yet other embodiments, the passive cooling technique may cool the product via conduction, and may include placing the sublimated product in contact with a panel comprised of a material with high heat capacity and thermal conductivity, such as copper, brass, aluminum, or steel. In the preferred embodiment illustrated in FIG. 12, which will be described in further detail below, such a panel is illustrated with a series of grooves. It was unexpectedly discovered during development of apparatuses 100 and 500 (to be described below) that when the metal panel did not contain such grooves, a small boundary layer of air tended to develop between the panel and hot sublimated products being brought to the cooling panel by a robot transport mechanism. Due to the presence of this layer of air, the sublimated product would often slide to the edge of the cooling panel or off of the panel altogether, resulting in the product being outside of the usable range of the robot. This error resulted in either total loss of the sublimated product or required manual operator intervention; neither outcome is desirable. The addition of grooves or slits to the panel dissipates the boundary level and allows reliable, predictable placement of sublimated products on the cooling plate during the customization process.

In alternative embodiments, the cooling system may be configured as an active cooling system. For example, the cooling system may include one or more fans in addition to a heat sink. In some embodiments, the cooling system may be configured to sense whether the sublimated product is cooled to the desired temperature. In other embodiments, the cooling system may be configured to allow the product to cool for a predetermined duration of time. In such configurations, the cooling system and/or other components of apparatus 100 may be capable of preventing access to the product by a user or consumer until the product is sufficiently cooled. In other embodiments, the cooling system may include additional or alternative active cooling elements, including but not limited to a Peltier plate, a Peltier bath, spraying or immersion in liquids such as water, liquid nitrogen, etc., and a heat exchanger. In some embodiments, components of apparatus 100 may actively transport the sublimated product through a forced convection cooling field.

In some embodiments, apparatus 100 may include an associated user interface device (not shown). The user interface device may be configured to assist an operator in selecting one or more images to print on the transfer media, selecting one or more products on which to sublimate the printed images, controlling aspects of the sublimation process, and coordinating payment for the product. An exemplary user interface device will be described below in association with FIGS. 5A-5B.

In some embodiments, apparatus 100 may further include a housing, such as housing 10 in FIGS. 1A-1C, such a housing configured to enclose some or all of the components of apparatus 100 in a manner that prevents an operator from contacting the enclosed components. Housing 10 may be comprised of metal, plastic, glass, or a combination thereof. Housing 10 may serve several important functions: it protects the operator (or others) from burn, pressure, pinch, or puncture injuries that could occur as a result of contact with the apparatus components. Further, housing 10 protects the apparatus itself, shielding the components from wear and tear and keeping them clear of dust, insects/animals, etc. When equipped with an optional housing, such as housing 10, a delivery opening in housing 10 may be configured to provide the product to an operator or another party outside of housing 10.

As discussed above, when configured as a full kiosk, housing 10 protects the operator and other individuals who may encounter the machine. Heating platen 4 and heat shield 6 may be disposed within housing 10 such that they do not touch any of the housing walls, so as to maintain the external surface of housing 10 at a temperature safe for touch. Additionally, in some embodiments housing 10 may be equipped with a ventilation system. The ventilation system may result in ambient air flowing into the machine, either by natural convection or by forced convection, such as through a series of fans. In embodiments where housing 10 is configured to contain a ventilation system, the ventilation system may be further configured to interface with a larger ventilation system for the retail establishment or other structure hosting the apparatus. A ventilation system may permit heating platen 4 to be kept at a steady state intermediate temperature or even at full operational temperature, without creating burn risks to users or excessively raising the ambient temperature of the surrounding air. In some embodiments, the ventilation system may be configured to control a temperature within housing 10 such that the mechanical and electrical components of apparatus 100 are protected from damage and the exterior surface of housing 10 remains touch-safe (e.g., at a temperature that will not harm an individual when that individual's skin contacts the surface). Allowing the enclosed components, including heating platen 4, to remain at an intermediate but safe temperature reduces system warm-up time and customer wait time.

Housing 10 also may have value-added functions for the entity hosting the apparatus. In some embodiments, housing 10 may feature a decorative design that appeals to customers and attracts interest and business. The design could be proprietary to the maker of the apparatus, or could be designed by the entity hosting the apparatus. Housing 10 may be configured such that a portion of the enclosure is transparent. Such a configuration provides entertainment and education to the user while the sublimation task is underway, and may also allow an operator to take note of components of the apparatus requiring maintenance or repair. As discussed above, off-board configurations of the apparatus may also optionally include such a housing, depending on the needs of the user.

The modular subsystem features of the apparatus promote deployment of the apparatus in a variety of ways. The apparatus may be suitable for customizable footprints to meet the needs of the hosting entity. For example, if the apparatus must fit in the corner of a room, the modular design may permit the device to wrap around the corner. A "countertop" configuration might be a good fit for a jewelry counter at a department store. The subsystem configuration increases the flexibility and versatility of the apparatus and increases the market possibilities for the invention.

FIGS. 3A-3D illustrate the operation of motorized swing-arm mechanism 8 in further detail. As discussed above, swing-arm mechanism 8 may be configured to fold, unfold, and remove the transfer media from substrate 2 as part of the sublimation process. In the example embodiment illustrated in FIGS. 3A-3D, apparatus 100 is shown in the middle of a transfer media folding process. In this embodiment, substrate 2 is covered with a pad 38. As discussed above, pad 38 may be comprised of a heat-resistant material, such as silicone, and may be configured to exhibit a stiffness such that the product to be sublimated is subjected to a pressure of about 30 to 40 psi at each surface to be sublimated. A clamping system (described further below in association with FIG. 22) may secure a sheet of transfer media 42 printed with one or more images to substrate 2 and pad 38. A product 40 to be sublimated is placed on transfer media 42, with product 40 being situated (by manual or automated means) such that each of its surfaces to be sublimated are in contact with a printed image on transfer media 42. Accordingly, transfer media 42 must be folded such that it substantially surrounds product 40 if a printed image is to be sublimated on product 40's top surface. Such a process will now be described in detail.

Apparatus 100 may be equipped with a control (not shown) which activates an associated swing-arm stepper motor once apparatus 100 determines that product 40 and transfer media 42 are properly aligned and secured onto substrate 2. As discussed above, swing-arm mechanism 8 may comprise two parallel arms connected by a bar. When transfer media 42 is initially placed onto substrate 2 either manually, by an operator, or automatically, by a robotic transport mechanism (described below), a portion comprising approximately half of the transfer media will necessarily be hanging loosely off of substrate 2, since that loose portion is to be folded over to substantially surround product 40. At this initial point, swing-arm mechanism 8 is stationary and fixed in the position illustrated in FIGS. 1A-1C and 2, and may support the loose edge of transfer media 42. In these embodiments, the home position of linear motion stage 14 as described above may be configured to be a position proximal to swing-arm mechanism 8 so that it may support transfer media 42 in this manner.

Figure 3B:
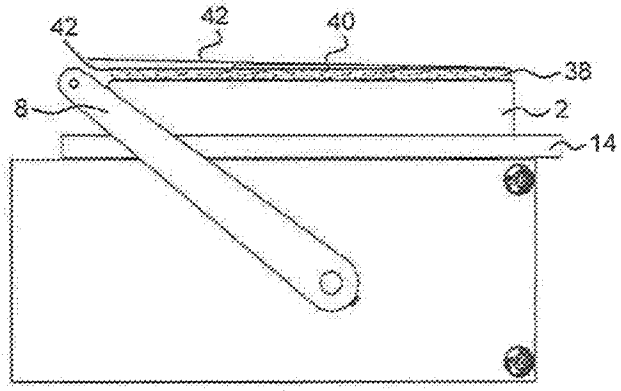
FIGS. 3A-3D show various steps of the operation of a folding bar assembly associated with an exemplary integrated dye sublimation printing apparatus, consistent with disclosed embodiments.
Figure 3D:
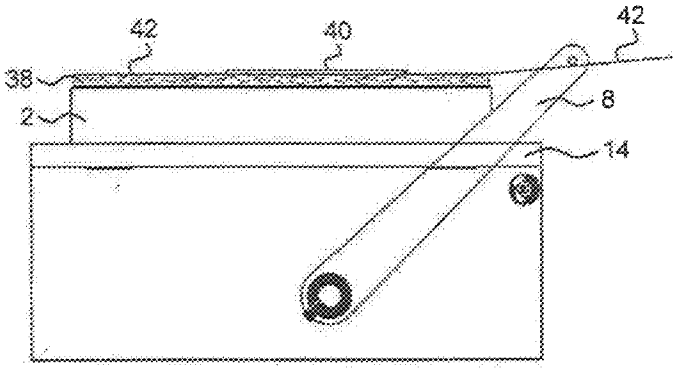
Figure 3A:
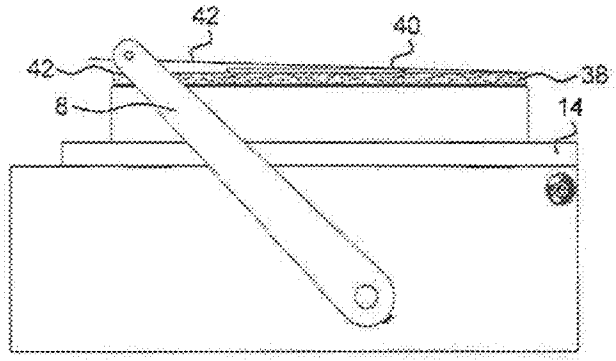

At a pre-determined time after transfer media 42 and product 40 are situated on substrate 2, the associated swing-arm stepper motor may activate, and may pull swing-arm mechanism 8 in a semi-circular arc by way of drive belts (not shown). Each arm of swing-arm mechanism 8 may be associated with an individual drive belt. The bar of swing-arm mechanism 8 engages the loose edge of transfer media 42, and as swing-arm mechanism 8 completes its arc, it may fold transfer media 42 such that it substantially surrounds product 40. As described above, transfer media 42 may contain a bisecting feature to facilitate folding, such as a crease or a scored line. Swing-arm mechanism 8 may fold transfer media 42 along this bisecting feature. When the folding is complete, the stepper motor may pause swing-arm mechanism 8 at a position that enables linear motion stage 14 to translate substrate 2 to a position under heating platen 4 to complete the sublimation task, as described above. This position is illustrated in FIG. 3A. Upon completion of the sublimation task, linear motion stage 14 may initially return to its home position, which would again be the position shown in FIG. 3A. However, as illustrated in FIG. 3A, this position is not conducive to unfolding transfer media 42. Therefore, linear motion stage 14 may be configured to translate slightly past its home position, i.e., further away from heating platen 4. This position is shown in FIG. 3B. When linear motion stage 14 completes this extra motion, the swing-arm stepper motor may activate and may move swing-arm mechanism 8 further through its semi-circular arc, such that its bar is below the folded edge of transfer media 42, as shown in FIG. 3B. Once swing-arm mechanism 8 is in place, linear motion stage 14 may return to its home position.

Figure 3C:
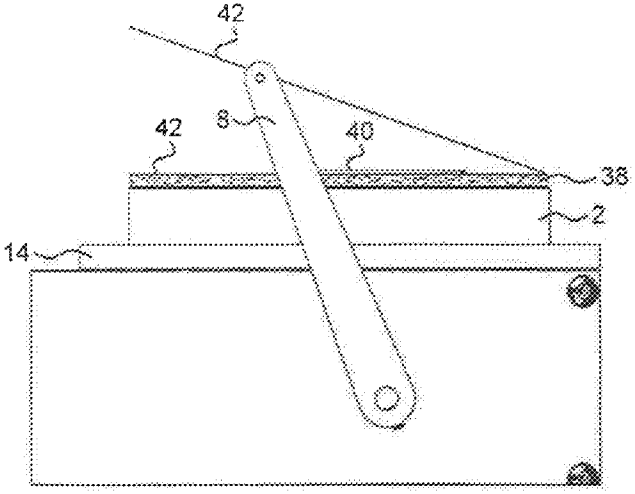

At this point, an associated swing-arm stepper motor may reverse its motion, and accordingly reverse swing-arm mechanism 8 back through its semi-circular range of motion in order to unfold transfer media 42. As shown in FIG. 3C, the bar of swing-arm mechanism 8 engages the folded edge of transfer media 42, and lifts the loose portion of transfer media 42 off of product 40. When swing-arm mechanism 8 completes its semi-circular arc and returns to its home position, as shown in FIG. 3D, transfer media 42 is completely unfolded. At this point, either an operator (in clerk-operated kiosk embodiments) or a robotic transport mechanism (in automated embodiments) may remove product 40 from the transfer media 42 to prepare it for delivery to the customer. Transfer media 42 is left on substrate 2. In some embodiments, transfer media 42 may be manually removed by an operator or automatically removed by a robotic transport mechanism. In other embodiments, swing-arm mechanism 8 may be configured to move transfer media 42 off of substrate 2. This action may be facilitated by the associated swing-arm stepper motor moving swing-arm mechanism 8 in a reverse direction slightly past its home position. Since the bar of swing-arm mechanism 8 remains in contact with transfer media 42, as the mechanism moves further backwards through its range of motion, it may exert leverage on the edge of transfer media 42 and thus catapult it off of substrate 2, where it may be collected for disposal as discussed above. In some alternative embodiments, the process described above and illustrated in FIGS. 3A-3D may instead be performed by a robotic transport mechanism instead of by swing-arm mechanism 8.

Figure 4:
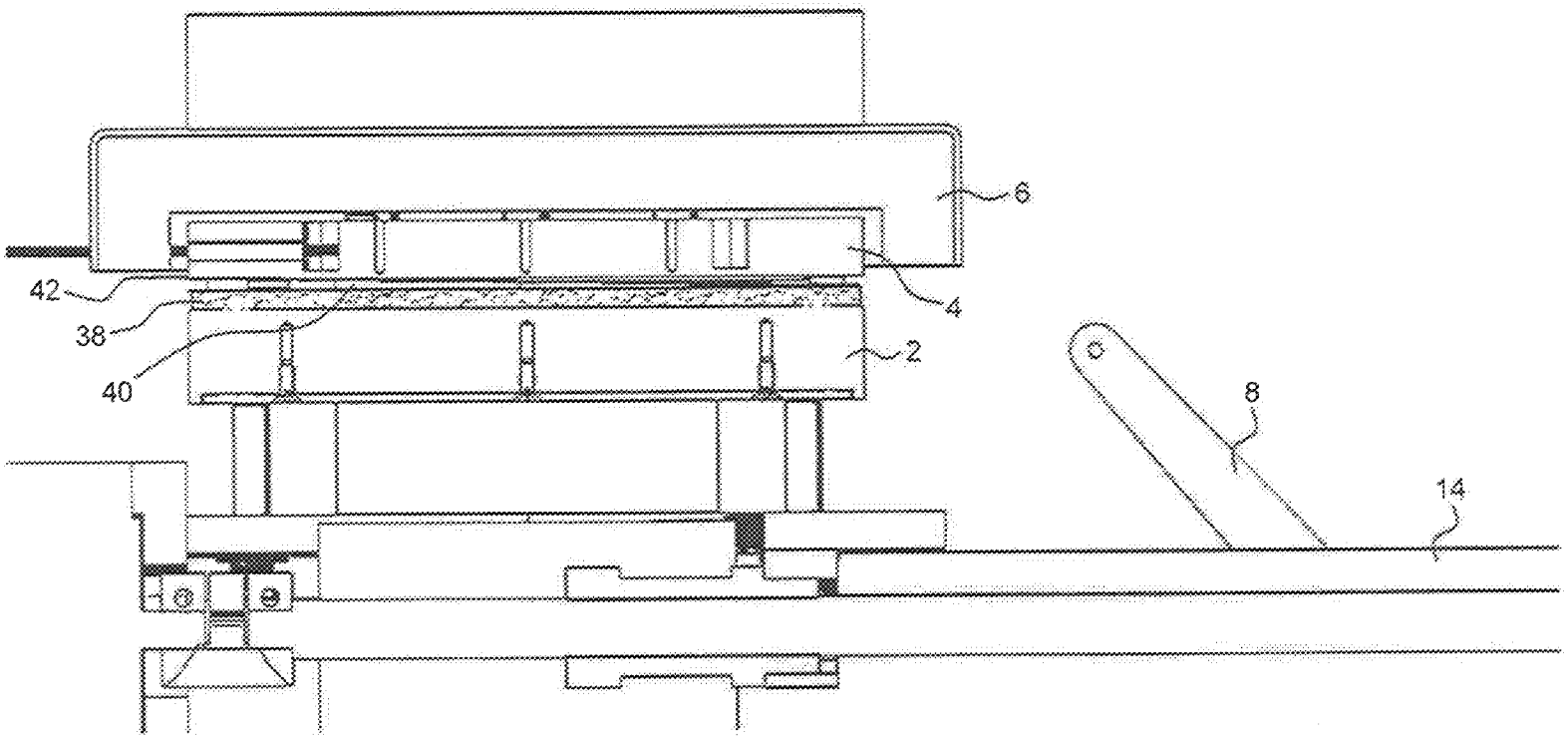
FIG. 4 is a detailed view of the dye sublimation transfer printing apparatus of FIGS. 1-2 during a sublimation operation, consistent with disclosed embodiments.

FIG. 4 illustrates a view of apparatus 100 during the sublimation task itself, as described previously in association with FIGS. 1-3. In the example shown in FIG. 4, apparatus 100 brings substrate 2 and heating platen 4 into contact via a hydraulic mechanism. The hydraulic press ram is engaged with the underside of substrate 2, which has been translated into position for the sublimation task by linear motion stage 14. Product 40 is being sublimated with images printed onto transfer media 42 by heating platen 4. Transfer media 42 has been folded to substantially surround product 40 by swing-arm mechanism 8. Swing-arm mechanism 8 is in its "paused" position as described above, awaiting linear motion stage 14's return to its home position. Apparatus 100 may remain in the configuration shown in FIG. 4 for a pre-determined amount of "dwell time" based on properties of the product, or properties of the printed image(s). Once the sublimation task is complete, the hydraulic system returns substrate 2 to its seated position within linear motion stage 14. At this point, apparatus 100 may de-energize heating platen 4, either completely or to an intermediate holding temperature as discussed above. Once substrate 2 is seated within linear motion stage 14, the stage translates back towards its home position to the right of FIG. 4, and swing-arm mechanism 8 unfolds transfer media 42 as discussed above in association with FIGS. 3A-3D.

Figure 5B:
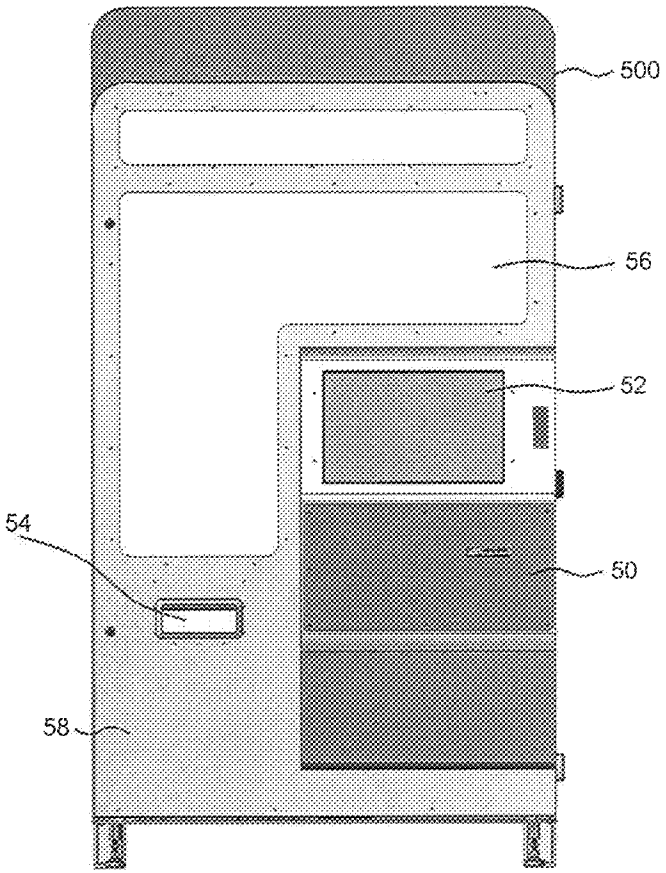
FIG. 5B is a front view of the vending machine of FIG. 5A.
Figure 5A:
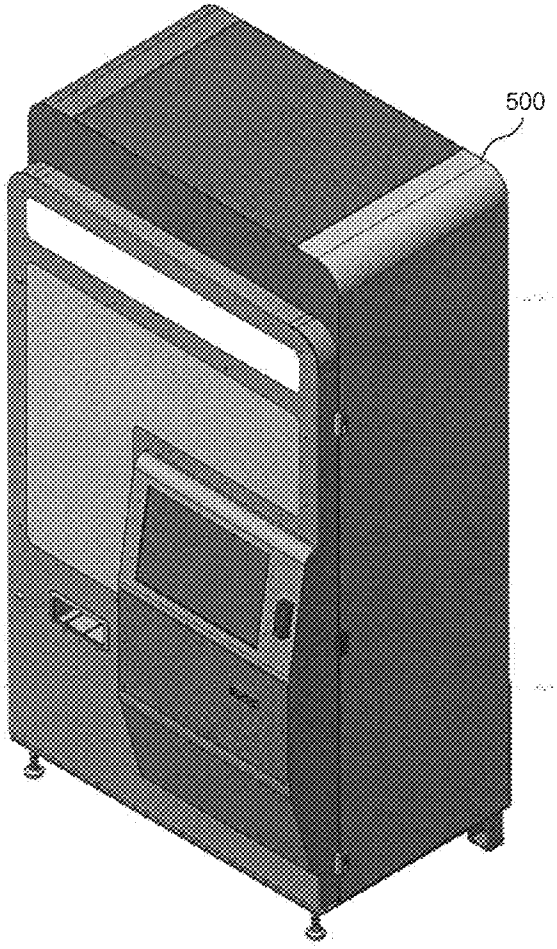
FIG. 5A is an exterior profile view of an exemplary integrated dye sublimation transfer printing vending machine, consistent with disclosed embodiments.

FIGS. 5A and 5B illustrate the integration of an apparatus similar to apparatus 100 into a housing 58 configured to permit operation of the apparatus in the manner of a vending machine. FIG. 5A is a profile view of this vending apparatus 800, and FIG. 5B is a front view. In this vending embodiment, a modified version of apparatus 100 (a sheet-fed sublimation printer system) is situated within housing 58. Components of the apparatus within the vending machine may be substantially as described above and as depicted in FIGS. 1-4, with several additional features added to adapt the apparatus to a fully automated, fully contained, integrated embodiment operable by an untrained consumer safely at a point of sale in a retail setting. For example, an associated printer is included within the housing, and is configured to maintain a supply of a plurality of sheets of transfer media. Also included within housing 58 are one or more products and/or accessories of different types. In some embodiments, these products and/or accessories may be maintained in a storage container, such as one or more magazines. As used in this specification, the term "magazine" is to be interpreted broadly beyond its typical plain and ordinary usage to encompass any storage container suitable for use in a vending apparatus.

Housing 58 may be configured as discussed above to include a control unit to regulate the temperature of heating platen 4. Maintaining heating platen 4 at an intermediate holding temperature (e.g. 200 degrees Fahrenheit) between ambient temperature and sublimation temperatures (e.g. 350 degrees Fahrenheit) allows for quick ramping up to a sublimation temperature. Housing 58 may further include ventilation components or systems. When present, these systems may interface with other ventilation systems in the retail establishment hosting vending apparatus 500. The ventilation components may be configured to control a temperature within the housing such that the mechanical and electrical components of vending apparatus 500 are protected from damage and the exterior surface of the housing remains touch-safe. Allowing the enclosed components, including heating platen 4, to remain at an intermediate but safe holding temperature reduces system warm-up time and customer wait time.

Vending apparatus 500 may include a user interface device 50. User interface device 50 may be configured with various capabilities to facilitate the various steps of a sublimation task. User interface device 50 may include a variety of components to control other components of apparatus 500. Device 50 may contain a computing system (not shown), which may further comprise one or more processors and one or more internal memory devices. The one or more processors may be associated with control elements of apparatus 500 that position and operate the various components. The memory devices may store programs and instructions, or may contain databases. The memory devices may further store software relating to a graphical user interface, which device 50 may display to the user on an output screen 52. The computer system of user interface device 50 may also include one or more additional components that provide communications to other entities or systems via known methods, such as telephonic means or computing systems, including the Internet.

User interface device 50 may include input and output components to enable information associated with the sublimation task to be provided to a user, and also for the user to input required information. In some embodiments, the input components may include a physical or virtual keyboard. For example, a consumer may first be prompted by device 50 to determine one or more images to be printed by the included printer onto sheets of transfer media. Device 50 may be configured to receive a user-provided digital image file in various ways, including but not limited to receiving insertion of flash memory or a USB drive, connecting via a USB or Firewire® cable, receiving image files by email, receiving image files uploaded via a mobile application, retrieving user-submitted image files from an online library or website, etc. In some embodiments, user interface device 50 may be configured to transmit or receive information from a mobile application associated with one or more of a manufacturer of the vending apparatus, a retailer hosting the vending apparatus, or a third party. In these embodiments, vending apparatus 500 and the mobile application may be configured to exchange information relating to the consumer and/or to a sublimation task associated with the user. The information may comprise one or more of information associated with a product the consumer wishes to sublimate, information associated with an image or text to be sublimated on the product, information associated with payment for the sublimated product, or information comprising a location of the nearest vending apparatus. In some embodiments, vending apparatus 500 may be configured to receive a fully pre-paid, pre-configured order for a sublimation task from the mobile application. In these embodiments, vending apparatus 500 may receive the order directly from the mobile application via user interface device 50 (for example, if a particular vending apparatus 500 is determined to be the closest geographically to the consumer). In other embodiments, user interface device 50 may be configured to access a remote server to retrieve information relating to the order from the mobile application. In these embodiments, vending apparatus 500 may be configured to receive a code configured to facilitate access by user interface device 50 to information associated with a saved transaction ordered from the mobile application.

In some embodiments, device 50 may be capable of outputting audible notifications or alerts to a customer or operator of vending apparatus 500. For example, device 50, via various internal sensors or transducers integrated within the apparatus, may receive a notification that, for example, the transfer media is misaligned or jammed based on a lack of registration of a fiducial marker. In such a situation, device 50 may be configured to audibly output "PAPER MISFEED" and contact either an on-site or remote customer service representative via audio or visual cues (such as a flashing light) to fix the problem. In another embodiment, device 50 may be configured to tell the user to "LOOK AT THE SCREEN" when information is required from the user or important information is displayed for the user. In yet another embodiment, device 50 may be configured to audibly output "YOUR PRODUCT IS READY" when the sublimation process is complete and the product is cooled to a safe handling temperature. In some embodiments, the audio output capabilities of vending apparatus 500 may extend to the input components. Device 50 may include a display screen 52, which may serve as both an input and output device. Device 50 may be configured such that key presses on a virtual keyboard or touchscreen buttons associated with display screen 52 elicit confirmatory clicking noises. Additionally, the input components of device 50, including display screen 52, may be configured to provide tactile or visual feedback to the user to indicate that an input member, such as a key of a keyboard, has been successfully pressed.

In some embodiments, user interface device 50 may include a camera (not shown in FIGS. 5A-5B), which can capture an image at the point of sale to utilize in the printing process and transmit the captured image to the included printer. The camera, in conjunction with networking capabilities of device 50, may enable a user in another physical location to perform remote diagnostics, maintenance, and calibration of vending apparatus 500, as well as perform customer service functions to assist a user of the apparatus. The memory of device 50 may contain a plurality of stock images for the consumer to choose from to supplement a user-supplied image or an image captured by the camera. In some embodiments, device 50 may be configured to receive input of personal information from the consumer to be sublimated onto a product. Such personal information may include, but is not limited to, a name associated with the consumer, contact information, initials/monogramming, etc. Device 50 may be configured to generate an image including the received personal information. In some embodiments, device 50 may permit the consumer to select from a plurality of possible stock images to incorporate the personal information. In still other embodiments, device 50 may be configured to, at the selection of the consumer, synthesize the personal information into a selected stock image from the device memory, and provide the single synthesized image to the included printer for printing onto transfer media. In other embodiments, device 50 may provide the consumer with the capability to select a product from an associated storage container for sublimation that is pre-printed with a stock image stored in the memory of device 50. Device 50 may be configured to store the received personal information as well as any personalized, synthesized, or stock images created or selected by the consumer. Further, device 50 may be configured to prompt the consumer for additional products that they may desire to have sublimated with the same image. Device 50 may be configured to transmit the stored consumer image to a remote network server, and may communicate an indication to the consumer information about additional sublimated or customized products that might be available for the consumer that can be printed and shipped from a remote location. The indication may be communicated to the consumer through various known means of communication, such as by telephone, email, social media, or on an internet webpage associated with one or more of the consumer, the retail outlet hosting vending apparatus 500, or the maker of vending apparatus 500. In some embodiments, device 50 may provide further options to the user, including customizing and purchasing accessories for the sublimated product, or configuring a delivery vehicle for the product. Device 50 may also be configured to prompt the user to select a companion accessory for the sublimated product. In some embodiments, the accessory also may be capable of sublimation by the apparatus. In some embodiments, the user may be prompted to insert a desired accessory into the machine, or the accessory may be contained within the apparatus. Device 50 may be configured to coordinate and collect payment for the accessory. In some embodiments, apparatus 500 may be configured to utilize the used transfer media as a delivery vehicle for the sublimated product. In such embodiments, the transfer media may be preprinted on one or more sides with text or images associated with the retail outlet hosting vending apparatus 500, or the maker of vending apparatus 500.

Device 50 and an included camera may be configured to allow interaction with vending apparatus 500 by remote operators. Device 50 may be configured to include a "hot button" that when pressed, sends a notification to the remote operator asking for live video or audio contact with the operator of the apparatus. In some embodiments, a remote technician may be capable of being notified by device 50, and able to view system components live through the camera. Device 50 may be further configured to enable control by the remote technician, who could then perform service on vending apparatus 500 such as clearing jammed transfer media, removing a stuck product from a storage container, retrieving a dropped accessory, etc. In other embodiments, device 50 and the included camera may enable real-time customer service interactions with a user. When either a customer or an operator such as a store clerk have questions about the process or require assistance, a remote customer service representative may be contacted via device 50's hot button and can interact live with the customer. In some embodiments, device 50 may be configured to facilitate live video chat on an included display screen with the representative. In other embodiments, device 50 may be configured to facilitate live audio interaction with the representative, similar to a telephone call. In yet other embodiments, pressing the hot button may activate a text-based live chat, or send an email to the customer service representative. In some embodiments, the remote customer service may be a value-added service, as the service representative can assist a consumer in purchasing and customizing additional products and/or accessories.

Device 50 may be further configured to coordinate and collect payment for the sublimation task. The memory of device 50 may contain information relating to pricing for various types of the plurality of products. The pricing may vary by product, and may vary based on other predetermined criteria, such as the quantity of objects desired, image processing tasks completed, images acquired via an associated camera, etc. Device 50 may display the pricing information on an output screen to the user. Device 50 may include, or be connected to, payment acceptance components that can accept cash, credit cards, or other payment methods from the consumer, such as a coupon, or a payment application on a mobile device. Device 50 may further comprise a product delivery opening 54, through which the customized sublimated product may be dispensed to the user. In these embodiments, device 50 may be configured to prevent access to the sublimated product through delivery opening 54 until payment has been received and accepted.

Device 50 may include a printer that can provide the consumer with a receipt of the payment transaction. In some embodiments, the receipt may also contain other information, such as an Internet URL for a website associated with either the retail outlet hosting vending apparatus 500, or the maker of vending apparatus 500 for purposes of additional possible products. Device 50 may be integrated into housing 58, as shown in FIGS. 5A-5B, or it may be disposed as a distinct device proximal to housing 58 but not integrated within it. It should be understood that a device similar to device 50, with any of the above configurations, may be provided as part of any apparatus contemplated by this invention, whether in a vending or retail context or not.

Housing 58 may be configured to include at least one surface portion 56 comprised of a transparent material. The material may comprise, as non-limiting examples, acrylic, glass, fiberglass, plastic, or a hybrid material. Transparent surface portion 56 may be oriented in a manner that makes the components of the dye sublimation printer apparatus, such as apparatus 100, visible to a consumer or other operator while safely shielding the user from heat, pinch points, stored energy sources, and other such potential hazards associated with the operation of heavy machinery. Transparent surface portion 56 may provide entertainment and education to the user while the sublimation task is underway, and may also allow an operator to take note of components of the apparatus requiring maintenance or repair. In some embodiments, transparent surface portion 56 may facilitate remote diagnostics, maintenance, and user assistance via the configured features of user interface device 50.

Figure 6B:
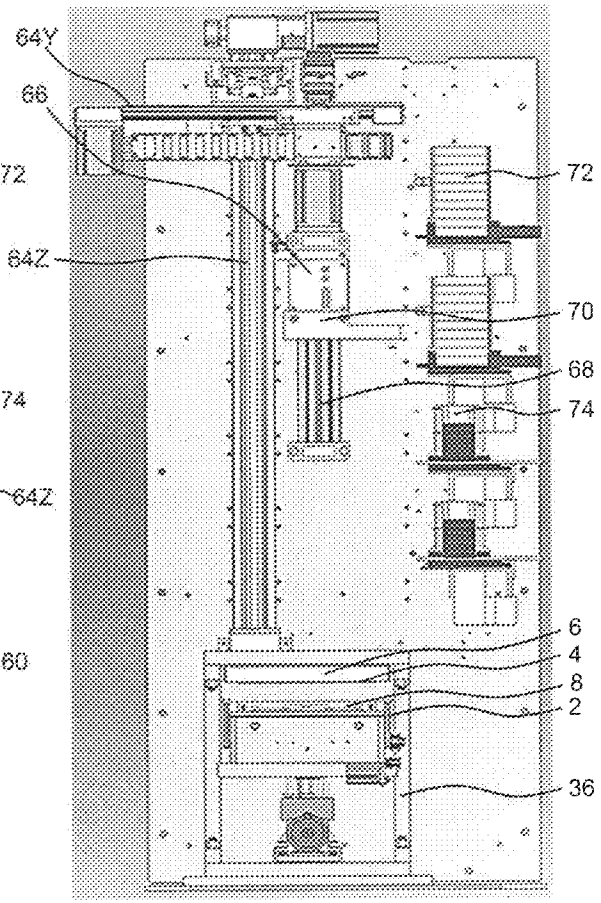
FIG. 6B is a side cutaway view of the vending machine of FIGS. 5A-5B, consistent with disclosed embodiments.
Figure 6A:
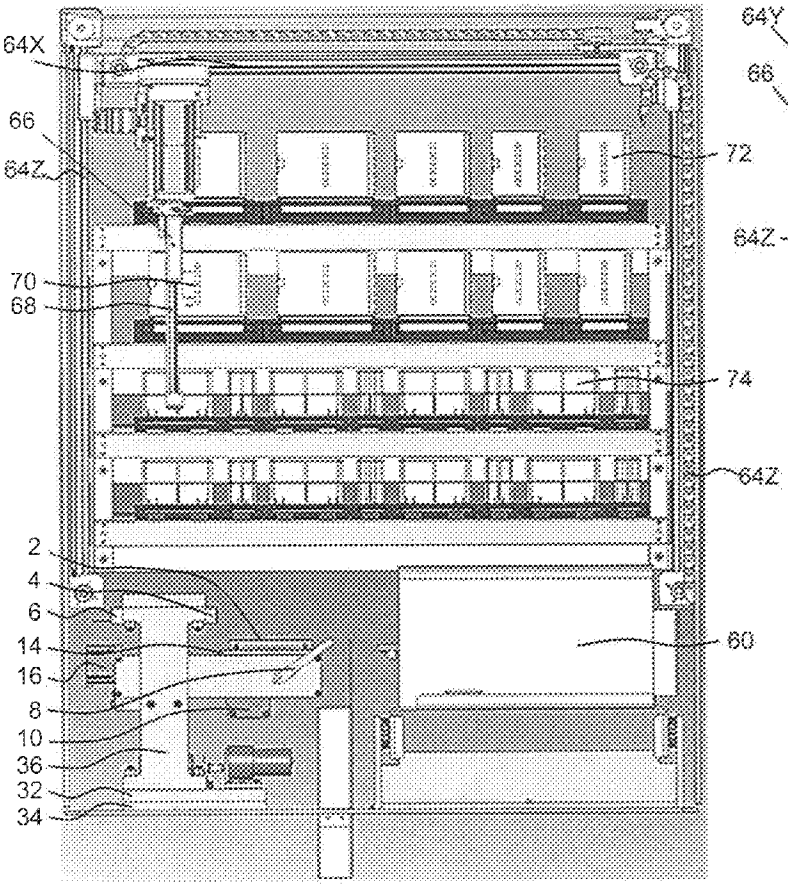
FIG. 6A is a front cutaway view of the vending machine of FIGS. 5A-5B, consistent with disclosed embodiments.
Figure 7:
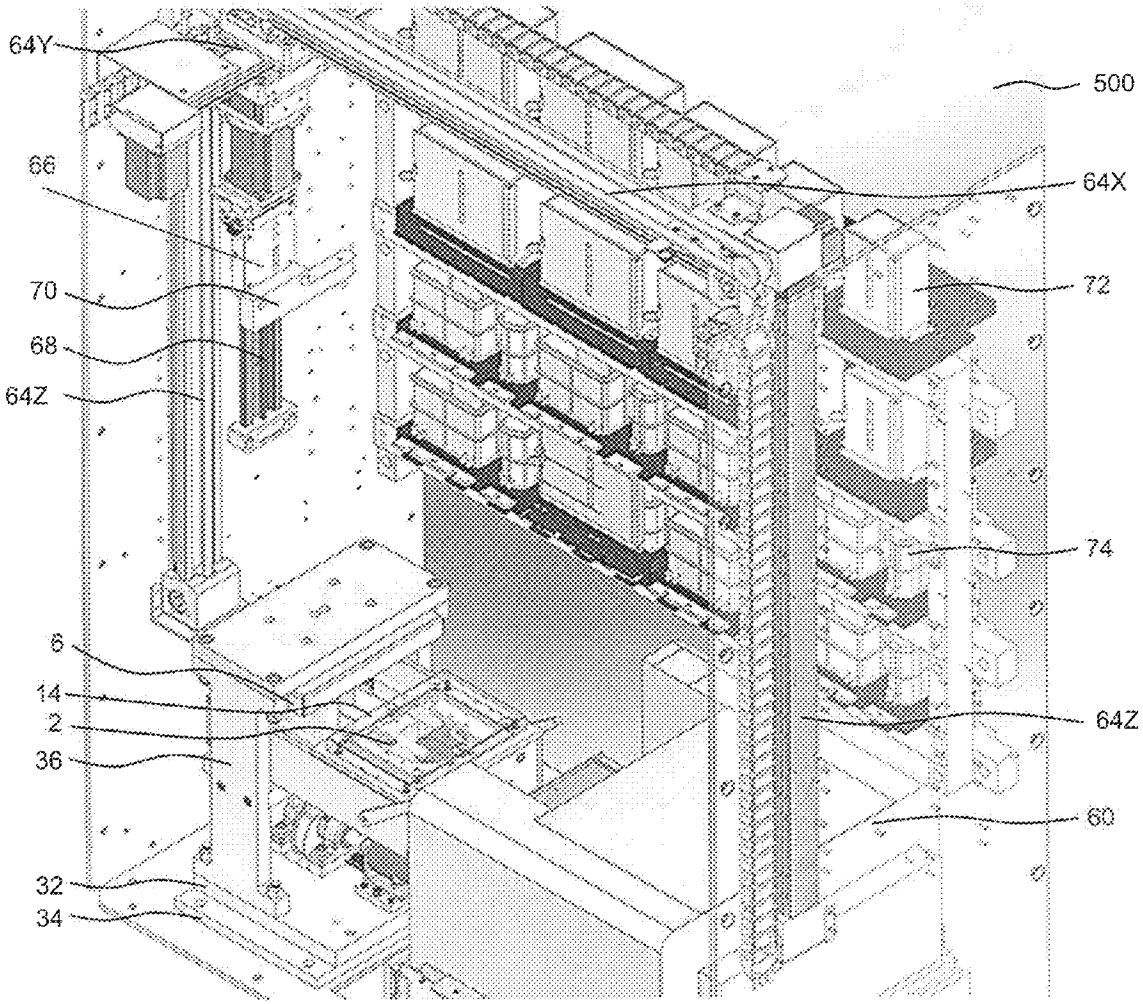
FIG. 7 is a profile cutaway view of the vending machine of FIGS. 5A-5B, consistent with disclosed embodiments.

FIGS. 6A, 6B, and 7 illustrate interior views of a vending apparatus 500, consistent with disclosed embodiments. FIG.

6A is a front interior view of vending apparatus 500, while FIG. 6B is a side view. FIG. 7 is a profile view from a slightly different perspective. In the example illustrated in FIGS. 6A-6B, a modified apparatus 100 and associated printer 60 are situated at the bottom of vending apparatus 500. For simplicity, printer 60 is not shown in FIG. 6B. As discussed above, these components are operable within vending apparatus 500 in substantially the same manner as discussed above.

As discussed briefly above, vending apparatus 500 may contain one or more mechanisms for holding or storing a supply of product inventory. One such mechanism may be a storage container, with each storage container containing one type of a plurality of types of products. In other embodiments, one or more of the storage containers within vending apparatus 500 may be configured to store included accessories for sublimated products. Examples include, but are not limited to, key rings or key chains, covers or holders for luggage tags, frames, handles, etc. In some configurations, stand-alone accessories may also be contained in a storage container within vending apparatus 500, or may be introduced to the apparatus by a user. Accessories may serve as value-added components that add to the aesthetics or utility of the sublimated product. The accessories themselves may or may not be sublimated. Accessories may or may not be dispensed at the same time as the sublimated product. For example, one user may customize both a sublimated product and a matching accessory. Another user might purchase and customize only a sublimated product. Finally, another user might purchase and customize a sublimated product, and return to vending apparatus 500 at a later time to purchase one or more accompanying accessories for the product. As discussed above, the accessories may be pre-packaged, and inserted into vending apparatus 500 by the user before, during, or after the sublimation of the product.

In the illustration of FIGS. 6A-6B and 7, vending apparatus 500 includes a plurality of product storage containers 74 and a plurality of accessory storage containers 72. As will be explained below, in some embodiments in which both product and accessory storage containers are present within vending apparatus 500, the product storage containers 74 may be placed higher on a back wall of housing 58 than the accessory storage containers 72, as shown in FIG. 6A. This configuration permits ready access to sublimatable products by the robotic transport mechanism, and ensures that accessories do not crowd the sublimation apparatus. In other embodiments, accessory storage containers 72 may be placed higher on the back wall of housing 58 due to a particular configuration of the device or the sizes and shapes of the involved products and accessories. Each of the plurality of product storage containers 74 and accessory storage containers 72 may contain a plurality of a type of a product. As can be seen in FIG. 6A, the storage containers may be of different shapes and sizes. For example, a wider product storage container 74 may be configured to store and dispense cases for mobile devices, such as cell phones. In these embodiments, a narrower product storage container 74 may be configured to store and dispense, for example, luggage tags or military dog tags to be sublimated. Further detail about product storage containers 74, accessory storage containers 72 and various alternative embodiments therein is provided below in association with FIGS. 8 and 17-19.

Vending apparatus 500 may be configured to contain a robotic transport mechanism, as illustrated in FIGS. 6A, 6B, and 7. The robotic transport mechanism may comprise a series of rails 64X, 64Y, and 64Z mounted onto one or more walls of housing 58, Alternatively, the robot rails 64X, 64Y, and 64Z may be mounted to an internal structure supported by the base of the machine and not directly to the housing 58. The mechanism further comprises a robotic head unit 66, which is configured to travel along rails 64X, 64Y, and 64Z in three dimensions (X, Y, or Z) by way of a belt, a chain, or a lead screw. In some embodiments, robotic head unit 66 may be operably coupled to a telescoping linear actuator 68 and an end effector 70. End effector 70 will be described in detail below in association with FIG. 8.

Consistent, precise operation of the robotic transport mechanism is critical, since it must perform many activities in a compressed spatial area within vending apparatus 500. For example, in some embodiments the robotic transport mechanism may be responsible for transporting the printed sheets of transfer media from printer 60 to substrate 2, and may further assist in the alignment of the transfer media on the substrate. In other embodiments, as will be discussed below in association with FIG. 16, printer 60 may itself be configured to automatically place and align the transfer media onto substrate 2. The robotic transport mechanism may additionally be configured to retrieve a selected product and/or accessory from one of product storage containers 74 or accessory storage containers 72, in a process that will be described in association with FIG. 8. Further, the robotic transport mechanism may be configured to pick up the sublimated product, and transport it to a cooling system, such as the system described above and described in further detail below in association with FIG. 12 (not shown in FIG. 6A-6B or 7). Finally, the robotic transport mechanism may provide the cooled sublimated product to delivery opening 54 for the customer to retrieve.

The robotic transport mechanism may be deployed within vending apparatus 500 in a variety of configurations not limited to that illustrated in FIGS. 6A-6B and 7. For example, in some embodiments, the mechanism may comprise a single robotic head unit 66 and end effector 70, and rails 64X, 64Y, and 64Z may be configured essentially in an "H" shape that primarily allows movement in the X and Y directions. Movement in the vertical Z direction is achieved via a telescoping linear actuator 68, as shown in FIG. 6A. In these embodiments, rails 64Z may be omitted. Linear actuator 68 permits end effector 70 to fit into tight areas within vending apparatus 500, and permits it to perform precise movements, such as the alignment of the transfer media on substrate 2. Furthermore, a telescoping linear actuator permits a freer range of motion without contacting elements of the heat press assembly associated with apparatus 100.

In alternative embodiments, these problems may be solved through a different configuration of the robotic transport mechanism. In these embodiments, the robotic transport mechanism may not include a telescoping linear actuator 68. Instead, the robotic transport mechanism may contain multiple end effectors 70. Rails 64X, 64Y, and 64Z may be configured in a manner that permits head unit 66 and end effectors 70 to essentially cover their own "region" in the Z-plane within vending apparatus 500. Thus, in the example shown in FIGS. 6A-6B and 7, one end effector 70 might be situated higher on the robotic head to access the top half of vending apparatus 500, and might for example be responsible for retrieving products and accessories from product storage containers 74 and accessory storage containers 72 in the top half of vending apparatus 500. Meanwhile, another end effector 70 might be situated lower on the same robotic head to access the bottom half of vending apparatus 500, and might be responsible for all transport activities associated with the sublimation functions of apparatus 100 and/or delivery of sublimated products to the user via delivery opening 54. All of these robotic motion operations may be performed in full view of transparent section 56 of housing 58, so that the customer may visualize and enjoy the process of their sublimated product's creation.

Figure 8A:
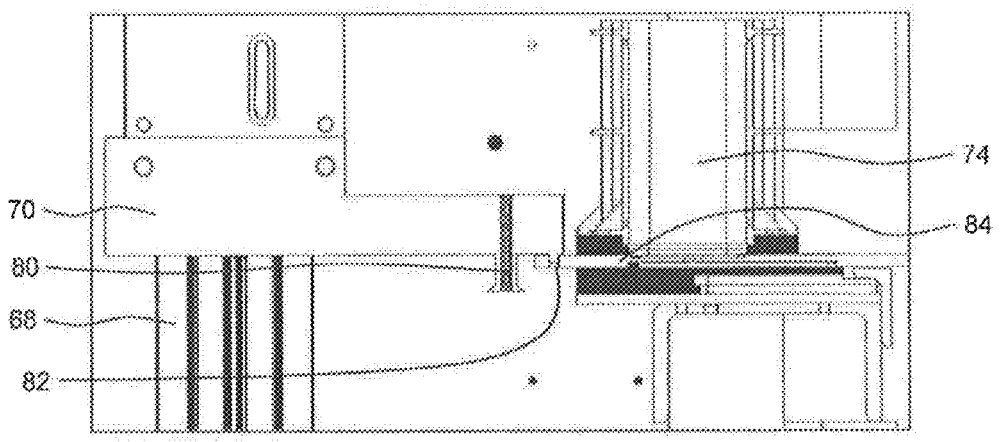
FIGS. 8A-8C are diagrammatic illustrations of an end effector interacting with a storage container incorporated within an integrated dye sublimation transfer printing vending machine, consistent with disclosed embodiments.
Figure 8B:
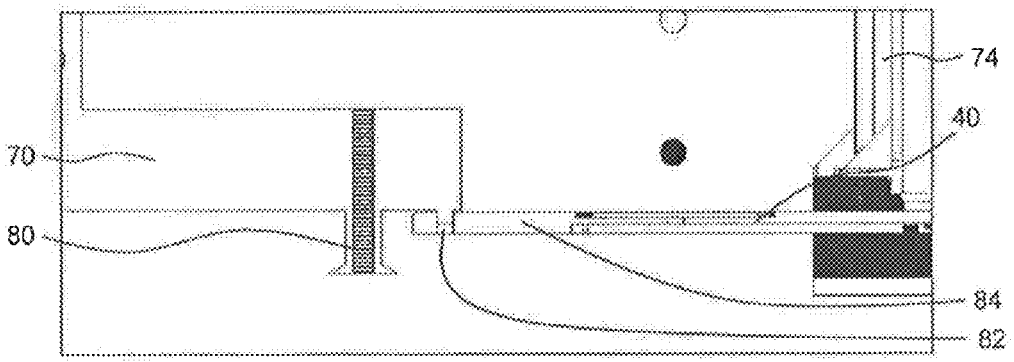
Figure 8C:
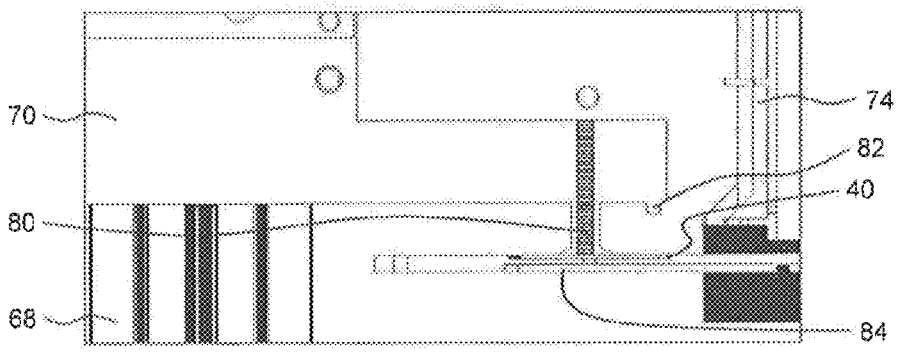

FIGS. 8A-8C illustrate end effector 70 in detail, and further illustrate how the robotic transport mechanism may be configured to retrieve products from product storage containers 74 and accessory storage containers 72. As shown in FIG. 8A, end effector 70 contains several implements that help it interact with various components of vending apparatus 500. In some embodiments, end effector 70 may contain one or more vacuum suction cups 80. Suction cups 80 may be arranged in various configurations on the underside of end effector 70. For example, in some embodiments end effector 70 may comprise three suction cups 80, and the suction cups may be arranged in a triangle shape, with two suction cups collinear with one another and the third cup offset from them. In some embodiments, end effector 70 may be linked via cables to an independent vacuum system (not shown). The vacuum system associated with end effector 70 and suction cups 80 may be configured to contain one or more switches or transducers designed to provide feedback to a control (not shown) indicating whether or not the vacuum system is engaged. Each suction cup 80, for example, may have a vacuum switch indicating its engagement status to the control. In these embodiments, for example, end effector 70 may be configured to use two suction cups 80 to pick up a product, such as a luggage tag. If, after retrieving the tag, only one of the suction cups 80 indicates that its suction is engaged, it may indicate a problem, such as an improper pickup of the tag. The control may be configured to stop system activity and, for example, drop the tag that was improperly retrieved and properly retrieve a new tag. In some embodiments, end effector 70 may be configured with two coplanar suction cups 80 situated on the same horizontal plane in order to grab, hold, and transport larger objects, such as the transfer media or larger products. An example end effector 70 will be described in further detail below in association with FIGS. 24A-24C.

End effector 70 may also include a mechanical implement 82 that assists with various functions. In some embodiments, for example, end effector 70 may use mechanical implement 82 to interact with product storage containers 74 and/or accessory storage containers 72 to retrieve products. This process is illustrated in detail in FIGS. 8A-8C, and will additionally be discussed below in association with FIGS. 17-19. In FIG. 8A, a product storage container 74 may be configured to include a "shuttle" 84 that acts as a dispenser for products contained within the storage container. In the example illustrated in FIGS. 8A-8C, product storage container 74 contains a plurality of small, flat items such as luggage tags. Shuttle 84 in these embodiments may be configured to contain a well or other small depression in which a single luggage tag may be held for retrieval by the robotic transport mechanism. Within product storage container 74, the stack of other luggage tags may be restrained in some embodiments by a spring-loaded system (not shown), such that engagement and translation of shuttle 84 may dispense exactly one luggage tag.

Shuttle 84 may also contain a hole cut to substantially the same dimensions of mechanical implement 82. Mechanical implement 82 may be configured to fit into this hole in shuttle 84 in order to gain access to products inside of product storage container 74. In FIG. 8A, end effector 70 has moved proximal to product storage container 74, and has engaged shuttle 84 via mechanical implement 82. In FIG. 8B, with implement 82 and shuttle 84 still mechanically coupled to one another, robotic head unit 66 and/or linear actuator 68 (not shown) translates end effector 70 away from product storage container 74. This action has the effect of pulling shuttle 84 fully open so that the product 40 held within it can be freely accessed. Finally, in FIG. 8C, robotic head unit 66 and/or linear actuator 68 first moves end effector 70 upwards, so that mechanical implement 82 disengages with shuttle 84. Robotic head unit 66 and/or linear actuator 68 then may translate end effector 70 towards product storage container 74, such that one or more suction cups 80 are aligned above product 40. Robotic head unit 66 or an associated control (not shown) may energize the vacuum system associated with end effector 70 and suction cups 80. Robotic head unit 66 and/or linear actuator 68 may then move end effector 70 downwards such that the suction cup(s) 80 engage product 40. Once the vacuum switches described above are triggered, indicating that suction cups 80 are secured to product 40, robotic head unit 66 and/or linear actuator 68 may translate end effector 70 up and away from shuttle 84 and may transport product 40 to apparatus 100. In some embodiments, end effector 70 may first re-engage shuttle 84 via mechanical implement 82 and replace shuttle 84 back into product storage container 74. In other embodiments, end effector 70 may return to product storage container 74 after placing product 40 on substrate 2 and may then close shuttle 84. In still other embodiments, shuttle 84 may be configured to automatically close once product 40 is removed. Notably, the robotic transport mechanism may perform a similar process to the one just described in association with product storage container 74 to retrieve accessories from an accessory storage container 72 (not shown in FIGS. 8A-8C). The only difference between the product retrieval and accessory retrieval processes is the destination of the item; the robotic transport mechanism transports the products, such as product 40, to apparatus 100 within vending apparatus 500 to be sublimated. Conversely, the robotic transport mechanism may transport an accessory directly to delivery opening 54.

In some embodiments, end effector 70 may be equipped with one or more sensors and a camera that may be configured to interface with a vision system that will be described below in association with FIGS. 10-12 and 17-21. Said sensors may be configured to read and recognize indicia on one or more of sublimatable products, accessories, or other integrated components of apparatus 500. In some embodiments, these indicia may constitute fiducial markers, such as those described below in association with FIG. 21. In other embodiments, the indicia may constitute barcodes, QR codes, or other such machine-readable indicia. In some embodiments, the one or more sensors associated with end effector 70 may be infrared sensors. Alternatively, the sensors may be laser sensors. The one or more sensors may be configured to operate as part of an automated inventory management system that will be described in further detail below. In some embodiments, the one or more sensors may be situated on a side of end effector 70, and may be configured such that each sensor is pointed in a downward direction. In these embodiments, systems associated with apparatus 500 may determine inventory levels of products or accessories within the apparatus using the vertical distance traveled by the laser or infrared beam before recognizing an indicia and/or the physical presence of a product or accessory within the storage containers or other storage containers. In other embodiments, the one or more sensors may be situated on end effector 70 proximal to mechanical implement 82, and may be configured such that each sensor is pointed in a forward direction. In these embodiments, the vision system may be configured to recognize when the infrared or laser beam contacts the top of a stack of products or accessories within the storage containers described above, and may use such data to determine the inventory level of the given product or accessory.

Turning to FIG. 9, FIGS. 9A-9F illustrate exemplary images that may be associated with the apparatuses described above in association with FIGS. 1-8. In FIG. 9A, a single sheet 90 of transfer media is shown, with printed images 92 printed (by a printer such as printer 60) onto either side of the bisecting feature. Image 92 is an example of an image that may be determined by a consumer for printing. In some embodiments, the image(s) may be a user-provided image received through user interface device 50. In other embodiments, the image(s) may be stock images preloaded into the memory of user interface device 50. In still other embodiments, the image(s) may constitute text input received by device 50. In yet other embodiments, the image(s) may be captured by a camera associated with device 50. The image(s) may also represent a combination or composite of the above described options. In some embodiments, the consumer may provide the image by portable media as discussed above. As discussed above, a printed sheet 90 such as that described in FIG. 9A would be aligned onto a substrate, such as substrate 2, and engaged by one or more heating platens, such as heating platen 4, for sublimation onto one or more products. In some embodiments, as shown in FIG. 9A, images 92 may be mirrored by the apparatus from their original orientation to facilitate simultaneous double-sided printing. Printer 60 may be configured to automatically process and invert the images 92 such that they may be printed in the mirrored fashion. In some embodiments, further processing may also be performed by the printer, such as offsetting the images 92 from one another to fit dimensions of a product, altering the size of an image 92, etc. FIG. 9A also illustrates printed fiducial markers to assist in alignment of sheet 90. FIGS. 9B, 9C, and 9D illustrate top, side, and bottom views, respectively, of a finished product that has been sublimated using the transfer media and images featured in FIG. 9A.

FIGS. 9E and 9F illustrate examples of a user-provided image 94, a stock image 96, and a synthesized image 98 as described above in relation to vending apparatus 500. Image 94, like image 92, may represent either a consumer-supplied image or an image captured by camera 84. Image 96 may be an example of a stock image, contained in the memory of a user interface device such as device 50 of apparatus 500. In the example of image 96, elements relating to a geographical destination, in this case, Hawaii, constitute the image. As discussed above, a consumer may opt, via device 50, to synthesize a consumer-provided image such as image 94 with a stock image, such as image 96, to create a synthesized image 98. The user interface device could then provide synthesized image 98 to a dye sublimation printer, such as printer 60, to print the image in preparation for sublimation. Of course, a consumer could alternatively select to print only image 94 onto a product, or only image 96. In still other embodiments, a consumer could opt to print a consumer-supplied image such as image 94 onto one surface of a product, and print a stock image like image 96 onto another surface. Other alternatives are possible, such as consumer-supplied image 94 and synthesized image 98 on opposing sides of a product, etc.

Figure 10:
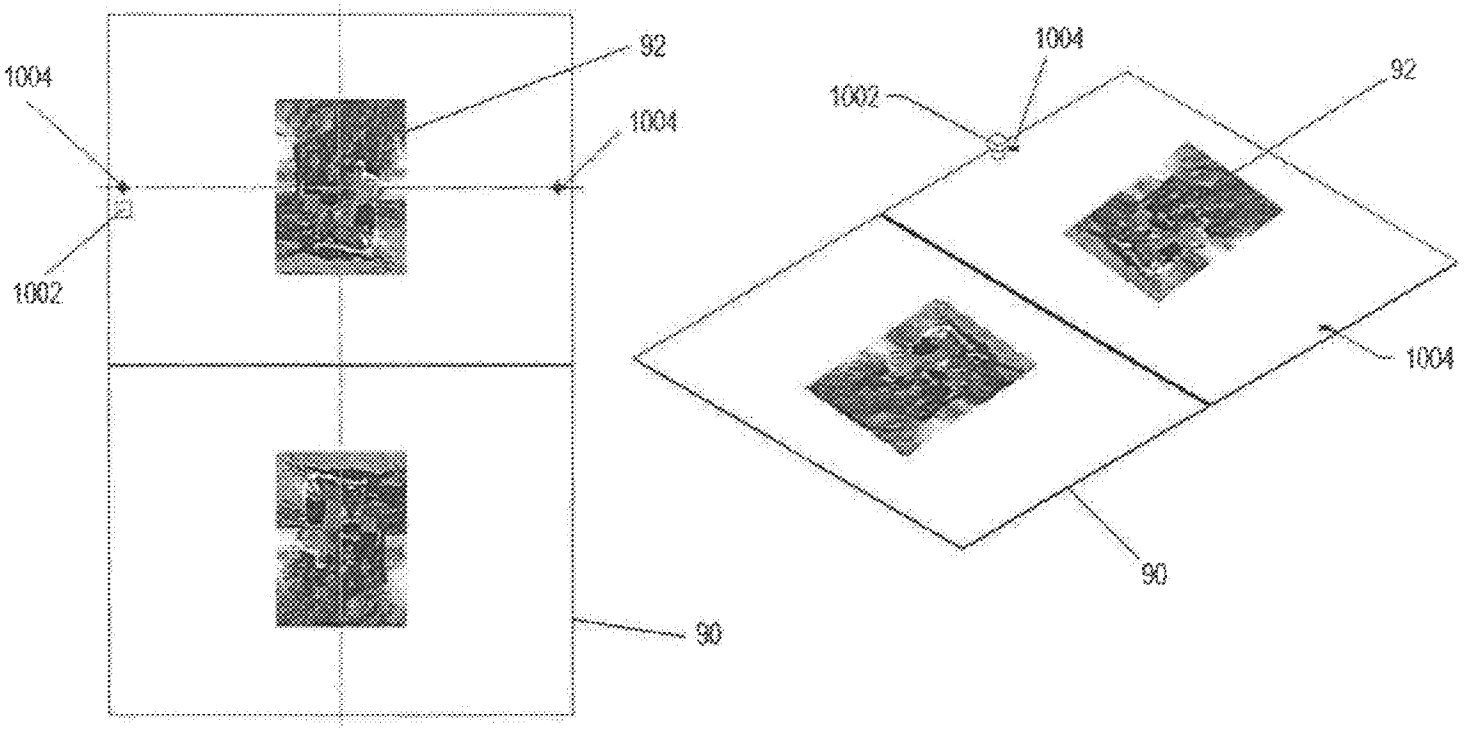
FIG. 10 is a diagrammatic illustration of optional registration and alignment features consistent with disclosed embodiments.

In some embodiments, the transfer media may contain one or more printed indicia and/or fiducial markers readable by the machine vision tracking system described previously to confirm location and orientation of the transfer media. An example of such an embodiment is illustrated in FIG. 10. Proper alignment of the transfer media in a sublimation printing apparatus such as apparatuses 100 or 500 described above is particularly important when the apparatus is configured to print on opposing sides of a product substantially simultaneously. Even a slight misplacement of the transfer media, and thus the printed images, may trigger a defective sublimated product.

FIG. 10 illustrates a top view and a perspective view of a sheet of transfer media with images printed on its surface, such as sheet 90 and images 92 described above in association with FIG. 9. In the example illustrated in FIG. 10, the sublimation apparatus (which may be, for example, any one of apparatuses 100 or 500) may be equipped with a machine vision tracking system 1002. System 1002 may be substantially as described above, and may include one or more cameras, as well as one or more control units capable of executing software commands. System 1002 may be mounted in a fixed position on a transport mechanism, such as on end effector 70, or it may be configured to freely move along the mechanism. In the example of FIG. 10, sheet 90 has been printed with a set of fiducial markers 1004.

Tracking the location of the printed sheets of transfer media using the fiducial markers at all times within the apparatus may be important to ensure quality of the image transfer and to prevent hazards, such as overheating of the transfer media. Even slight overheating of transfer media may create extremely unpleasant odors that could irritate the user and other surrounding customers. Therefore, the machine vision tracking system 1002 may be configured to confirm the location of a given sheet of transfer media such as sheet 90 in the apparatus using visual confirmation or scanning means at set time periods, or when contact or non-contact sensors detect that sheet 90 has progressed to a new part of the apparatus. The machine vision tracking system 1002 may determine that sheet 90 is susceptible to overheating and preemptively act to de-energize the heating platen and request service. This process may occur, for example, when the machine vision tracking system 1002 determines that the media and heating platen have been in contact for a time period exceeding a predetermined threshold value. The predetermined threshold value may be based on the temperature of the platen or properties of the product being sublimated.

The fiducial markers 1004 may also serve as indicators of the performance of the apparatus; if the apparatus senses via the markers that the transfer media is being consistently misaligned, hung up, or otherwise not moved smoothly through the system, it may indicate that the apparatus requires maintenance. Markers 1004 may constitute machine-readable barcodes, printed patterns, QR codes, etc. In some embodiments, markers 1004 may be directly read by machine vision tracking system 1002. In other embodiments, images of markers 1004 may be captured by a camera, which may or may not be part of system 1002, and the images may be analyzed and confirmed via software. Markers 1004 may be pre-printed on sheet 90, or they may be printed by printer 60 at the time images 92 are printed onto sheet 90. In some embodiments, the markers 1004 may constitute crosshairs, and one or more markers may be placed around the periphery of the printed image to assist with alignment tasks governed by the robotic transport mechanism and substrate 2 as described. Further description of fiducial markers 1004 and how they may be utilized by vision system 1002 is located below in association with FIG. 21.

In some embodiments, fiducial markers 1004 may be utilized by apparatus 100 or 500 to perform an automatic self-calibration process. A user interface device associated with the apparatus may configure printer 60 to print calibration images onto transfer media. The calibration images may comprise a pattern readable by components of the apparatus, such as machine vision tracking system 1002, as well as a set of fiducial markers 1004. Once printed, the transfer media bearing the calibration images may be transported from printer 60 to substrate 2 manually by an operator, or automatically by end effector 70, as described. Machine vision tracking system 1002 may be configured to track the alignment of the calibration images using fiducial markers 1004 as described above. System 1002 may be further configured to compare the location of markers 1004 (e.g., using coordinates) when the transfer media is aligned on substrate 2 to a pre-determined set of coordinates associated with an "ideal" alignment, such as a home position, or a default configuration. System 1002 may be configured to determine offsets in each dimension using the calibration images on the transfer media. The offset information may be stored locally in a memory device associated with the user interface device, or the user interface device may be configured to transmit the information to a remote server. Apparatuses 100 or 500 may be configured to automatically adjust the calibration of relevant components to correct the offsets, such as printer 60, end effector 70, substrate 2, or machine vision tracking system 1002. Further detail regarding machine vision tracking system 1002 and fiducial markers 1004 will be described below in association with FIG. 21.

Figure 11:
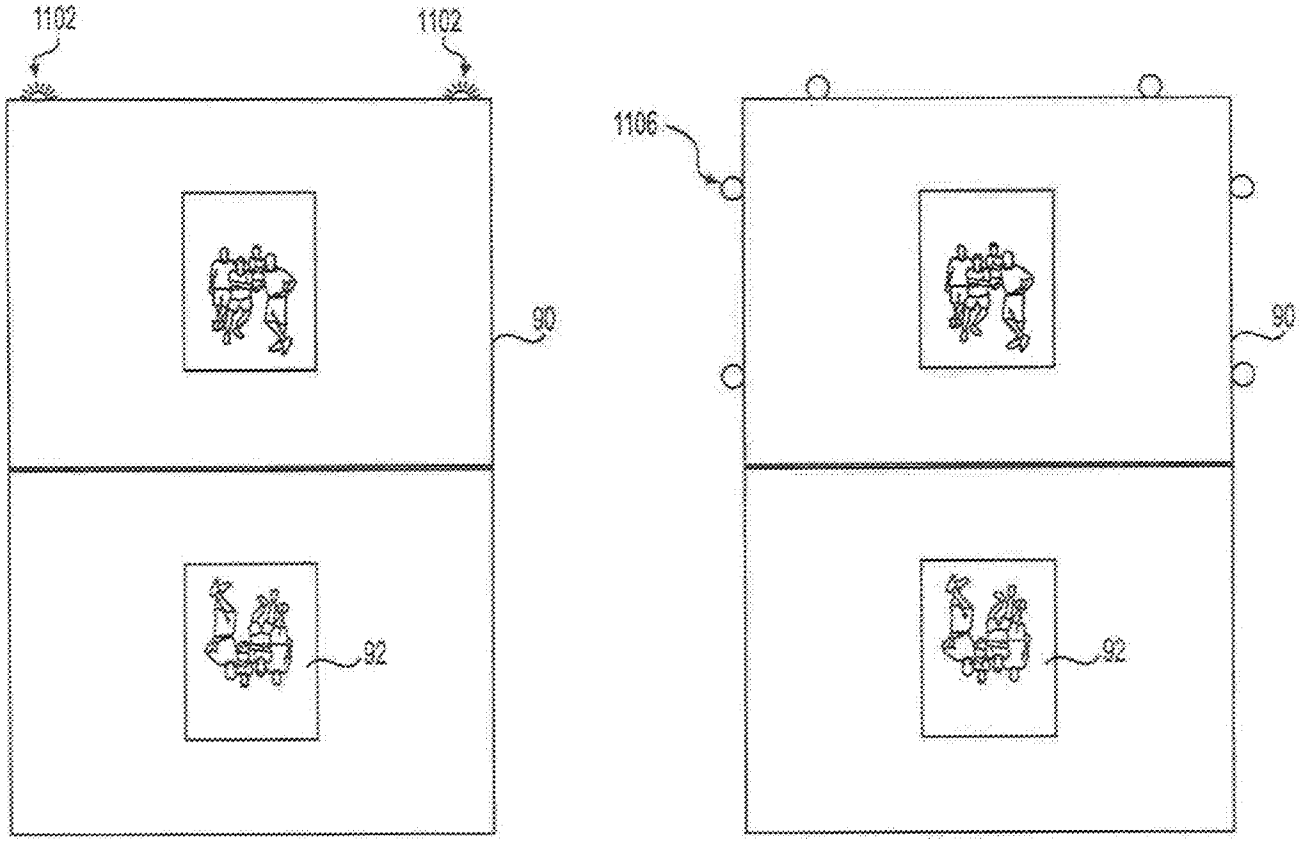
FIG. 11 is a diagrammatic illustration of optional registration and alignment features consistent with disclosed embodiments.

In some embodiments, as discussed above, alignment of the transfer media on the substrate of a disclosed apparatus (such as substrate 2) may be additionally facilitated by optional mechanical sensors and or non-contact sensors. Examples of such implements are illustrated in FIG. 11. As discussed above, proper alignment of the transfer media in a sublimation printing apparatus such as apparatuses 100 or 500 described above is particularly important when the apparatus is configured to print on opposing sides of a product substantially simultaneously.

End effector 70 and/or substrate 2 may include one or more non-contact sensors 1102 to aid in automatic transfer media and/or product alignment, orientation, and registration. Non-contact sensors within the scope of the invention include, but are not limited to, optical sensors, proximity sensors, or digital cameras, which may be mounted on any or all of end effector 70, other components of the robotic transport mechanism, and substrate 2. For example, sensors 1102 may comprise light sources configured to provide through-beams of visible, infrared, or laser light that may indicate to an operator if the transfer media is properly aligned and registered on substrate 2. The indication may occur visually on substrate 2 or a nearby structure itself (for example, red and green LED lights, with the green light illuminating when the transfer media is properly aligned or past a certain location within the apparatus), or may be transmitted to a user interface device and presented in a graphical user interface.

Non-contact sensors 1102 may be associated with one or more control units that control the motion of end effector 70 or other aspects of the robotic transport mechanism, and may form part of an integrated, automated alignment system. For example, in some embodiments end effector 70 may be configured to transport and align a sheet of printed transfer media from printer 60 to substrate 2. As described above, sensors 1102 may be configured to sense that the transfer media has passed over them, such as by breaking a through-beam, by sensing a change in optical clarity, or by a visual confirmation if sensors 1102 are configured to include a digital camera. When sensors 1102 are triggered, they may signal to the control unit controlling the robotic transport mechanism and/or end effector 70 to immediately cease further forward motion of the transfer media onto the substrate. Sensors 1102 may be further configured to detect misalignment of the transfer media. For example, if the transfer media is placed on substrate 2 at a slight angle, sensors 1102 may be able to detect the error in the media placement and either signal to the control unit controlling the robotic transport mechanism to take corrective measures, or signal to other software components to account for the misplacement during further operation of the apparatus.

In other embodiments, substrate 2 may be disposed relative to printer 60 such that a series of mechanical guides assist in the placement of the transfer media. For example, a tray attached to printer 60 may be configured to form a funnel shape, such that the transfer media can only approach substrate 2 in a predetermined manner. Substrate 2 may be fitted with guide rails or other such stationary mechanical implements to position and align the transfer media and/or products, such as mechanical implements 1106. Such mechanical implements may be disposed under the immediate surface of substrate 2, and may be situated in holes or divots in substrate 2. In some embodiments, mechanical implements 1106 may be retractable, and are only visible and engaged while aligning and positioning the transfer media.

In some embodiments, implements 1106 may be configured as mechanical switches that provide guidance for orientation and alignment of the transfer media. In these embodiments, implements 1106 may serve as stops for the transfer media, such that when an edge of the media hits the switch, apparatus 100 automatically stops moving the media in that direction. In other embodiments, implements 1106 may be configured to serve as gates, and may be retractable. The transfer media may be fed or transported over top of implements 1106, then positioned in the X-Y dimension once beyond them. An example embodiment of a mechanical guide system associated with mechanical implements 1106, printer 60 and substrate 2 will be described in further detail below in association with FIG. 16.

Figure 12B:
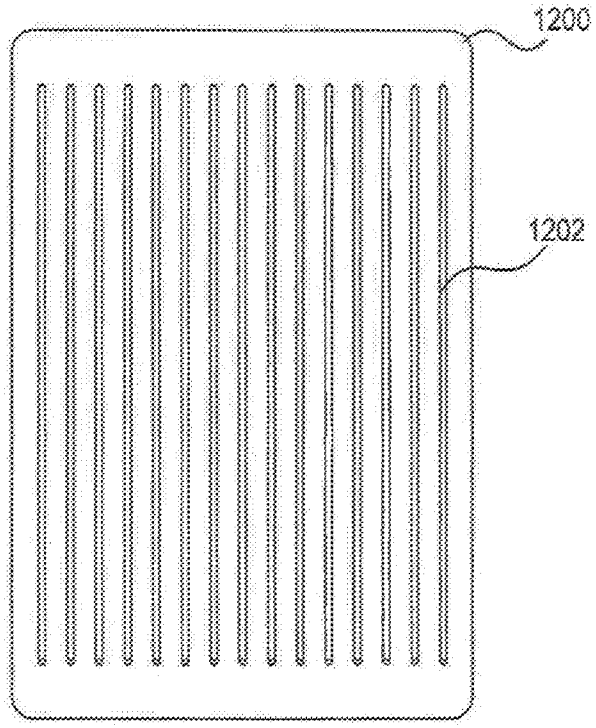
FIGS. 12A-12B are diagrammatic illustrations of a cooling plate associated with an exemplary integrated dye sublimation printing apparatus consistent with disclosed embodiments.
Figure 12A:
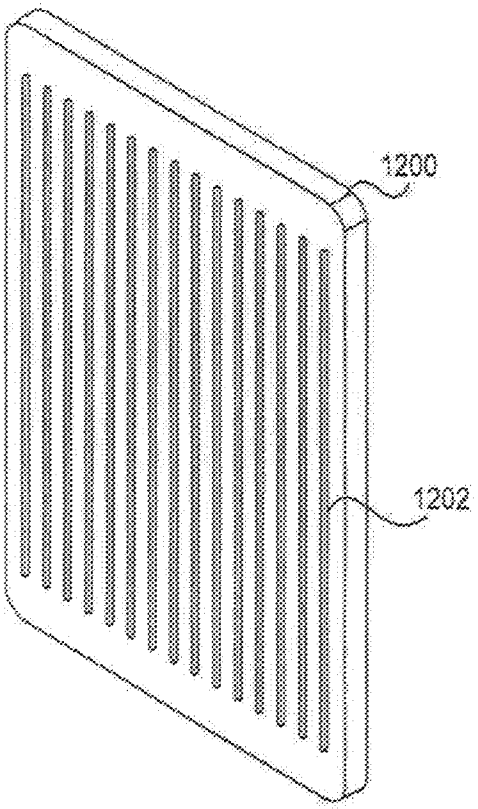

Turning to FIG. 12, FIG. 12 illustrates an example cooling plate 1200 that may serve as a passive cooling system as described above. Cooling plate 1200 may be comprised of any material with high heat capacity and thermal conductivity, such as copper, brass, aluminum, or steel. In these embodiments, cooling plate 1200 may constitute a heat sink. Cooling plate 1200 may be manufactured and installed within vending apparatus 500 in any shape or size based on the products to be sublimated within the particular apparatus 500. In preferred embodiments, cooling plate 1200 is approximately the size of a sheet of typing paper: about 8.5" wide by about 11" long. Cooling plate 1200 may be any thickness, but is preferably about 0.75" thick. In some embodiments, a cooling plate 1200 may also be associated with an apparatus 100 outside of a vending environment. The cooling plate may simply be placed proximal to the apparatus, and a sublimated product may be placed on it to cool either manually by an operator or automatically via a robotic transport mechanism as discussed above.

As discussed above, it was unexpectedly discovered during development of apparatuses 100 and 500 that the inclusion of several grooves 1202 within cooling plate 1200 was advantageous. Without the presence of grooves 1202, a small boundary layer of air tended to develop between cooling plate 1200 and hot sublimated products being brought to the cooling plate by a robot transport mechanism within apparatus 500. Due to the presence of this layer of air, the sublimated product would often slide to the edge of cooling plate 1200 or off of the plate altogether, resulting in the product being outside of the usable range of the robot. This error resulted in either total loss of the sublimated product or required manual operator intervention. The addition of grooves 1202 to the panel dissipates the boundary level and allows reliable, predictable placement of sublimated products on the cooling plate during the customization process. In some embodiments, grooves 1202 may be depressions milled partially through the surface of cooling plate 1200. In alternative embodiments, grooves 1202 may be slits cut entirely through the surface of cooling plate 1200. Any given cooling plate 1200 may contain grooves 1202 as depressions, slits, or a combination thereof. Grooves 1202 may be of any size, shape, or number within cooling plate 1200. In preferred embodiments, grooves 1202 may be about 0.125" wide, about 5" long, and may be placed about 0.5" apart on the surface of cooling plate 1200. It has been found that these parameters successfully diminish the boundary level effect and prevent slippage of sublimated products from the surface of cooling plate 1200.

Figure 13:
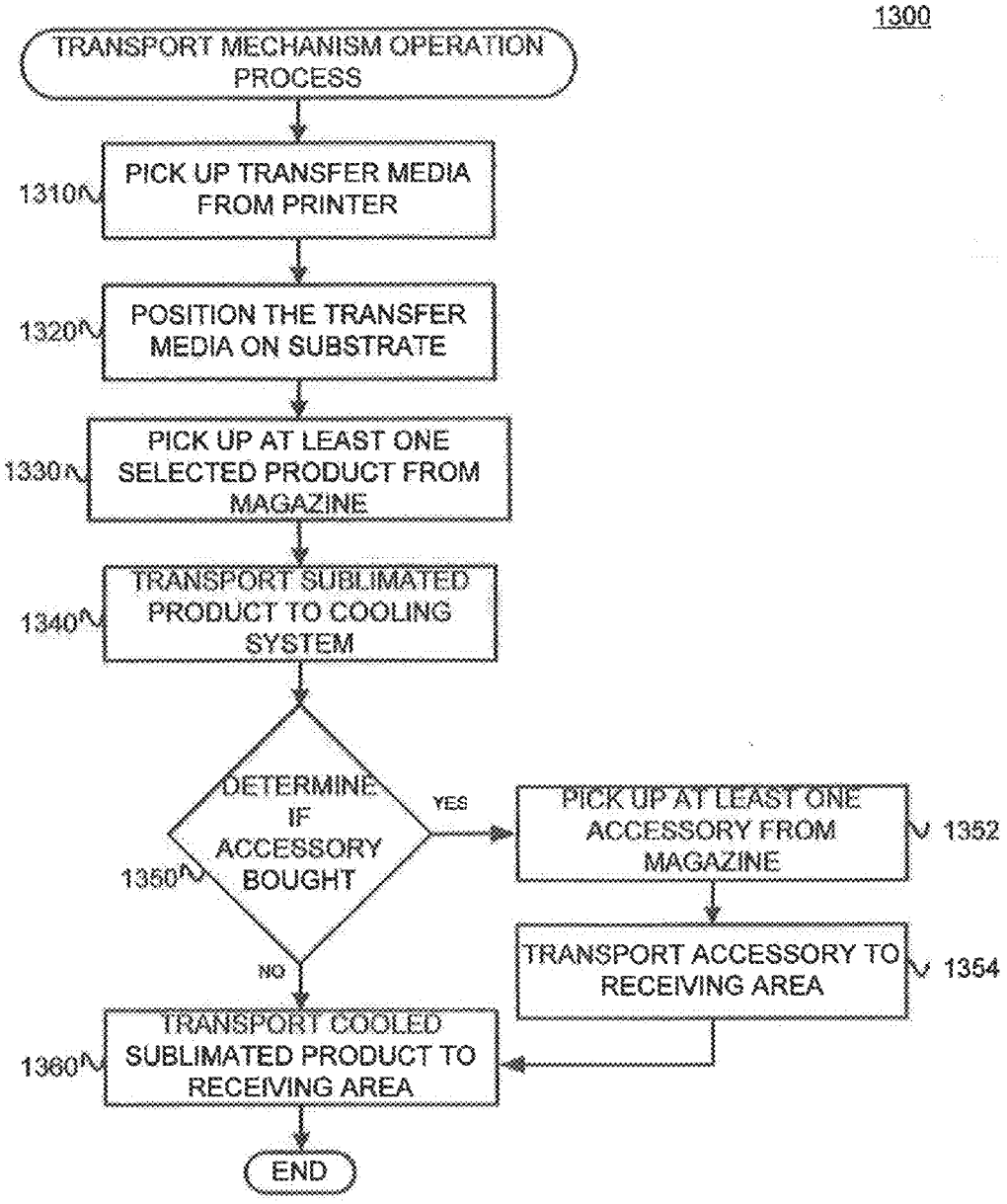
FIG. 13 is a flowchart of an exemplary transport mechanism operation process, consistent with disclosed embodiments.

The robotic transport mechanism of vending apparatus 500 described above may be configured to perform a transport mechanism operation process 1300, such as that shown in the example of FIG. 13.

In some embodiments, the robotic transport mechanism may be configured to pick up a sheet of transfer media from printer 60 that has been printed with digital images for sublimation (Step 1310). As described above in association with FIGS. 8A-8C, end effector 70 may be configured to pick up the transfer media via a vacuum system and via vacuum suction cups 80. The vacuum system may provide feedback as discussed above via switches that indicate to vending apparatus 500 whether the transfer media is properly and securely fastened to the suction cups 80.

Robotic head unit 66 and end effector 70 may position the transfer media onto a substrate, such as substrate 2 (Step 1320). As discussed, in alternative embodiments, vending apparatus 500 may be configured to move the transfer media to substrate 2 in a variety of ways. Once placed in proximity to substrate 2, vending apparatus 500 may position and align the transfer media on the substrate using one or more of the components described above, such as mechanical guides, mechanical switches, optical switches, machine vision systems, or a combination of one or more such components. Examples of these elements are described below in association with FIG. 21.

In one embodiment, the robotic transport mechanism may be configured to retrieve and position a selected product onto the transfer media once the transfer media is placed and aligned on substrate 2 (Step 1330). In some embodiments, such as vending apparatus 500, the selected product is selected and retrieved automatically by the robotic transport mechanism from a product storage container, such as product storage container 74. This process is described above in association with FIGS. 8A-8C. In brief, end effector 70 may pull open shuttle 84 of storage container 74, and may pick up product 40 with suction cups 80. Alignment of the selected product on the transfer media may also utilize one or more of the mechanical guides, mechanical switches, optical switches, and machine vision systems described above. The selected product may be aligned onto one of the printed images on the transfer media.

The robotic transport mechanism may pause while the sublimation process is completed by apparatus 100 and associated components. After sublimating the image(s) onto the selected product, in some embodiments the robotic transport mechanism may transport the sublimated product to an associated cooling system, such as that described above in association with FIG. 12, and may facilitate the cooling of the sublimated product to at least about an ambient temperature (Step 1340).

In some embodiments, vending apparatus 500 may determine if an accessory has been purchased by the customer in association with the sublimated product (Step 1350). The customer may indicate a desire to purchase an accessory via user interface device 50. In some embodiments, vending apparatus 500 may be configured such that a particular product automatically comes with an accessory. If an accessory is determined to be associated with the transaction (Step 1350: YES), the robotic transport mechanism may translate robotic head unit 66 into proximity with the accessory storage container 72 containing the selected accessory, and may retrieve at least one accessory from storage container 72 in a process substantially the same as that described above with respect to Step 1330 (Step 1352). The robotic transport mechanism may transport the retrieved accessory to product delivery opening 54, where it may be retrieved by the customer (Step 1354). In some embodiments, the robotic transport mechanism may retrieve the accessory while the sublimation task of the associated product is still underway; for example, while the sublimated product is cooling. In other embodiments, the accessory may only be retrieved after occurrence of another event, such as providing the product to the customer via product delivery opening 54, or receiving payment from the customer via user interface device 50 and associated components. In some embodiments, the accessory itself may be sublimated. In these embodiments, vending apparatus 500 may sublimate the accessory in substantially the same manner as discussed above for sublimating products.

If no accessory is purchased or otherwise associated with the transaction (Step 1350: NO), or if the accessory retrieval process has already been completed at Step 1354, the robotic transport mechanism may transport the cooled, sublimated product to product delivery area 54 (Step 1360). As described above, the product is again transported using vacuum suction cups 80 associated with end effector 70. Vending apparatus 500 may provide the product and/or accessory to the customer immediately, or may withhold the product until another event occurs, such as receiving payment for the items, or after presenting the customer with a solicitation to purchase additional products and/or accessories.

Figure 14:
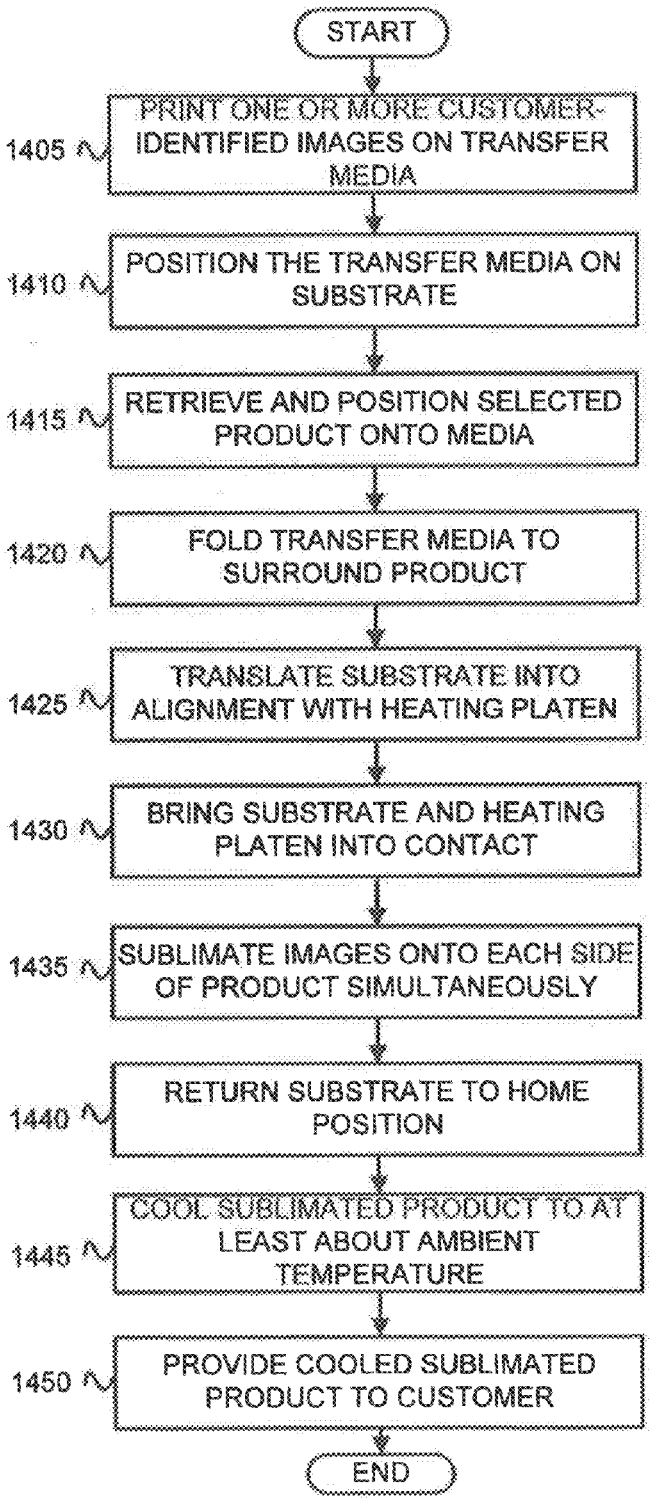
FIG. 14 is a flowchart of an exemplary dye sublimation transfer printing process, consistent with disclosed embodiments.

Apparatus 100 and vending apparatus 500 may be configured to perform a sublimation process, such as that shown in the example of FIG. 14. In one embodiment, a printer associated with the apparatus, such as printer 60, may print one or more customer-identified images on a transfer media (Step 1405). In some embodiments, the image(s) may be a user provided image received through user interface device 50. In other embodiments, the image(s) may be stock images preloaded into the memory of user interface device 50. In still other embodiments, the image(s) may constitute text input received by device 50. In yet other embodiments, the image(s) may be captured by a camera associated with device 50. The image(s) may also represent a combination or composite of the above described options.

The sublimation apparatus may position the transfer media onto a substrate, such as substrate 2 (Step 1410). In some embodiments, such as clerk-operated kiosk embodiments associated with a stand-alone apparatus 100, an operator may manually place the transfer media onto substrate 2. In other embodiments, such as the example embodiment described above in association with vending apparatus 500, a robotic transport mechanism may move the printed sheet of transfer media from printer 60 to substrate 2, using end effector 70 and vacuum suction cups 80. As discussed, in alternative embodiments, vending apparatus 500 may be configured to move the transfer media to substrate 2 in a variety of ways. Once placed in proximity to substrate 2, vending apparatus 500 may position and align the transfer media on the substrate using one or more of the components described above, such as mechanical guides, mechanical switches, optical switches, machine vision systems, or a combination of one or more such components.

In one embodiment, the sublimation apparatus or an operator of the apparatus may be configured to retrieve and position a selected product onto the transfer media once the transfer media is placed and aligned on substrate 2 (Step 1415). In some embodiments, such as a stand-alone apparatus 100, an operator may manually place select a product and place it on the transfer media, or may utilize a modular fixture configured to be associated with the selected product, as discussed below in association with FIG. 15. In other embodiments, such as vending apparatus 500, the selected product is selected and retrieved automatically by a robotic transport mechanism from a product storage container, such as product storage container 74. This process is described above in association with FIGS. 8A-8C. Alignment of the selected product on the transfer media may also utilize one or more of the mechanical guides, mechanical switches, optical switches, and machine vision systems described above. The selected product may be aligned onto one of the printed images on the transfer media.

In some embodiments, swing-arm mechanism 8 may further be configured to fold the transfer media to substantially surround the product (Step 1420), wherein at least one printed image is positioned on each side of the product. In some embodiments, apparatus 100, whether in a stand-alone embodiment or when integrated into vending apparatus 500, may fold the transfer media along a bisecting feature using swing-arm mechanism 8 in a process described above in association with FIGS. 3A-3D. Upon folding the media, one or more images may be positioned proximal to each side of the product to be sublimated. Apparatus 100, via linear motion stage 14, may engage substrate 2 and heating platen 4 (Step 1425), in a process described above in association with FIGS. 1A-1C and 2.

Process 1400 continues with the sublimation apparatus bringing heating platen 4 into contact with substrate 2 and the associated transfer media (Step 1430) and sublimating the one or more printed images onto opposing sides of the product substantially simultaneously in a single thermal cycle (Step 1435). In some embodiments, the single thermal cycle may further include a predetermined pressure. In some embodiments, parameters for the single thermal cycle that enable simultaneous printing on multiple sides of a product may be determined automatically by vending apparatus 500. The parameters may be based on one or more of the material comprising the product, the dimensions of the product, characteristics of the printed images, or other predetermined criteria. When the sublimation is complete, apparatus 100, via linear motion stage 14, may translate substrate 2 back to its home position (Step 1440), in a process described above in association with FIGS. 1A-1C and 2. As described above in association with FIGS. 3A-3D, swing-arm mechanism 8 may unfold and assist in disposal of the transfer media when substrate 2 returns to the home position. If present, a robotic transport mechanism may pick up the product and transport it to other components of the apparatus as described below.

After sublimating the image(s) onto the selected product, in some embodiments the sublimation apparatus, such as vending apparatus 500, may cool the sublimated product to at least about an ambient temperature (Step 1445). Vending apparatus 500 may cool the product using an optionally-equipped cooling system as described above in association with FIG. 12. Vending apparatus 500 may employ an active cooling system, using fans, sprayers, water baths, etc., or may employ a passive system like that of cooling plate 1200, such as heat sinks and thermally conductive panels of material such as aluminum. As discussed above, vending apparatus 500 may be configured to limit consumer access to the sublimated product via delivery opening 54 until the product has sufficiently cooled. Once the sublimated product has cooled to about an ambient temperature, vending apparatus 500 may be configured to provide the product to the customer via delivery opening 54 (Step 1450). In some embodiments, user interface device 50 may facilitate and receive payment for the product, and may prevent access to the product until payment is received.

Figure 15:
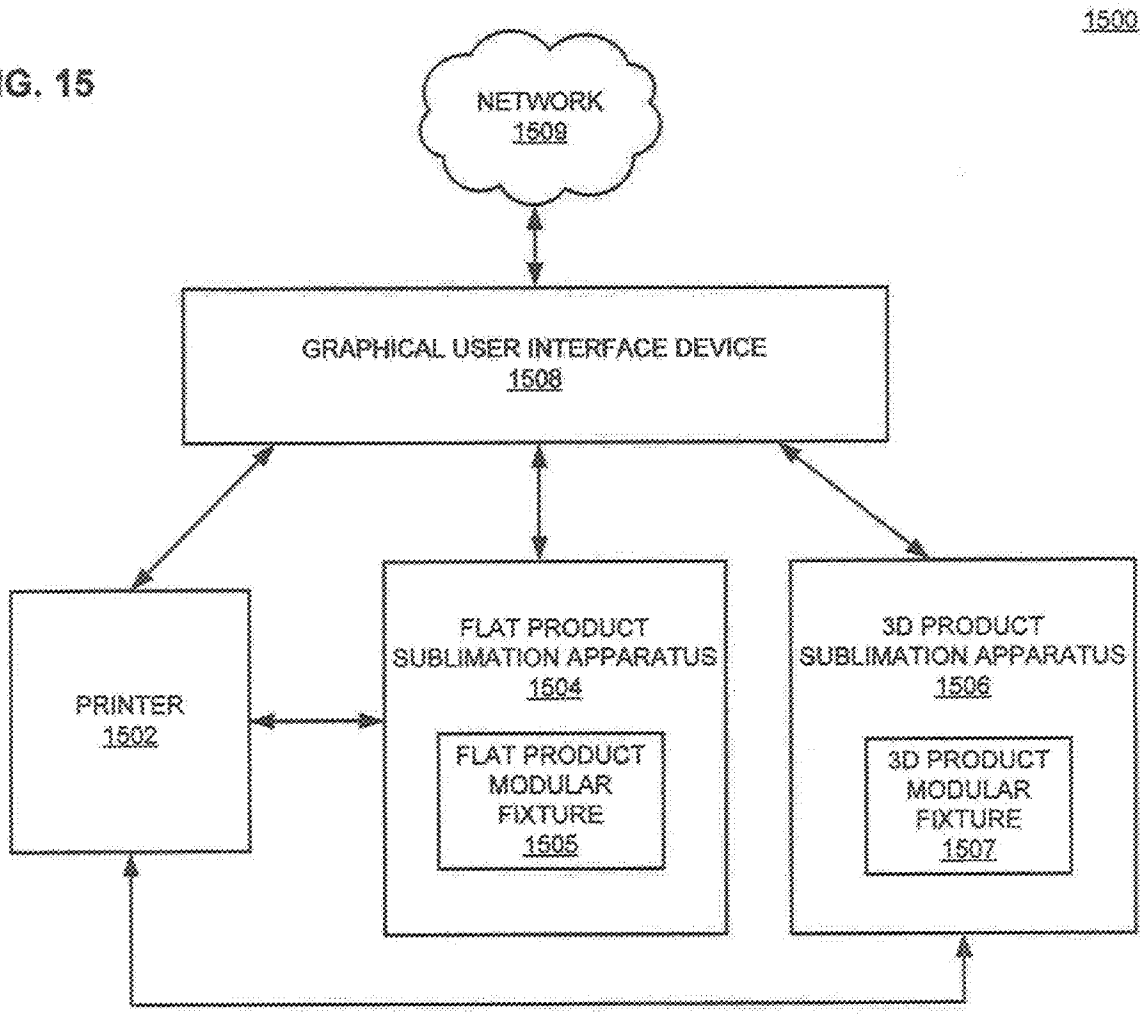
FIG. 15 is a block diagram of an exemplary clerk-operated dye sublimation transfer printing system, consistent with disclosed embodiments.

FIG. 15 shows an exemplary system that may be configured to perform one or more aspects of the disclosed embodiments. The components and arrangement shown in FIG. 15 are not intended to be limiting to the disclosed embodiment as the components used to implement the processes and features disclosed here may vary.

In accordance with certain disclosed embodiments, a system 1500 may be provided that includes a dye sublimation transfer printer 1502, a flat product sublimation apparatus 1504 (comprising flat product modular fixture 1505), a 3D product sublimation apparatus 1506 (comprising flat product modular fixture 1507), a graphical user interface device 1508, and a network 1509. Other components known to one of ordinary skill in the art may be included in system 1500 consistent with the disclosed embodiments.

Printer 1502 may be substantially the same as the associated printer described above in association with apparatus 100, and substantially the same as printer 60 described above in association with apparatus 500. Printer 1502 may be a dye sublimation transfer printer. In some embodiments, printer 1502 may be configured to communicate with a graphical user interface device (such as graphical user interface device 1508), and may further be configured with image processing software to process digital image files submitted by a user via the graphical user interface device.

Flat product sublimation apparatus 1504 and 3D product sublimation apparatus 1506 may each be configured substantially the same as apparatus 100 described above, and may contain similar components and parts. In some embodiments, flat product sublimation apparatus 1504 may further comprise a flat product modular fixture 1505, and 3D product sublimation apparatus 1506 may further comprise a 3D product modular fixture 1507. These modular fixtures may be configured as described above to serve as staging areas and alignment aids for particular types of products to be sublimated. For example, 3D product modular fixture 1507 may be configured to assist 3D product sublimation apparatus 1506 in sublimating images onto a coffee mug. In these embodiments, 3D product modular fixture 1507 may be shaped in a manner that enables secure placement and alignment of the coffee mug within 3D product sublimation apparatus 1506. 3D product modular fixture 1507 may contain additional features depending on its configuration. For example, 3D product modular fixture 1507 may contain elements or indicia (such as a barcode, QR code, computer-readable microchip, etc.) that may assist 3D product sublimation apparatus 1506 in configuring a heating platen thermal cycle to properly sublimate the product. As an example, the indicia may contain information about the material comprising the product, including its thermal properties. The indicia may contain instructions on proper dwell time, pressure, and cooling time for the product. It is understood that these are presented as non-limiting examples, and that the indicia may contain any information that may be relevant to 3D product sublimation apparatus 1506 for sublimation of the mug. Flat product modular fixture 1505 may be similarly configured to aid flat product sublimation apparatus 1504 in the sublimation of a flat product, such as a luggage tag.

Modular fixtures 1505 and 1507 may be configured in several ways. For example, the modular fixtures may be specific to a type of product, as discussed above in the example of the coffee mug. In some embodiments, the modular fixtures may even be specific to a particular one of a type of product. For example, an operator of system 1500 may have access to a plurality of 3D product modular fixtures 1507, each comprising a single coffee mug and associated indicia. These modular fixtures may be disposable after use. In these embodiments, the modular fixtures can be "shuttled" in and out of sublimation apparatuses 1504 and 1506 in a quick, safe manner. In other embodiments, modular fixtures 1505 and 1507 may serve more as generalized staging areas for a type of product, and may be re-usable.

Graphical user interface device 1508 may be configured in substantially the same manner as user interface device 50 described above in association with vending apparatus 500. Device 1508 may contain various computer systems and components (not shown) which may facilitate submission of a digital image file to be printed on a sheet of transfer media. In some embodiments, much as described above with respect to device 50, device 1508 may be configured to accept payment for the sublimated product, assist an operator or consumer with image processing tasks, perform maintenance on components of system 1500, or other such tasks as described above. Device 1508 may contain communication components that enable communication with remote computer systems via network 1509. Via this network connection, device 1508 may be configured to assist an operator or consumer with other tasks, such as making additional orders, selecting digital image files from a stored image source, recalling a saved sublimation task submitted online or by a mobile application, etc.

Network 1509 may be any type of network that facilitates communications and data transfer, such as, for example, a Local Area Network (LAN), or a Wide Area Network (WAN), such as the Internet. Network 1509 may be a single network or a combination of networks. Further, the network may comprise a single type of network or a combination of different types of networks, such as the Internet and public exchange networks for wireline and/or wireless communications. Network 1509 may utilize cloud computing technologies that are known in the marketplace. One skilled in the art would recognize that the network is not limited to the above examples and that system 1500 may implement and incorporate any type of network that allows the entities (and others not shown) included in FIG. 15 to exchange data and information.

In some embodiments, sublimation apparatuses consistent with disclosed embodiments (such as, for example, sublimation apparatuses 1504 and 1506 above), may be networked together along with a plurality of other such apparatuses (not shown) via network 1509 to a central server or servers (not shown in FIG. 15). The central servers may be associated with one or more of a manufacturer of the sublimation apparatuses, a retailer hosting the sublimation apparatuses, or a third party. In these embodiments, each of the networked sublimation apparatuses may be configured to transmit and receive data to the central server(s) via network 1509. Data transmitted to the servers from the apparatuses may comprise, for example, information relating to one or more of usage of the apparatus, maintenance status of the apparatus, re-stocking needs for the apparatus, digital image files received by the apparatus, etc. Data received from the servers by the apparatuses may comprise, for example, software updates for an associated user interface device (such as graphical user interface device 1508), or other software components. For example, software components may be received from the central server(s) that may be configured to perform maintenance on the sublimation apparatus. It is understood that these are intended to be non-limiting examples, and any information, files, or software may be transmitted to and from a central server. These embodiments are discussed in association with system 1500 solely for illustrative purposes. It is understood that any sublimation apparatus, such as apparatus 100 or vending apparatus 500, may be connected to a network and configured to exchange information with a central server or servers.

Figure 16A:
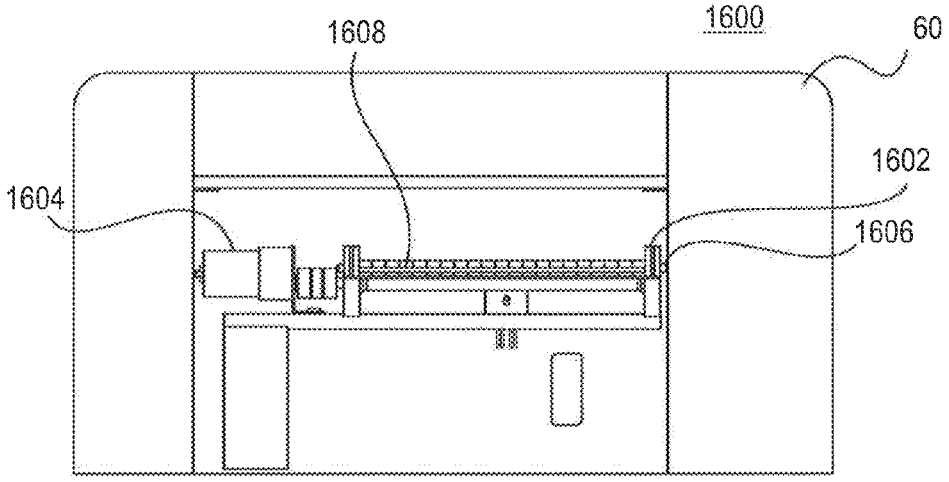
FIGS. 16A-16B are diagrammatic illustrations of a dye sublimation transfer printer assembly associated with an exemplary integrated dye sublimation printing apparatus consistent with disclosed embodiments.
Figure 16B:
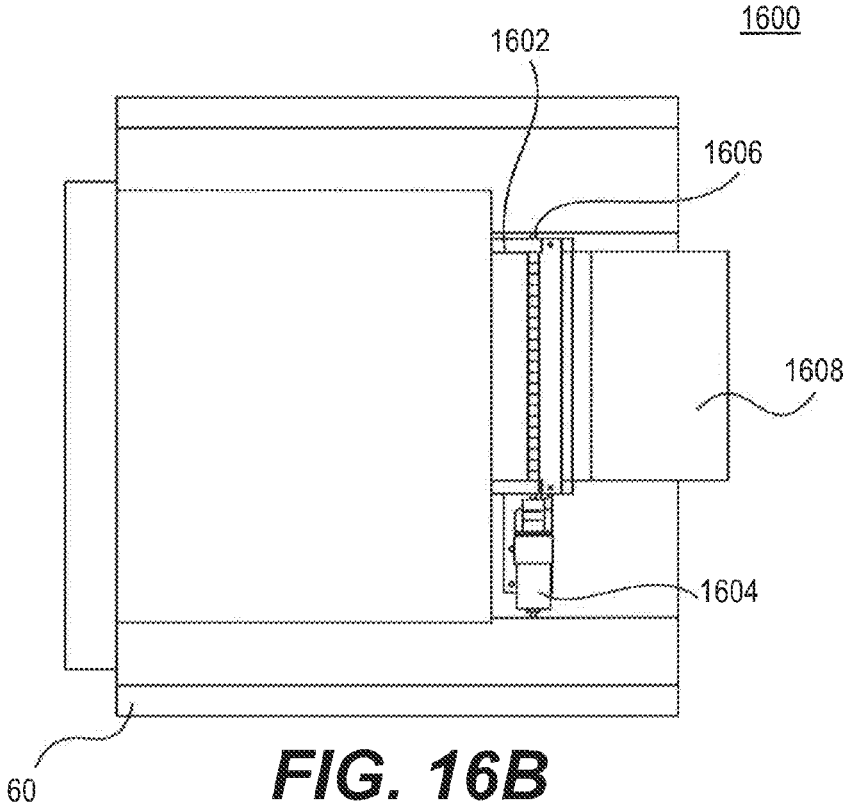

FIGS. 16A and 16B illustrate front and top views, respectively, of a printer assembly 1600 that may be configured to operate with one or more of apparatuses 100 and 500. Assembly 1600 includes a dye sublimation transfer printer, such as printer 60 described above. Printer 60 may be configured as described to print one or more images onto transfer media to then be sublimated onto one or more products. As previously discussed, a given apparatus 100 or apparatus 500 may be configured such that printed transfer media may be manually removed from printer 60, either by hand by an operator, or may be set up in a configuration where gravity assists the printed transfer media in accessing substrate 2. In alternative embodiments, a robotic transport mechanism may actively and automatically transport the printed transfer media from printer 60 to substrate 2.

FIGS. 16A-16B illustrate yet another embodiment of a printer feeding assembly that may be included within an apparatus 100 or apparatus 500 setup to further automate and enhance transfer media feeding, placement, and alignment. In these embodiments, a sheet of transfer media (not shown) is printed within the housing of printer 60. Feeding mechanisms typical to printers may then expel the printed sheet of transfer media from printer 60 onto printer tray 1602. Printer assembly 1600 may then activate an electric stepper motor 1604 to turn feeder bar 1606. In some embodiments, particularly embodiments associated with vending apparatus 500, stepper motor 1604 may always be active. In other embodiments, apparatus 100 or apparatus 500 may be configured to detect that a sheet of transfer media is exiting printer 60, and may energize stepper motor 1604 at that time. Such detection may be achieved by placement of one or more mechanical or optical sensors incorporated into printer tray 1602. In some embodiments, these sensors may be operatively coupled to sensors 1102 and/or 1106 as described above in association with FIG. 11, or the sensors may themselves be sensors 1102/1106.

Feeder bar 1606 may be substantially cylindrical in shape and may be comprised of any usable material, such as metal, plastic, or wood. Feeder bar 1606 may be configured in a manner such that it is situated close enough to the surface of printer tray 1602 to allow only the thickness of a single sheet of transfer media to pass through while rotating. Feeder bar 1606 may be operatively coupled to stepper motor 1604 by a rotor, crank, or other mechanical means such that the force generated by stepper motor 1604 operates to rotate feeder bar 1606 along its longitudinal axis.

In these embodiments, a sheet of printed transfer media may emerge from printer 60 and engage sensors on tray 1602. Stepper motor 1604 may either already be operational, or its operation may initiate upon an electronic or mechanical cue from the sensors of tray 1602 (such as sensors 1102/1106). Upon activation of stepper motor 1604 operation, feeder bar 1606 begins to rotate. The transfer media may engage feeder bar 1606, and feeder bar 1606's rotational motion may assist in propelling the transfer media onto platform 1608. In some embodiments, platform 1608 may be an intermediate location between printer tray 1602 and substrate 2. In other embodiments, platform 1608 and substrate 2 may be coextensive. Platform 1608 may also include one or more integrated mechanical or electronic sensors, such as sensors 1102/1106. The sensor(s) may be configured to detect when the printed sheet of transfer media is fully expelled out of printer 60, and further, when the rotational motion of feeder bar 1606 has completely propelled the transfer media out onto platform 1608. In some embodiments, sensors included within platform 1608 may be operatively coupled to stepper motor 1604 and may be configured to halt operation of stepper motor 1604 once the transfer media has processed to the proper location on platform 1608. Platform 1608 may further be operatively couple to other components of apparatus 100, such as clamping system 12, which may activate upon receiving a signal from platform 1608.

Figure 17A:
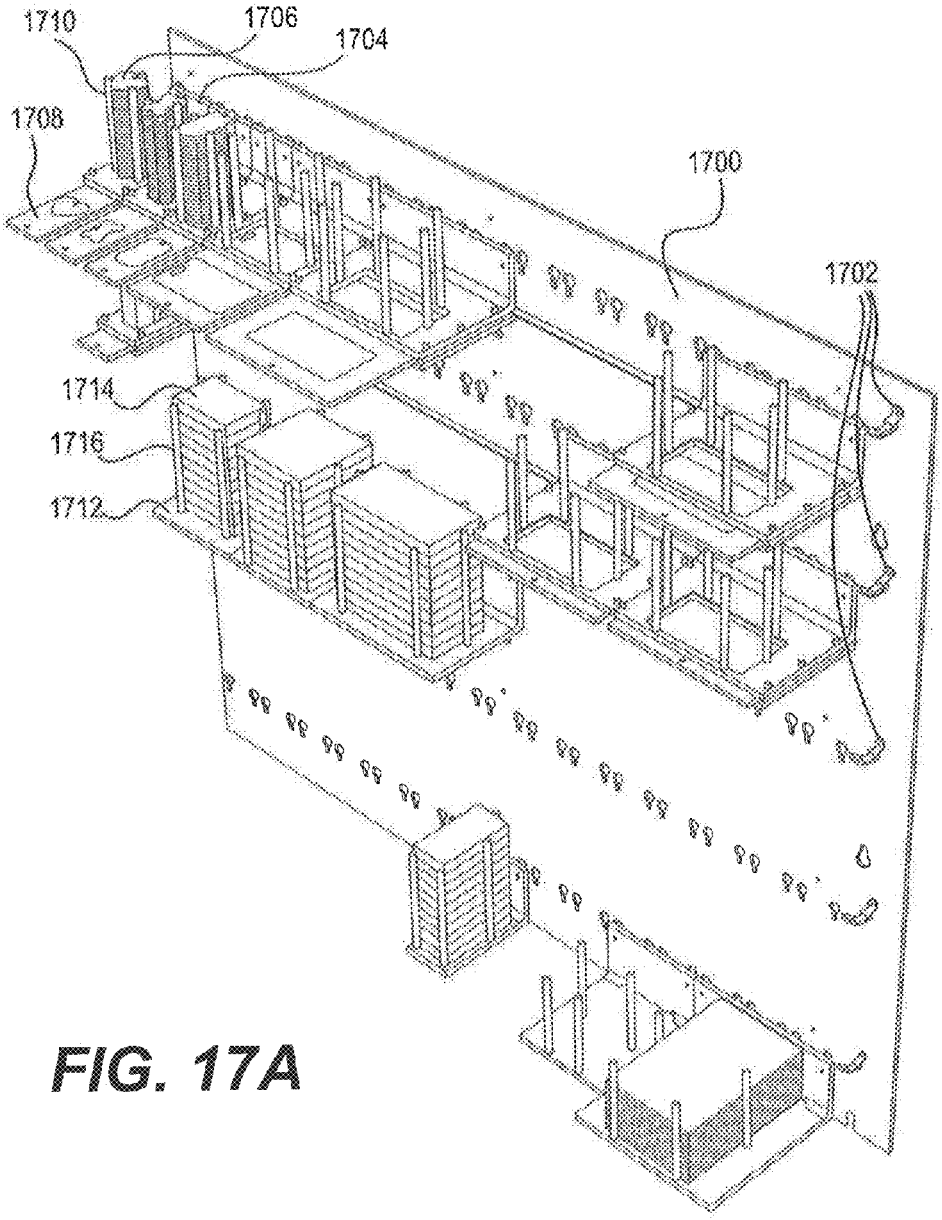
FIGS. 17A-17B are diagrammatic illustrations of interchangeable modular product and accessory storage containers incorporated within an integrated dye sublimation transfer printing vending machine, consistent with disclosed embodiments.
Figure 17B:
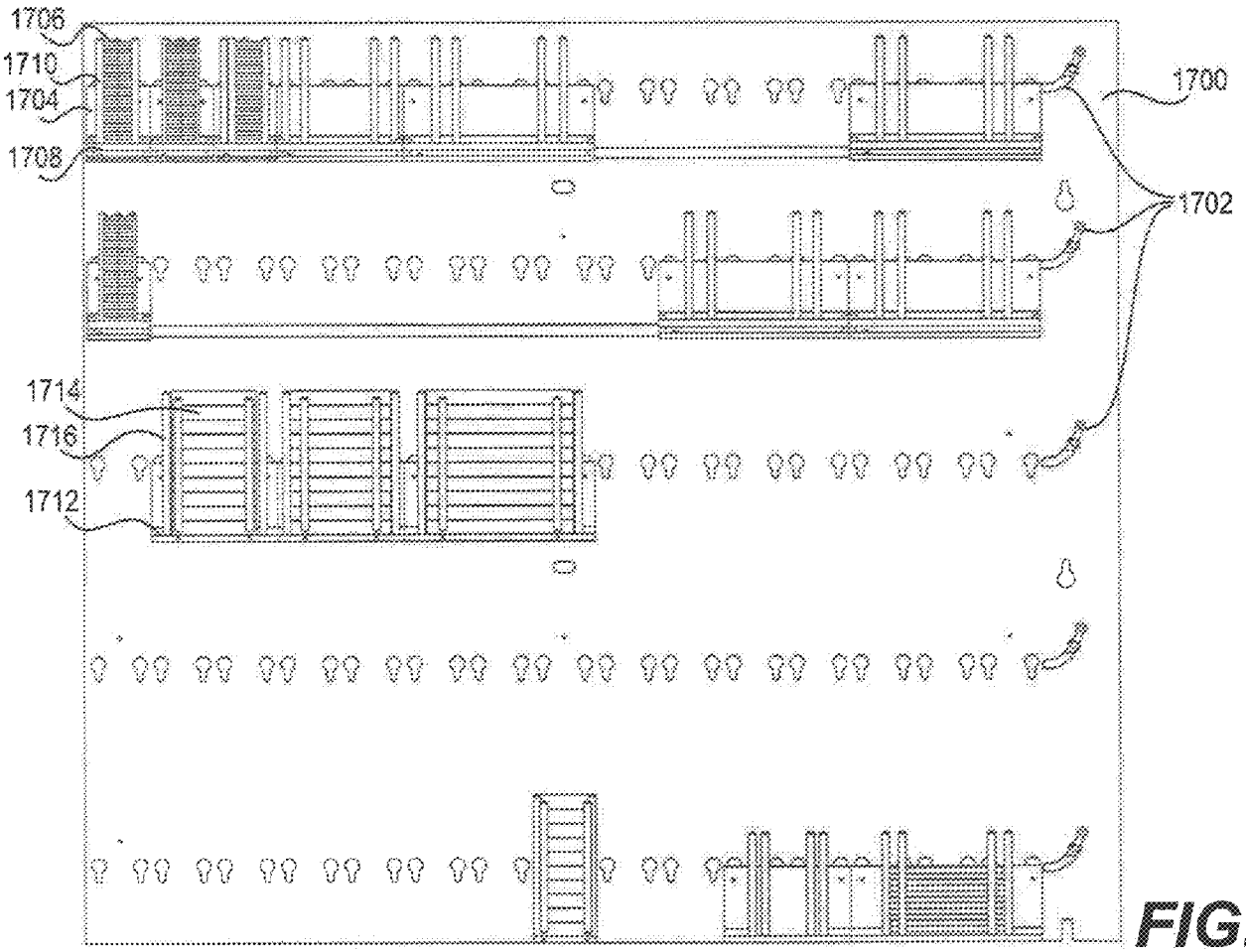

Turning to FIG. 17, FIGS. 17A and 17B illustrate perspective and front views, respectively, of an inventory management and deployment system 1700 consistent with disclosed embodiments. In some embodiments, inventory system 1700 may be situated within a vending apparatus 500. In alternative embodiments, inventory system 1700 may be configured to be used with a stand-alone apparatus 100 that may be clerk-assisted or user-operated. The back wall of inventory system 1700 may be comprised of any suitable material, such as wood, pressboard, cardboard, plastic, acrylic, aluminum, steel, etc. Inventory system 1700 may include several locks 1702 placed at the end of each row of the system. Each lock 1702 may be mechanically coupled to a locking bar (not shown) located on the rear of the back wall of inventory system 1700. When rotated, switched, or otherwise engaged, lock 1702 engages the locking bar to secure storage containers that may be attached through the back wall of the inventory system.

As illustrated in FIGS. 17A and 17B, an inventory system 1700 may contain one or more product containers 1704 and accessory containers 1712. In some embodiments, containers 1704 and 1712 may be the same as or interchangeable with product storage containers 74 and accessory storage containers 72 described above, or they may be distinct. Product containers 1704 and accessory containers 1712 may be configured in a modular manner such that they may be interchangeably installed and removed rapidly within inventory system 1700. FIGS. 17A-17B illustrate a series of different containers 1704 and 1712 that may have different heights, widths, and depths based on the products or accessories that they contain. For example, the illustrated embodiment of FIG. 17A shows various product containers 1704 each containing a stack of a plurality of different sublimatable products 1706, such as heart-shaped pet tags, bone-shaped pet tags, luggage tags, military dog tags, and various products related to mobile devices. Each product container 1704 includes a shuttle 1708, which presents a single product that can be picked up by, for example, end effector 70 of a robotic transport mechanism as described above. Each shuttle 1708 also contains a hole, divot, or other such feature near its end, which can interface with mechanical implement 82 of an end effector 70. The shuttles 1708 can each thus be operated in the manner illustrated in FIGS. 8A-8C to open the shuttle and remove a single product for sublimation. The individual stacks of products 1706 are held in place by pins 1710. In some embodiments, one or more of the pins 1710 associated with each product container 1704 may be removable, enabling refreshment of the product stack by a front-loading process that can be readily automated. Alternatively, all pins 1710 may be stationary on product container 1704 and the products may be refreshed by a top-loading process. Pins 1710 may be movable on the surface of product container 1704 to account for different shapes and sizes of products 1706.

Elsewhere on the top row of the back wall of inventory system 1700 is an empty portion of the mounting system for the product containers 1704. By using common spacing, product containers 1704 (as well as accessory containers 1712) may be manufactured with common dimensional units. For example, a product container 1704 with a thinner width, such as the pet tag containers in the upper left of FIGS. 17A and 17B, may be mountable on a single pair of key slots located on the back wall of inventory system 1700, and may be locked into place using locks 1702. Wider containers, such as the mobile device product storage containers to the right of the pet tag containers, may be mountable on two or three sets of key slots. This common dimensionality allows interchangeability of product containers 1704 and accessory containers 1712, and permits rapid re-arrangement and re-deployment of different products and accessories within vending apparatus 500. This may assist the retailer hosting vending apparatus 500 to rotate out offerings based on season, location, special events, etc., and enhances the profit generation capabilities of the vending apparatus.

In the example embodiment illustrated in FIGS. 17A and 17B, accessory containers 1712 are located on the back wall of inventory system 1700 below the product containers 1704. Depending on the products 1706 offered for sublimation in a given embodiment of vending apparatus 500, various complementary accessory containers 1712 may be deployed within inventory system 1700, each containing a stack of a plurality of different accessories 1714. In some embodiments, such as the example embodiment illustrated in FIGS. 17A and 17B, accessory containers 1712 may not include spring-loaded shuttles 1708 in the manner of product containers 1704 described above. Further, as also shown in FIGS. 17A and 17B, individual accessories 1714 may be packaged and presented in boxes or other such wrapping. Thus, the individual accessories are larger and easier for an end effector 70 to grasp, and a shuttle system may not be required for accurate retrieval. In alternative embodiments, the shuttles may be included. Much as is the case for products 1706, the individual stacks of accessories 1714 are held in place by pins 1716. In some embodiments, one or more of the pins 1716 associated with each accessory container 1712 may be removable, enabling refreshment of the accessory stack by a front-loading process that can be readily automated. Alternatively, all pins 1716 may be stationary on accessory container 1712 and the products may be refreshed by a top-loading process. Pins 1716 may be movable on the surface of accessory container 1712 to account for different shapes and sizes of accessories 1714.

Figure 18A:
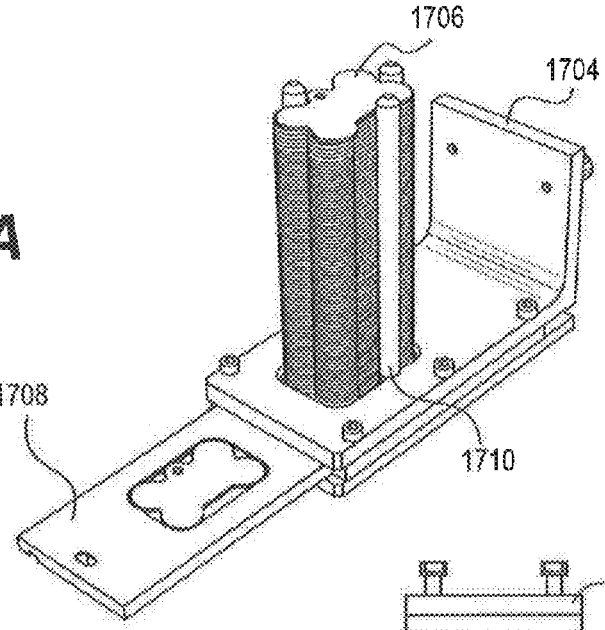
FIGS. 18A-18C are perspective, front, and top views respectively of a product storage container incorporated within an integrated dye sublimation transfer printing vending machine, consistent with disclosed embodiments.
Figure 18B:
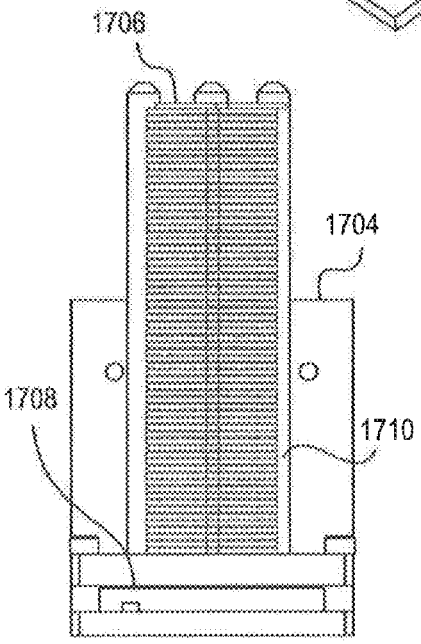
Figure 18C:
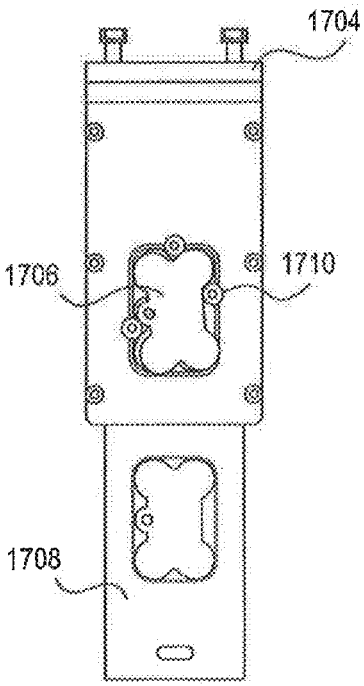

Turning to FIG. 18, FIGS. 18A-18C are detailed views of a product container 1704 as described above. In the example of FIG. 18, product container 1704 is filled with a stack of products 1706, which here are bone-shaped dog tags, held in place by three pins 1710. FIG. 18A is a perspective view of the product container assembly, FIG. 18B is a front view, and FIG. 18C is a top view. As shown in these figures, a robotic transport mechanism, such as the one described above in association with FIGS. 6-8, may be equipped with a robotic head unit 66 and end effector 70 that are configured to interface with shuttles 1708. A mechanical implement (e.g., a hook, nubbin, or other such feature) such as mechanical implement 82 described above may interface with the hole in each shuttle 1708, pull the shuttle open as described in FIGS. 8A-8C, and expose a single product 1706. Suction cups 80 associated with end effector 70 may then grasp the product 1706 with vacuum pressure, lift the product out of shuttle 1708, and transport the product 1706 to substrate 2 for placement and alignment on the transfer media. In some embodiments, shuttle 1708 may be configured to automatically close (such as via a spring-loaded mechanism), and then drop the next product 1706 into the shuttle well for a future task. In other embodiments, the shuttle 1708 may not automatically close, and may be closed by the robotic transport mechanism via interface with mechanical implement 82.

As discussed above, in some embodiments, pins 1710 may be movable and/or removable with respect to product container 1704. In embodiments where pins 1710 are stationary, products 1706 may be reloaded from the top either manually by a clerk or automatically, by the robotic transport mechanism via suction cups 80. In embodiments where pins 1710 are removable, particularly the pins proximal to shuttle 1708, a stack of products 1706 may be loaded into product container 1704 from the front. Alternatively, pins 1710 and/or product container 1704 itself may contain springs or other flexible elements that may allow end effector 70 to "open" and/or reload the product container 1704 without fully removing the pins 1710.

Figure 19A:
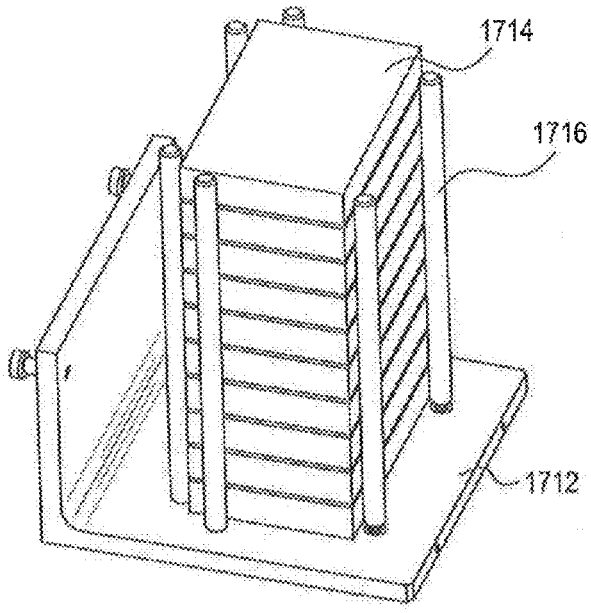
FIGS. 19A-19C are perspective, front, and top views respectively of an accessory storage container incorporated within an integrated dye sublimation transfer printing vending machine, consistent with disclosed embodiments.
Figure 19B:
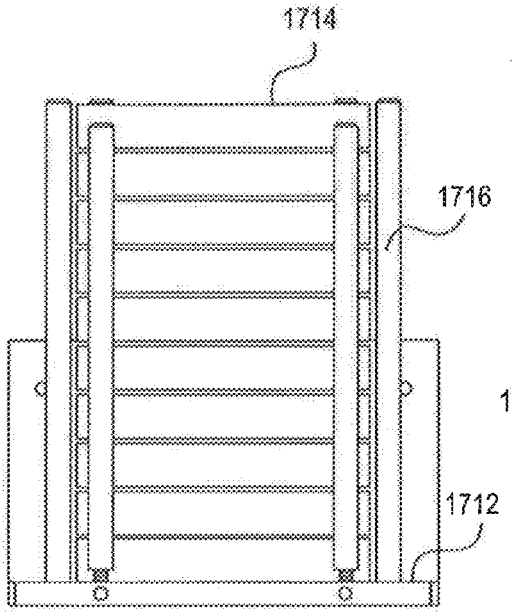
Figure 19C:
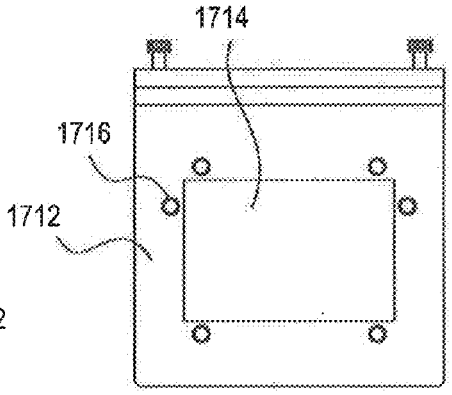

Similar to FIG. 18, FIGS. 19A-19C are detailed views of an accessory container 1712 as described above. In the example of FIG. 19, accessory container 1712 is filled with a stack of boxed accessories 1714, held in place by six pins 1716. FIG. 19A is a perspective view of the accessory container assembly, FIG. 19B is a front view, and FIG. 19C is a top view. As shown in these figures, the robotic transport mechanism described above may be configured to interface with the accessory container 1712. Suction cups 80 associated with end effector 70 may grasp an individual accessory 1714 with vacuum pressure, lift the accessory out of accessory container 1712, and transport the accessory 1714 to a desired location. In some embodiments, accessory 1714 may be transported to locations within vending apparatus 500, such as substrate 2 or cooling plate 1200. In other embodiments, the accessory 1714 may be transported directly to an area where it may be accessed by a user, such as delivery opening 54.

As discussed above, in some embodiments, pins 1716 may be movable and/or removable with respect to accessory container 1712. In embodiments where pins 1716 are stationary, accessories 1714 may be reloaded from the top either manually by a clerk or automatically, by the robotic transport mechanism via suction cups 80. In embodiments where pins 1716 are removable, a stack of accessories 1714 may be loaded into accessory container 1712 from the front. Alternatively, pins 1716 and/or accessory container 1712 itself may contain springs or other flexible elements that may allow end effector 70 to "open" and/or reload the accessory container 1712 without fully removing the pins 1716.

Inventory system 1700 may thus be configured to substantially automate the inventory management process for each individual vending apparatus 500. Deployment of system 1700 saves time and resources, particularly when augmented with additional features. For example, in some embodiments, end effector 70 of an associated robotic transport mechanism may be equipped with vision sensors as described above. In these embodiments, end effector 70 and an associated control (not shown) may be configured to track the inventory levels of the various products 1706 and accessories 1714 within each product container 1704 and accessory container 1712, respectively. For example, in one embodiment, upon installation of a given product container 1704 or accessory container 1712 within the back wall of an inventory system 1700, a "home position" for the particular container may be registered by the sensor(s) associated with end effector 70. This home position would in essence be the "top" of the container, and would equate to the container being full. The control may then be configured to know the unit vertical height of each product 1706 or accessory 1714 within the container. For example, a given accessory container 1712 may house boxed luggage tag holders whose boxes are each 0.5" high. End effector 70 may translate within the robotic transport mechanism until it finds the home position for that particular accessory container 1712. Robotic head 66 may then translate vertically downwards in the Z-direction until the sensor(s) associated with end effector 70 detect the presence of the top of a box. In the example presented above, for example, if the robotic head translates about two inches before detecting a box, the robotic transport mechanism control may determine that four of the 0.5" boxes have been removed from the accessory container 1712.

As configured, inventory system 1700 may be configured to automate at least three major functions of the vending apparatus 500 supply chain. First, inventory system 1700 enables vending apparatus 500 and associated user interface device 50 to know that a particular product or accessory is out of stock before an attempt is made to retrieve the out-of-stock item from its storage container. As discussed in further detail below in association with FIGS. 25-37, inventory system 1700 may be configured to alter the information displayed to a user via the user interface device relating to out-of-stock products. For example, the item may be "grayed out" on the selection interface presented on display screen 52, or may otherwise indicate that the item is not available, and the user may be directed to select another item. If the desired item is in stock, but at a low inventory level, user interface device 50 may be configured to display other related information. For example, purchase of the item may be limited to an amount less than or equal to the inventory count remaining within the particular storage container, as detected by inventory system 1700. In other embodiments, the user interface may be configured to offer a discount on low-stock items, in the manner of a "sale" or "clearance."

A second function of inventory system 1700 is that inventory levels can be tracked automatically, and resources can be saved by preventing unnecessary refill trips by a human worker. For example, the robotic transport mechanism control, in conjunction with user interface device 50, may be programmed such that a given inventory level triggers a refill visit. This threshold inventory level may be calculated on the basis of a single product container 1704 or accessory container 1712 (i.e., "refill me when inventory reaches 20% of full") up to the level of the entire vending apparatus 500 (i.e., "make a service visit when the average inventory level of all containers reaches 50%"). User interface device 50 may be configured to send information relating to inventory to a remote server, such as a server associated with the retail establishment hosting apparatus 500, a server associated with the manufacturer of apparatus 500, or another third party server. In some embodiments, the information may be sent regularly on a set schedule, including but not limited to hourly, daily, weekly, monthly, quarterly, semi-annually, or annually. In other embodiments, the information may be sent on an as-needed basis; for example, when one or more of the threshold levels described above are reached. In still other embodiments, a user operating one or more of the remote servers described above may be capable of accessing user interface device 50 or a remote server containing the information, and may affirmatively check the inventory status of apparatus 500 and its equipped containers.

As described, inventory system 1700 can substantially reduce time and hassle for a human service operator. The embodiments described above remove the necessity for a human operator to disable apparatus 500 and manually count the number of products 1706 and/or accessories 1714. Further, the refilling process can be expedited further by providing set declinations of refill products 1706/accessories 1714; for example, a pack of 25 of the boxed luggage tag holder accessories described in the example above. In these embodiments, a human operator may simply wait to refill the particular accessory container 1712 for the luggage tag holder accessory until 25 of them have been removed and sold from apparatus 500. In other embodiments, user interface device 50 may be configured to compile an inventory report based on information relating to inventory gathered by inventory system 1700, and display it on demand to the human service operator. The report may be displayed, for example, on display screen 52, or printed via an optional receipt printer associated with user interface device 50 described above. In these embodiments, the efficiency of visits to the vending apparatus 500 by a human service operator may be even further increased, by allowing an instant report of what products need to be replaced and/or replenished. Inventory system 1700 can thus reduce downtime for apparatus 500, minimize hassle to the service operator and the retail establishment, and enhance revenue.

A third function and benefit of inventory system 1700 is that it can assist with replenishment and management operations further up the supply chain. For example, a warehouse or other such storage facility affiliated with the human service operator may contain known amounts of products or accessories for deployment in one or more vending apparatuses 500 in a given geographical region. As individual inventory systems 1700 in each vending apparatus 500 periodically determine inventory levels of the various products, they may send information to a server as discussed above that prompts action by a human service operator, such as a replenishment visit. The server may be configured to compile information received from multiple vending apparatuses 500, including inventory levels, for purposes of determining inventory needs at the regional level. At a predetermined level of inventory, for example, the server may automatically place an order with a supplier for replenishment of the particular product or accessory. In this manner, multiple points of a supply chain can be automated and processed in a far more efficient and cost-effective manner thanks to the capability of a network of vending apparatuses 500 to self-determine and report their own levels of inventory.

Turning to FIG. 20, in some embodiments, apparatus 500 and an associated inventory system 1700 may be configured to sublimate and dispense small objects, such as jewelry or other custom items, that do not lend themselves readily to the stacked arrangement discussed in association with FIGS. 17-19. In these embodiments, a product container 1704 may be configured to store a product containing multiple such items. For example, in the examples illustrated in FIGS. 20A-20D, multiple identical items may be incorporated into a single rectangular plate, and the individual items could then be punched out of the plate for use, either manually or automatically. In alternative embodiments, the items need not be identical, and different shaped items may be etched within a common product. The multi-item product may be comprised of any sublimatable material described previously, including metals, plastics, or wood. In some embodiments, the multi-item product may be pre-printed with a background image or pattern, such as suggested above in association with FIG. 9. In other embodiments, the products may simply be blank. The "pieces" within the multi-item product may be etched into the product by any suitable means known to those of skill in the art.

Figure 20A:
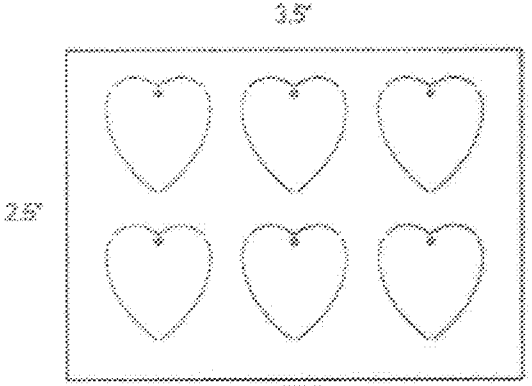
FIGS. 20A-20D are diagrammatic illustrations of common matrix products, consistent with disclosed embodiments.
Figure 20B:
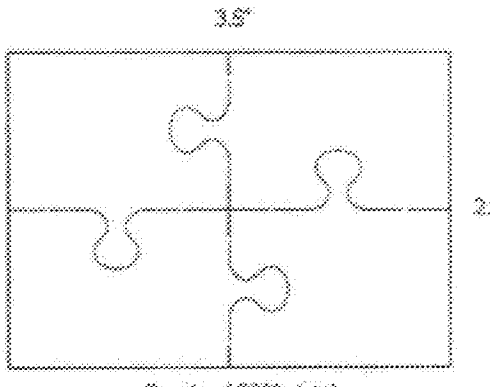
Figure 20C:
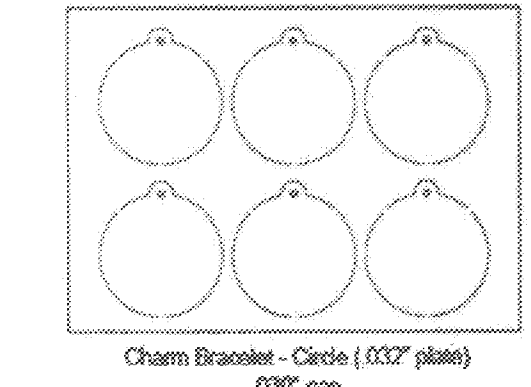
Figure 20D:
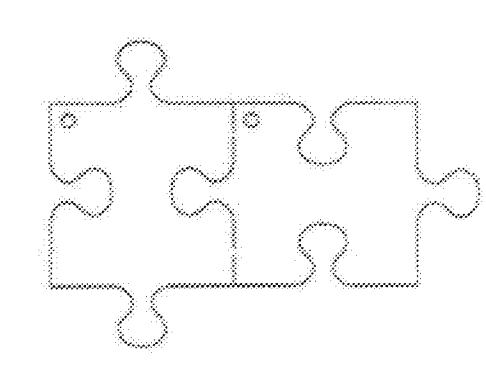

FIG. 20A illustrates such a multi-item product for a set of heart-shaped charms, such as those that may be associated with popular charm bracelets. In the illustrated example, six identical hearts are etched into a 3.5" by 2.5" product that is 0.32" thick. These specifications are presented solely for exemplary purposes, and any size product may be used. It may be advantageous, however, to use a commonly-sized product for different applications; for example, each of the plates in FIGS. 20A-20C are the same size, with different-sized elements etched into them. FIG. 20B illustrates a product with four puzzle pieces etched into it; the entire product itself may then be sublimated with an image and can serve as the completed puzzle. FIG. 20C illustrates a charm bracelet pattern similar to that shown in FIG. 20A, but with circular charms rather than heart-shaped charms. Finally, FIG. 20D illustrates an irregularly-shaped embodiment, with an irregular product split into two pieces of puzzle piece-shaped jewelry. These embodiments are presented as examples of how the "multi-item product" concept may be extended, and are not intended to be limiting. As described above, such a product stored within an apparatus 500 equipped with an inventory system 1700 may bear a fiducial marker or other such indicia that may indicate to an associated vision system 1002 information relating to that product. As such, an apparatus 100 or apparatus 500 may be configured to simultaneously sublimate various images onto one or more sides of each of the multiple items within the product. In some embodiments, the multiple items may be sublimated with the same image; for example, six individuals attending the same event can have identical charms/items as souvenirs of the event. In other embodiments, the multiple items may be sublimated with different images. For example, a consumer may have the opportunity to essentially make a charm bracelet from scratch with multiple different charms sublimated substantially simultaneously with a variety of different images.

In the multi-item product embodiment described in association with FIGS. 20A-20D, additional features may be included with the products to both increase efficiency within the apparatus 500 and/or add value for the consumer who customizes and purchases the item. For example, in some embodiments the multi-item product may have an embedded emery board or other such filing tool, in order to smooth the "edges" of the individual items once they are punched out of the product. Alternatively, such a filing tool may be included within apparatus 500 as a separate add-on accessory, housed within its own accessory storage container 1712. The multi-item products may also include features that increase efficiency and accuracy within the apparatus 500 for the sublimation process. For example, in the charms illustrated in the examples of FIGS. 20A and 20C, the holes in the individual items serve as attachment interfaces for the jewelry items, but they may also be usable as alignment tools or reference points for vision system 1002 within apparatus 500; essentially serving as extra fiducial markers 1004. There may be additional holes, marks, fiducial markers, etc. on the product or on any of its incorporated items that may be detectable by vision system 1002.

Figure 21A:
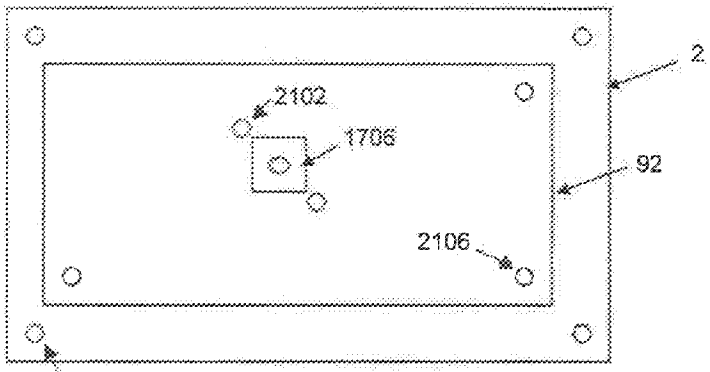
FIGS. 21A-21D are diagrammatic illustrations of fiducial markers usable with a vision system, consistent with disclosed embodiments.
Figure 21B:
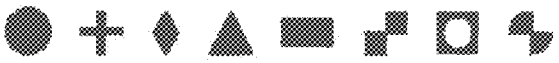

FIGS. 21A-21D describe additional features relating to vision system 1002 and fiducial markers 1004 in detail. FIG. 21A is a diagram illustrating different types of fiducial markers 1004 that may be recognizable by vision system 1002. In the example illustrated in FIG. 21A, a product 1706, such as those illustrated in FIGS. 17-18, is aligned on a sheet of transfer media 92 on substrate 2. There are three types of fiducial markers present. A local fiducial marker 2102 may be associated with one or more of product 1706 or transfer media 92. This subtype of fiducial marker 1004 may be associated with individual types of sublimatable products, and may assist with precise, accurate alignment of a particular product 1706. For example, if product 1706 is a dog bone pet tag, as illustrated in FIGS. 18A-18C, local fiducial marker 2102 may be situated near the edges of the tag on the printed transfer media. A second subtype of fiducial marker 1004 illustrated in FIG. 21A is panel fiducial marker 2104. In the example illustrated in FIG. 21A, the panel fiducial marker 2104 may be permanently disposed on substrate 2, and may send information to vision system 1002 to assist with proper alignment of the transfer media 92 on the substrate 2. For example, a panel fiducial marker 2104 may assist the automated printer assembly 1600 discussed above in accurately transporting the transfer media 92 from a printer 60 (not shown) to substrate 2. A third subtype of fiducial marker 1004 is a global fiducial marker 2106. Global fiducial marker 2106 may be printed on the transfer media 92 by printer 60 to further assist with alignment of the transfer media 92 and/or product 1706 on substrate 2. Although fiducial markers 2102, 2104, and 2106 are depicted as circles in FIG. 21A, the fiducial markers may be represented as any shape or pattern. Example fiducial markers are shown in FIG. 21B. In some embodiments, it may be advantageous to differentiate the size, shape, color, or other property of different types of fiducial markers 1004, or fiducial markers of the same type associated with different items, such as different types of products 1706.

Figure 21C:
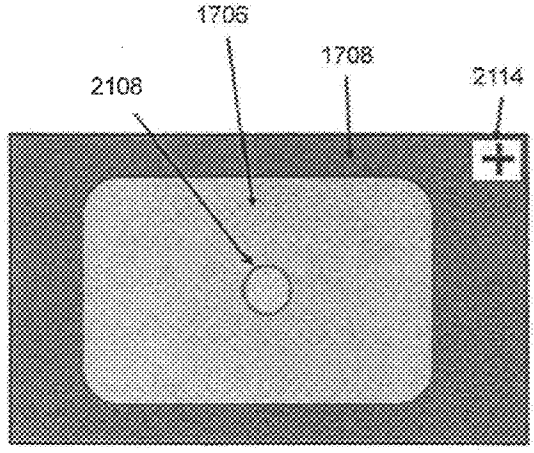

Vision system 1002 and fiducial markers 1004 may be used in some embodiments to assist an associated robotic transport mechanism within an apparatus 500 to faithfully retrieve products 1706 and/or accessories 1714 from their respective storage containers. In FIG. 21C, an example embodiment is illustrated in which a shuttle 1708 associated with a product container 1704 (not shown) is in the open position. A single product 1706 (here, illustrated as a luggage tag) is presented to the robotic transport mechanism for retrieval. A local fiducial marker 2114 may be disposed on the surface of shuttle 1708. Fiducial marker 2114 may serve several purposes in the scenario depicted in FIG. 21C, as well as the similar scenario presented in FIGS. 8A-8C and 18A-18C. First, fiducial marker 2114 may assist a sensor associated with end effector 70 of the robotic transport mechanism in gauging its global position with respect to the shuttle 1708 and the product 1706. In other words, robotic head 66 may be able to adjust the position of end effector 70 in the X, Y, and/or Z directions based on coordinates read from fiducial marker 2114. Secondly, fiducial marker 2114 may allow for finer scale adjustments once end effector 70 is in range of product 1706. For example, end effector 70 may be configured to pick up product 1706 at "ideal" location 2108 with suction cup(s) 80. Location 2108 may be a known lateral distance from fiducial marker 2114, and marker 2114 may be disposed at a known orientation. If small adjustments in position or alignment are required in order for end effector 70 to grasp product 1706 at position 2108, information read from fiducial marker 2108 interpreted by a control associated with the robotic transport mechanism or user interface device 50 may assist in making the adjustments. Finally, fiducial marker 2114 may contain other information specific to the product 1706 being presented, such as its size, shape, color, or the material which comprises it. This is intended to be a non-limiting list of possible information, and fiducial marker 2114 may contain more or less information in any particular embodiment.

Figure 21D:
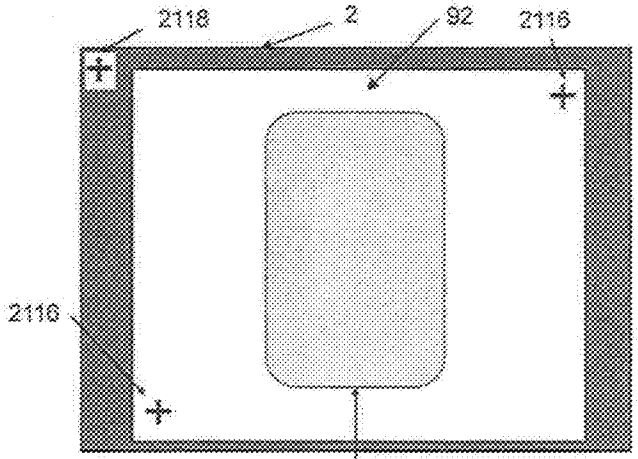

In FIG. 21D, fiducial markers are displayed in the context of placement of a product 1706 on a piece of transfer media 92 aligned on substrate 2. In some embodiments, as end effector 70 approaches substrate 2 after retrieving product 1706 from an associated product container 1704, sensors associated with end effector 70 and vision system 1002 may use two types of fiducial markers 1004 for placement of product 1706. Transfer media 92 may have target local fiducial markers 2116 printed on opposing corners of the media. End effector 70 and vision system 1002 may read the positions of fiducial markers 2116 and intelligently adjust for any offsets or variations in the positioning or alignment of transfer media 92 on substrate 2. Proper alignment is essential in order for successful sublimation of high-quality printed images onto product 1706. In some embodiments, a global fiducial marker 2118 may be disposed on the surface of substrate 2 itself to allow for coarser measurement. The examples illustrated here in FIGS. 21A-21D are intended to be non-limiting, and one of skill in the art may contemplate any number of uses for fiducial markers 1004 readable by vision system 1002 within a system environment consistent with disclosed embodiments.

Figure 22:
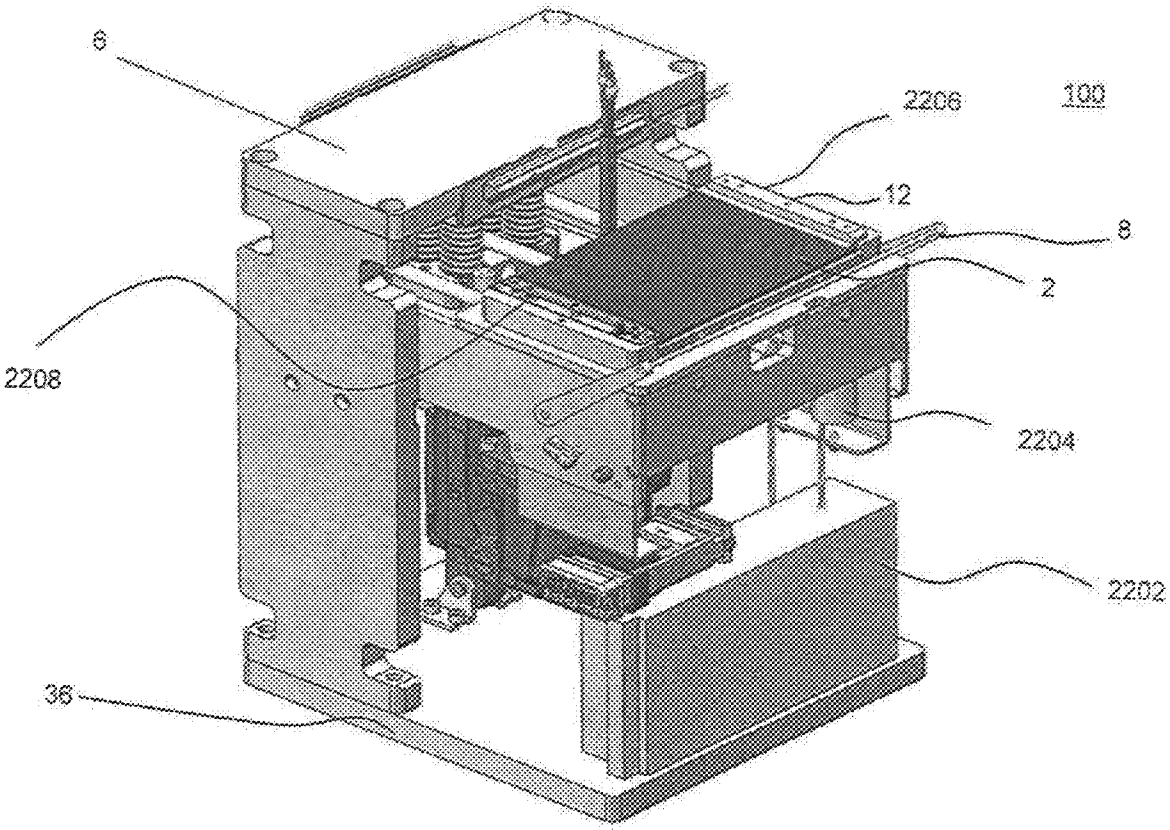
FIG. 22 is a diagrammatic illustration of a clamping system for transfer media within an integrated dye sublimation transfer printing apparatus, consistent with disclosed embodiments.

FIG. 22 is a cutaway view of apparatus 100, showing additional detail relating to clamping system 12. As shown in the example embodiment of FIG. 22, clamping system 12 further comprises two clamps 2206, with multiple bolts 2208 disposed within each of the two clamps. Other components of the system include solenoid(s) 2204 and solenoid power source 2202. The default position of clamps 2206 and bolts 2208 is fully clamped down. When transfer media is to be placed on substrate 2, clamping system 12 may be activated either manually or automatically to elevate clamps 2206 with sufficient clearance to insert at least a portion of the transfer media underneath. In some embodiments, clamping system 12 may be activated automatically via signals sent by sensors, such as sensors 1102 and/or 1106. The sensors may be associated with a printer assembly, such as printer assembly 1600, or may be associated solely with substrate 2. When activated, power source 2202 may provide power to solenoid(s) 2204. Solenoids 2204 then may provide force sufficient to elevate bolts 2208 and propel them upward relative to substrate 2. As bolts 2208 rise, they also may raise clamps 2206 a sufficient vertical distance to insert a sheet of transfer media underneath. Substrate 2 may be configured with one or more sensors, such as sensors 1102 and/or 1106, to recognize when the transfer media is properly placed and/or aligned, and clamping system 12 may be deactivated. In some embodiments, vision system 1002 may recognize fiducial markers such as fiducial markers 1004 on substrate 2 and/or the transfer media to confirm successful alignment, as discussed above in association with FIG. 21. Once proper alignment is confirmed, solenoid power source 2202 may reverse the direction of the solenoid 2204 force, and bolts 2208 may return to their default position. As this process proceeds, clamps 2206 return to their default clamped position, and the transfer media is secured to substrate 2.

Figure 23:
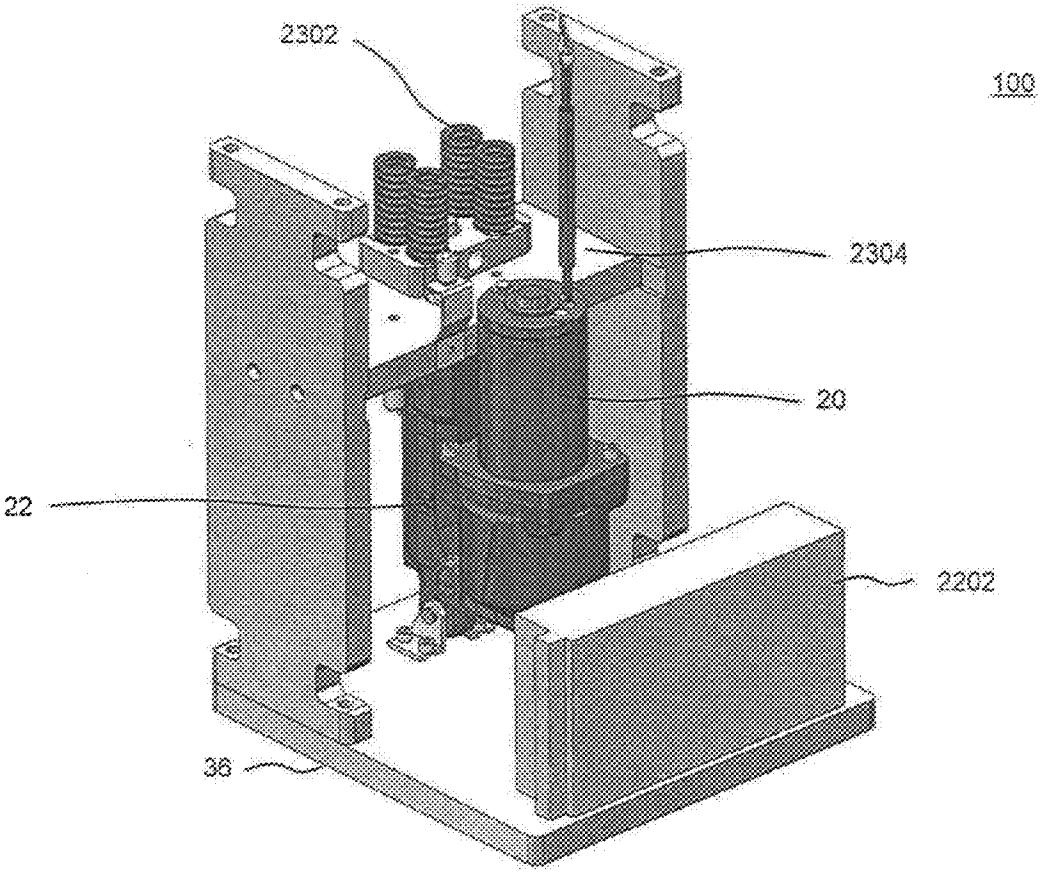
FIG. 23 is a diagrammatic illustration of a hydraulic system and spring-loaded press ram, consistent with disclosed embodiments.

FIG. 23 is an additional cutaway view of apparatus 100, showing additional detail relating to an embodiment incorporating a hydraulic system. In the view illustrated in FIG. 23, hydraulic pump 20 is shown in the center of apparatus 100. Hydraulic pump 20 receives inputs of electrical power and water/fluid (not shown) to generate pressure and force necessary to complete the process of bringing substrate 2 and heating platen 4 into contact. Force generated by hydraulic pump 20 is transferred to hydraulic actuator 22. As hydraulic actuator 22 extends upward, it may contact the underside of press ram 24, which comprises press plate 2304 and spring bed 2302. Spring bed 2302 may include springs of a known spring constant comprised of any suitable material, including steel, aluminum, plastic, ceramic, etc. The springs comprising spring bed 2302 may additionally be coated with a protective layer, such as neoprene, rubber, latex, etc. Press ram 24 may contact the underside of substrate 2 once substrate 2 has been translated into position atop the press ram via linear motion stage 14. Upon completion of a thermal cycle of heating platen 4 of predetermined duration, hydraulic actuator 22 reverses its force and retracts to its original position. Consequently, press plate 2304 and spring bed 2302 lower back to their original places as well. Substrate 2 translates back to its home position via linear motion stage 14, and heating platen 4 is de-energized as described above to complete the sublimation task.

Figure 24A:
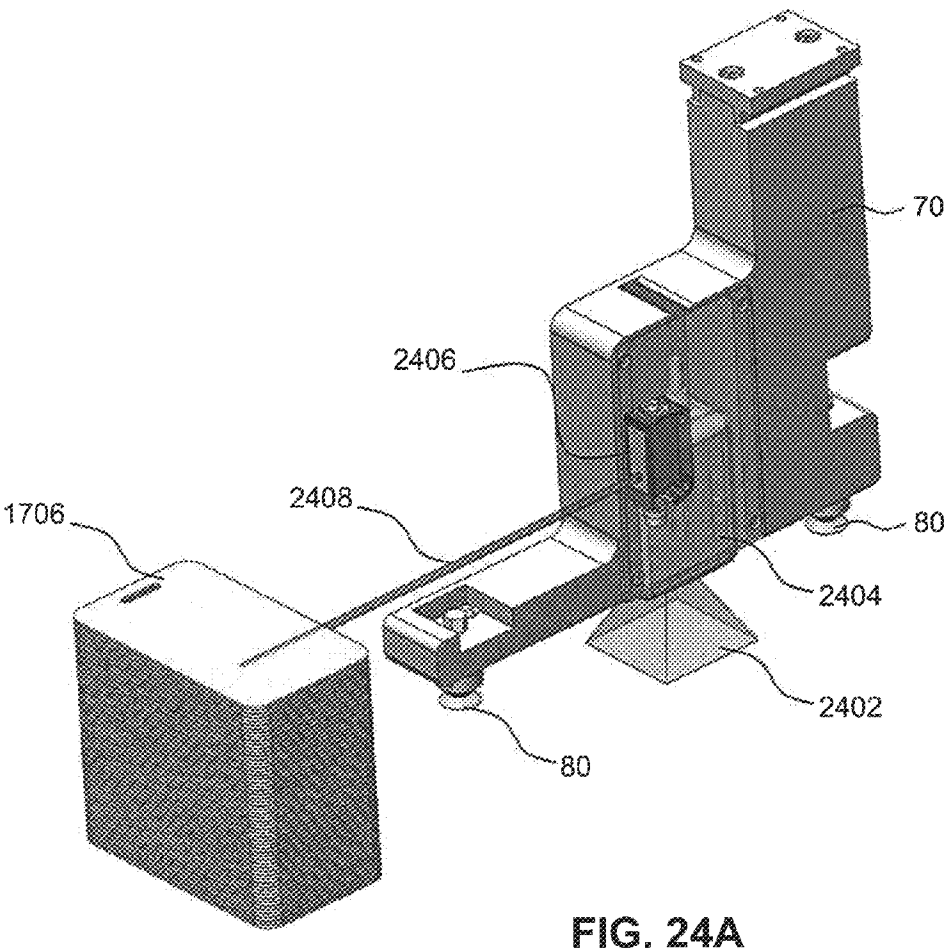
FIGS. 24A-24C are diagrammatic illustrations of an example end effector associated with a robotic transport mechanism, consistent with disclosed embodiments.

Turning to FIG. 24, FIGS. 24A-24C are detailed diagrammatic illustrations of an example end effector 70 equipped with added camera and sensor features as described above. In FIG. 24A, an end effector 70 is shown interacting with a stack of products 1706 in an embodiment involving inventory system 1700 as described previously. The end effector 70 illustrated in FIG. 24A is equipped with a camera 2404 and a sensor 2406. Each of these optional devices provides end effector 70 and associated systems described above with additional capabilities. Camera 2404, when associated with an end effector 70, may be configured to recognize, detect, and/or read fiducial markers, barcodes, or any other such machine-readable information within field of view 2402. The machine-readable information may include fiducial markers such as those described above in association with FIGS. 10-11 and 17-21. For example, end effector 70 may be positioned by a robotic control (not shown) such that a fiducial marker associated with a particular storage container within vending apparatus 500 is within field of view 2402. Camera 2404 may visualize the fiducial marker and read its information, such as information related to inventory count, and then end effector 70 may transmit the information to the control, to user interface device 50, or any other related system within or outside of vending apparatus 500. Camera 2404 and field of view 2402 may also be configured as discussed previously for other functions related to end effector 70, such as registration in the X and Y directions, and for fine motor control. For example, end effector 70 may pick up a single product 1706 using suction cups 80 as described above in association with FIGS. 8 and 18. Camera 2404 may use various fiducial markers as described in association with FIG. 21 to assist in precise retrieval of product 1706 and delivery to another location, such as substrate 2. In the example of FIG. 24A, end effector 70 also includes a sensor 2406 configured to operate within an inventory management system 1700 as discussed above. In the example of FIG. 24A, sensor 2406 may be configured to allow an associated control and/or computer system (not shown) to calculate the height of a stack of products 1706 via laser beam 2408 for purposes of determining inventory levels of that product. The example illustrated in FIG. 24A is intended to be non-limiting, and other configurations of end effector 70 are contemplated by the disclosed embodiments. For example, sensor 2406 may utilize infrared technology instead of a laser beam 2408. In other embodiments, sensor 2406 may be a contact sensor that can physically detect the height of products 1706 within a storage container by touch. In these embodiments, sensor 2406 may be associated with or may be coextensive with a mechanical implement 82 included with end effector 70 (not shown in FIGS. 24A-24B).

Figure 24B:
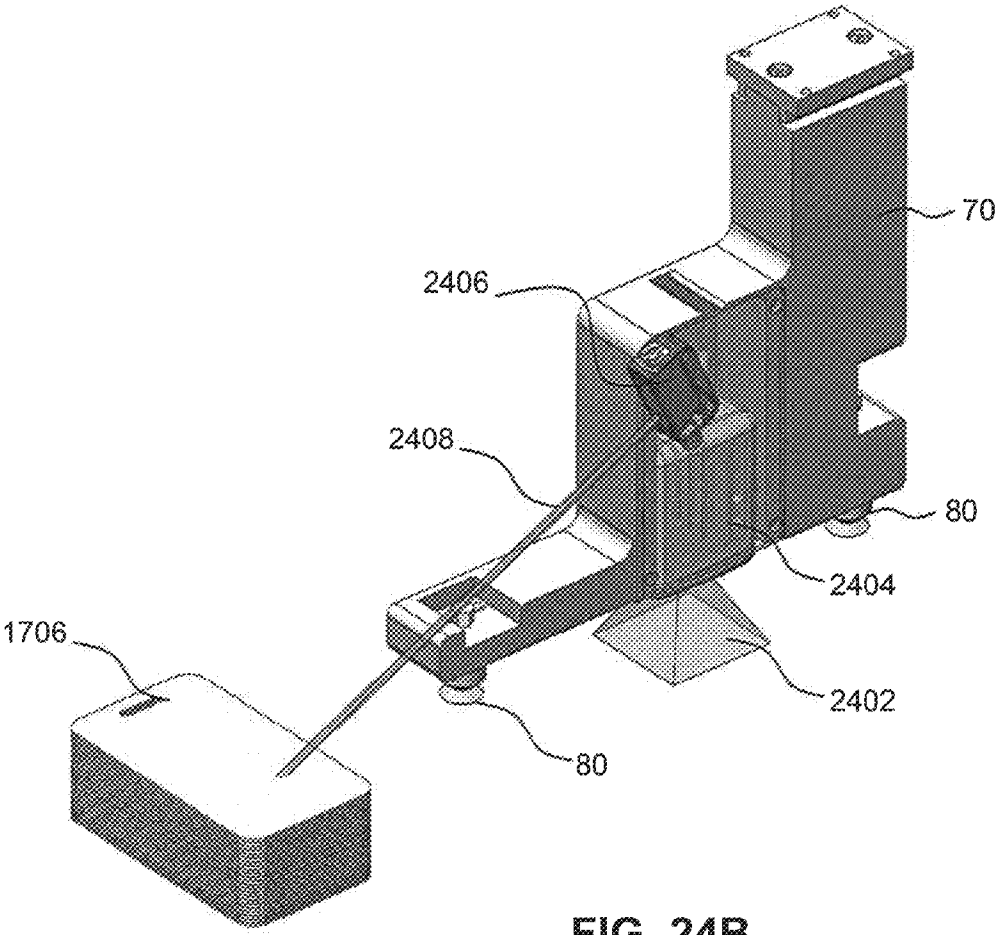
Figure 24C:
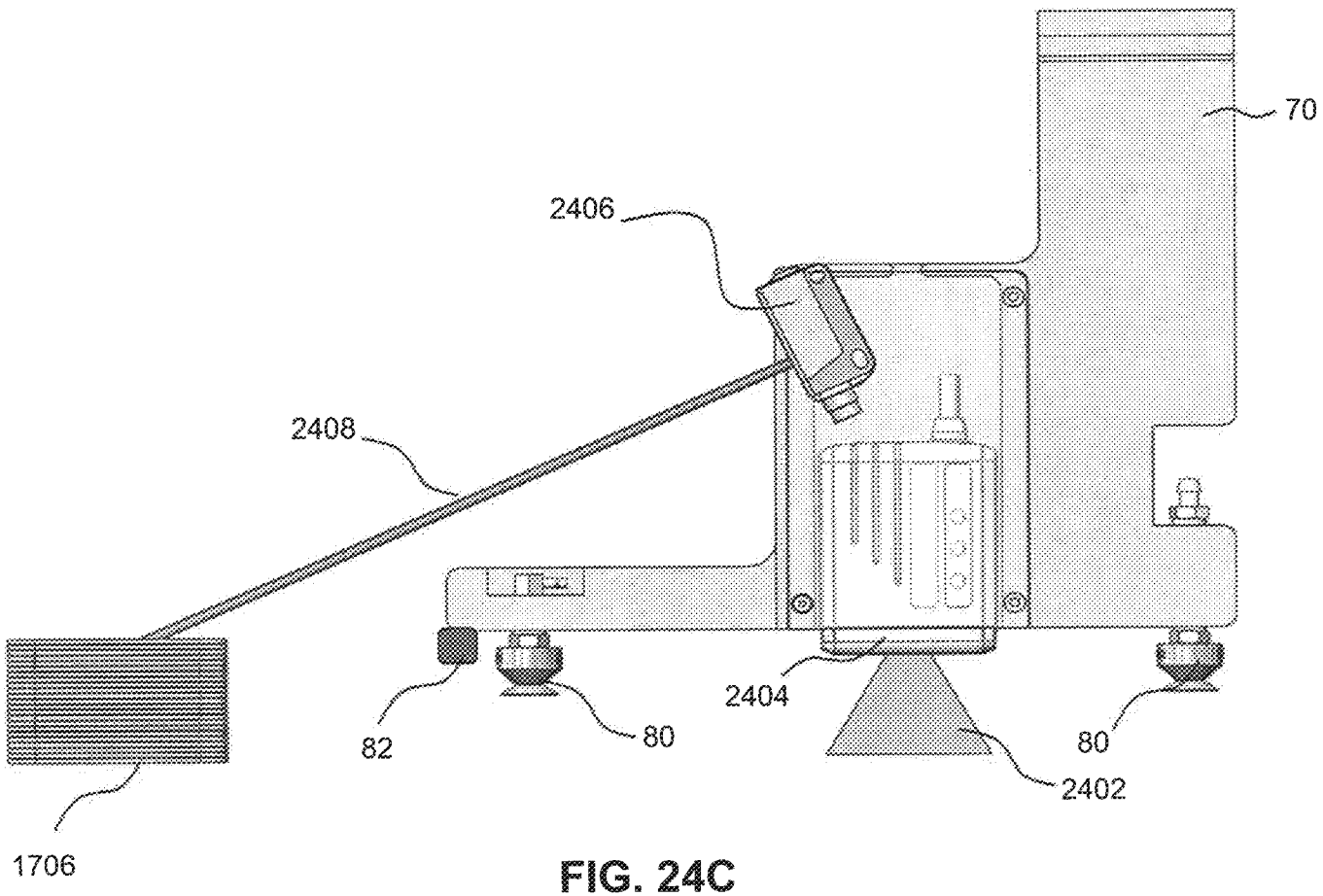

FIG. 24B illustrates an alternative embodiment of FIG. 24A. In FIG. 24B, sensor 2406 is mounted at a slightly higher physical location on end effector 70, and is additionally mounted at an angle instead of parallel to the base of end effector 70. In these embodiments, laser beam 2408 (or other such technology, as discussed above) may be configured to detect contact a location on the top of a stack of products 1706, rather than an edge as shown in FIG. 24A. FIG. 24C is a side view of FIG. 24B. FIG. 24C additionally includes a mechanical implement 82, which may be disposed near the front of end effector 70 as shown to interface with a shuttle 84 or shuttle 1708 of a storage container as described previously in association with FIGS. 8 and 17-19. In addition, mechanical implement 82 may be configured as discussed above to serve as a contact sensor for use in determining inventory levels within an inventory management system 1700.

Figure 25:
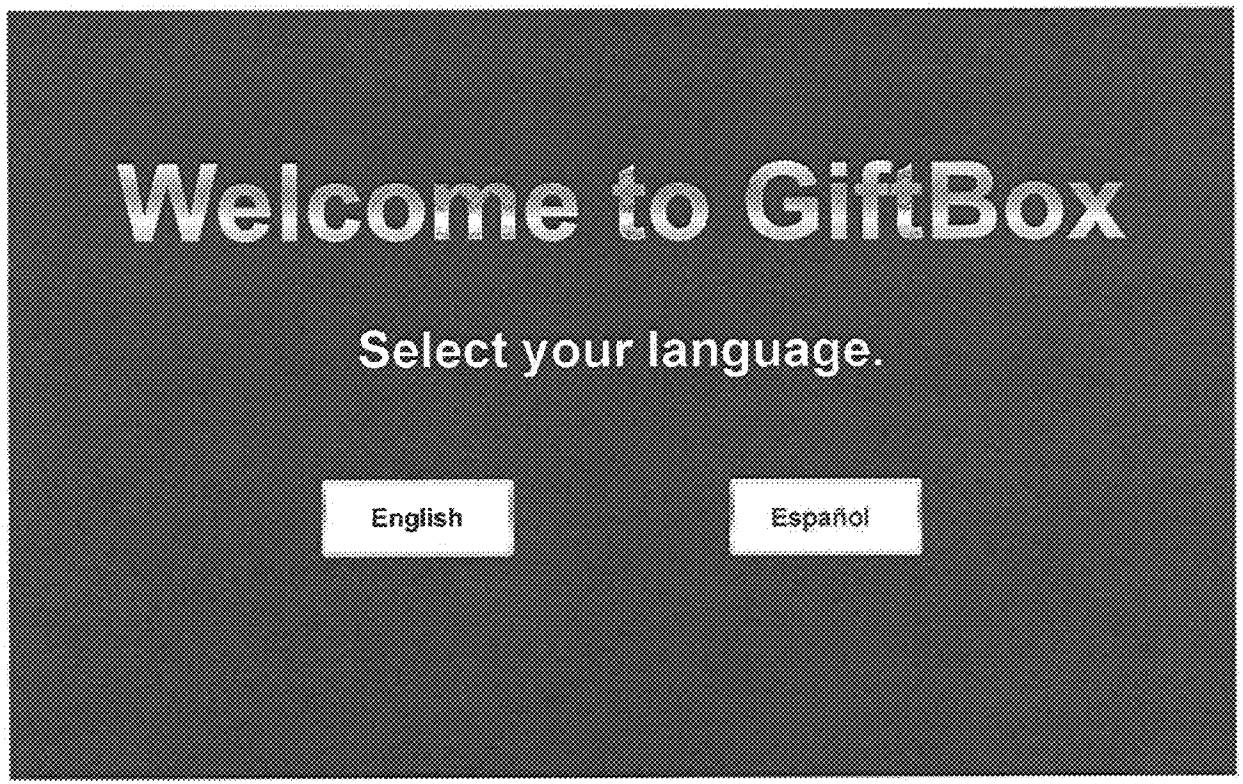
FIG. 25 is an example user interface associated with a vending apparatus for initiating contact with a user and allowing language selection, consistent with disclosed embodiments.
Figure 26:
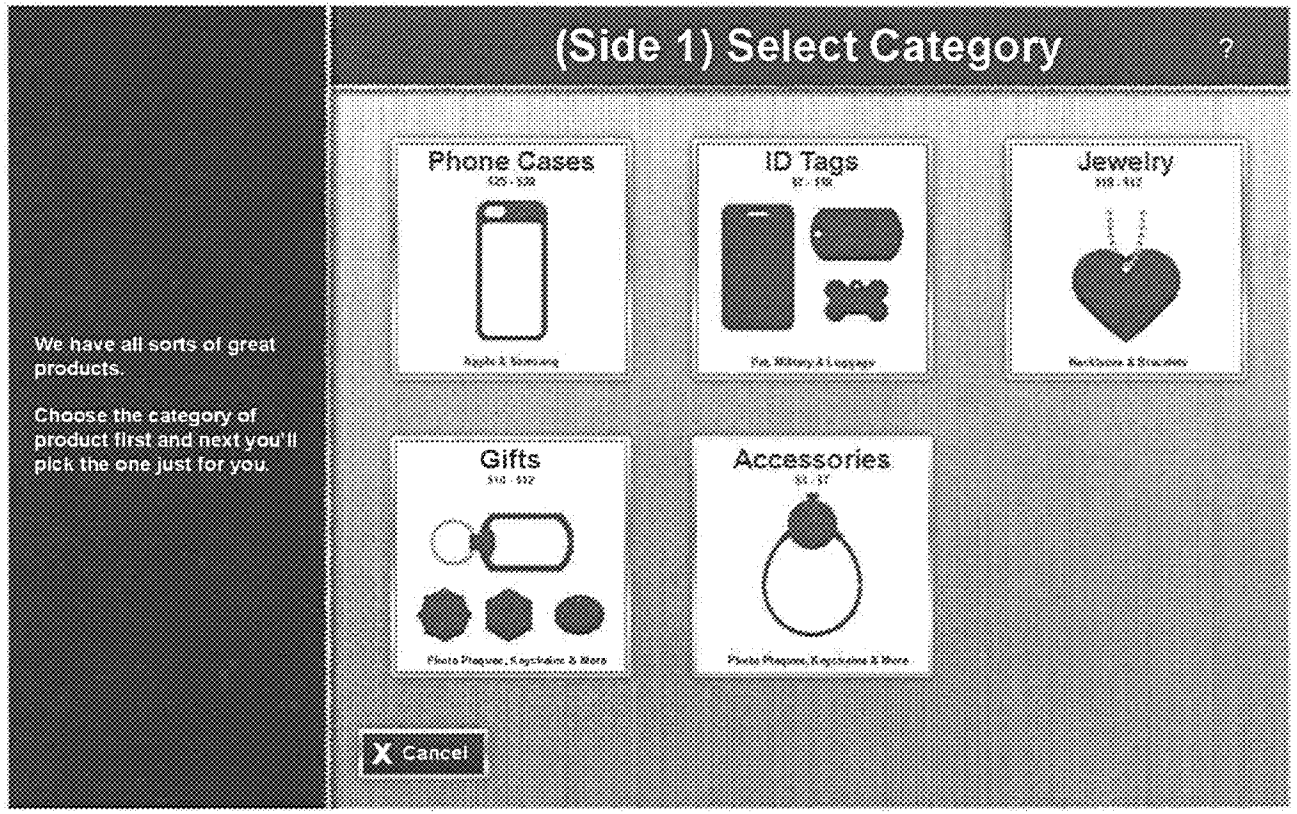
FIG. 26 is an example user interface associated with a vending apparatus for selecting one of a plurality of different types of products to be sublimated, consistent with disclosed embodiments.

FIGS. 25-37 are example graphical user interfaces (GUIs) that may be provided by the disclosed embodiments to facilitate interaction with a user. In these embodiments, user interface device 50 of a vending apparatus 500 may display the GUIs to the user via display screen 52. FIG. 25 is an example GUI that may be configured to initiate contact with a user and allowing language selection. FIG. 26 is an example GUI that may be configured to assist a user in selecting one of a plurality of different types of products to be sublimated. Depending on the configuration of user interface device 50 and display screen 52, the different options illustrated as square boxes in FIG. 26 such as "Jewelry" and "Gifts" may be operable as touchscreen buttons, or may be selectable using an optional mouse/trackball and/or keyboard associated with user interface device 50.

Figure 27:
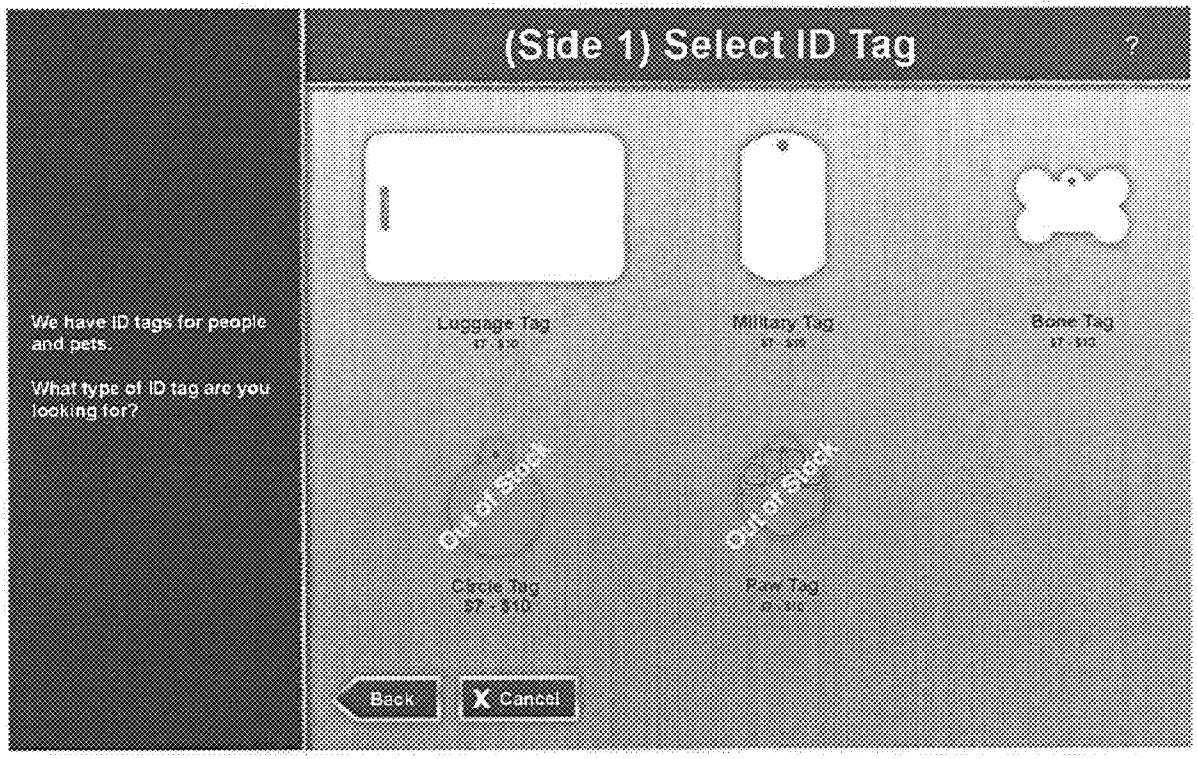
FIG. 27 is an example user interface associated with a vending apparatus for selecting one subtype of a plurality of different types of products to be sublimated, consistent with disclosed embodiments.
Figure 28:
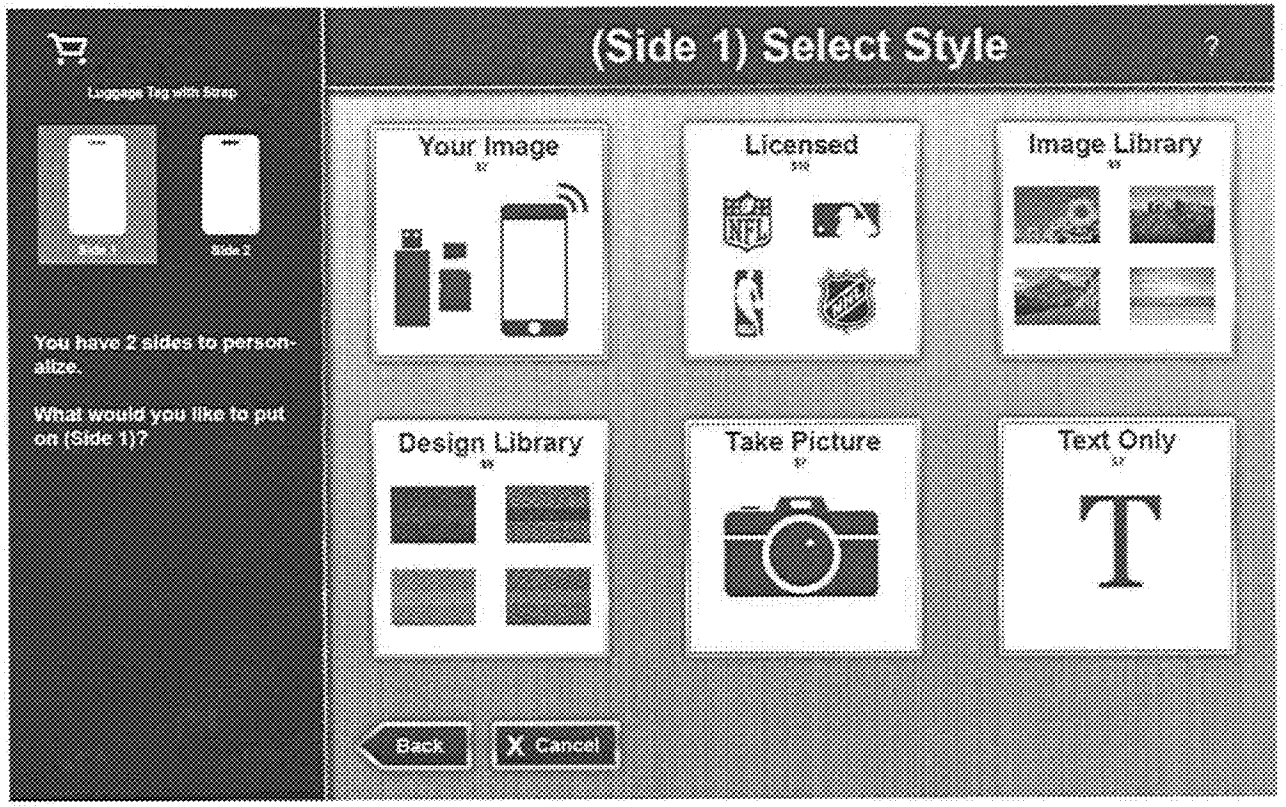
FIG. 28 is an example user interface associated with a vending apparatus for customizing a product, consistent with disclosed embodiments.
Figure 29:
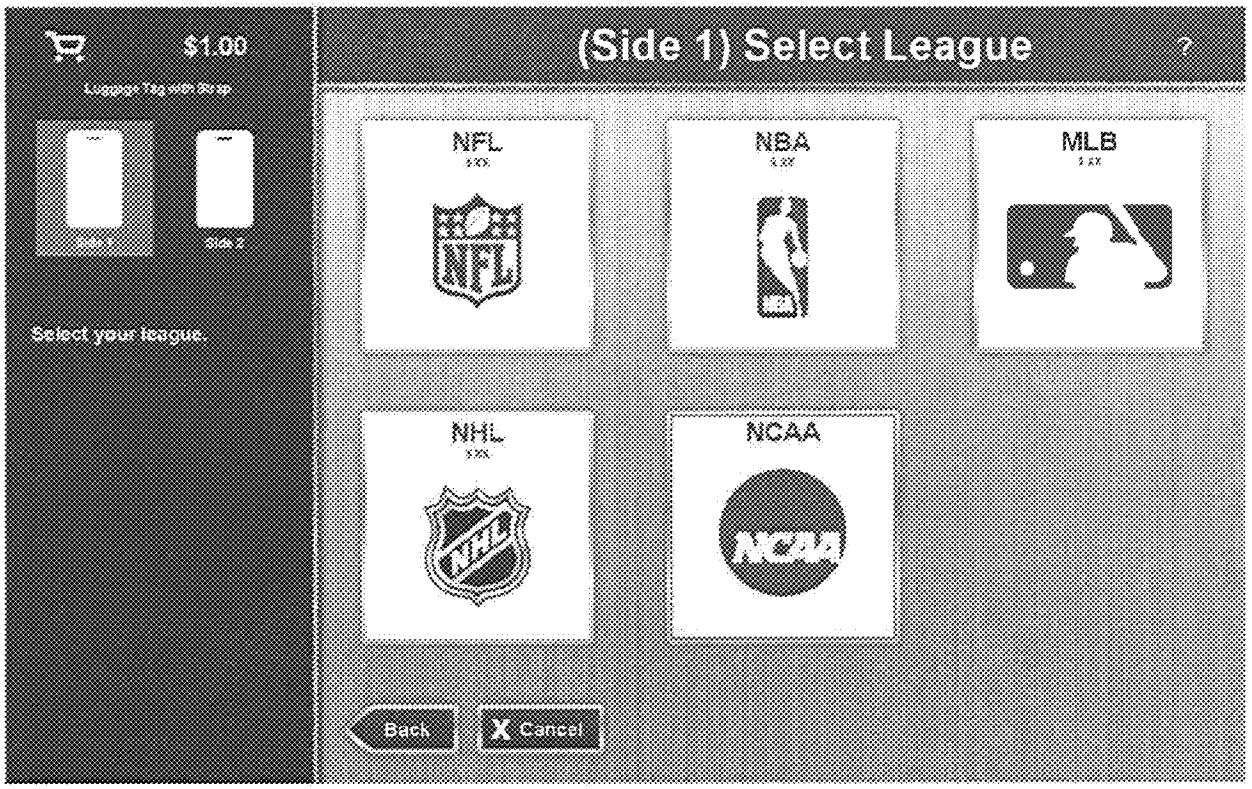
FIG. 29 is an example user interface associated with a vending apparatus for customizing a product, consistent with disclosed embodiments.
Figure 30:
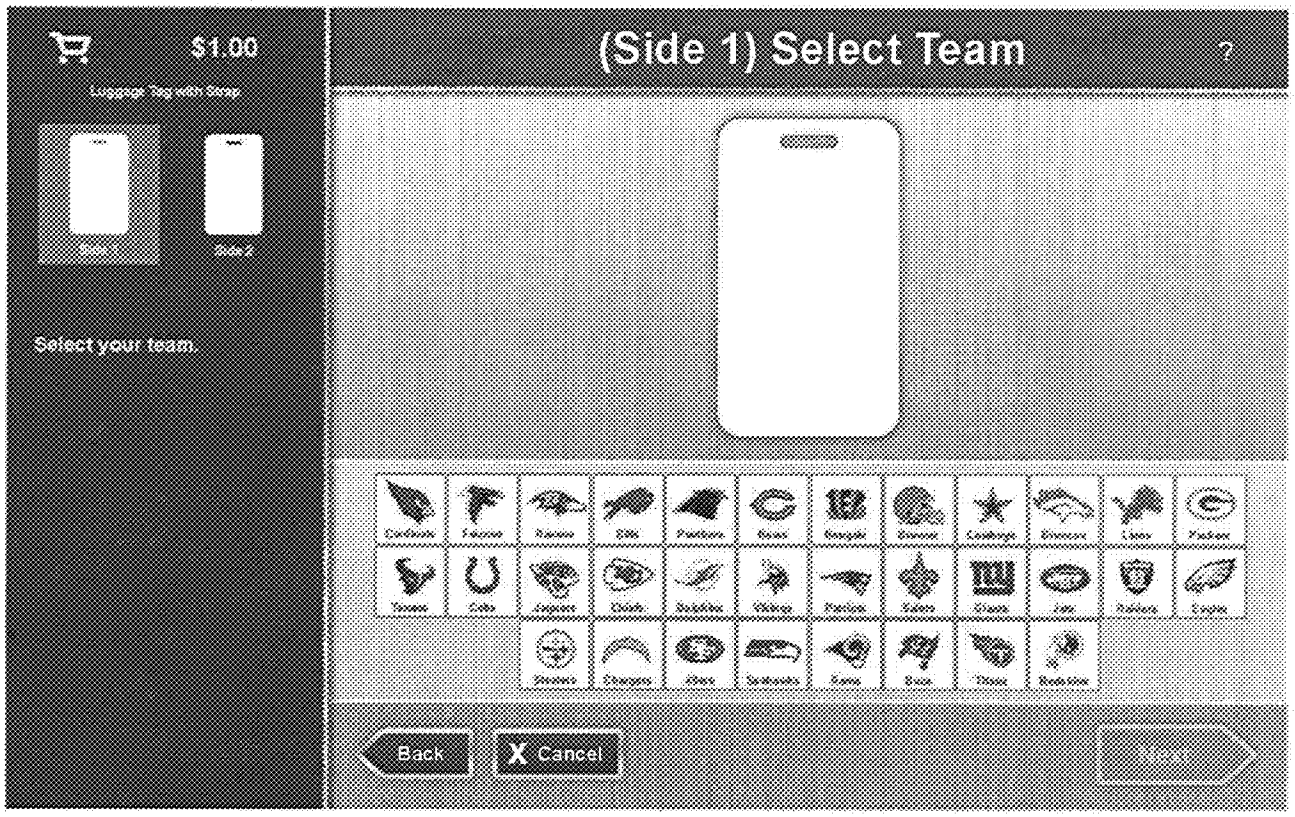
FIG. 30 is an example user interface associated with a vending apparatus for customizing a product, consistent with disclosed embodiments.
Figure 31:
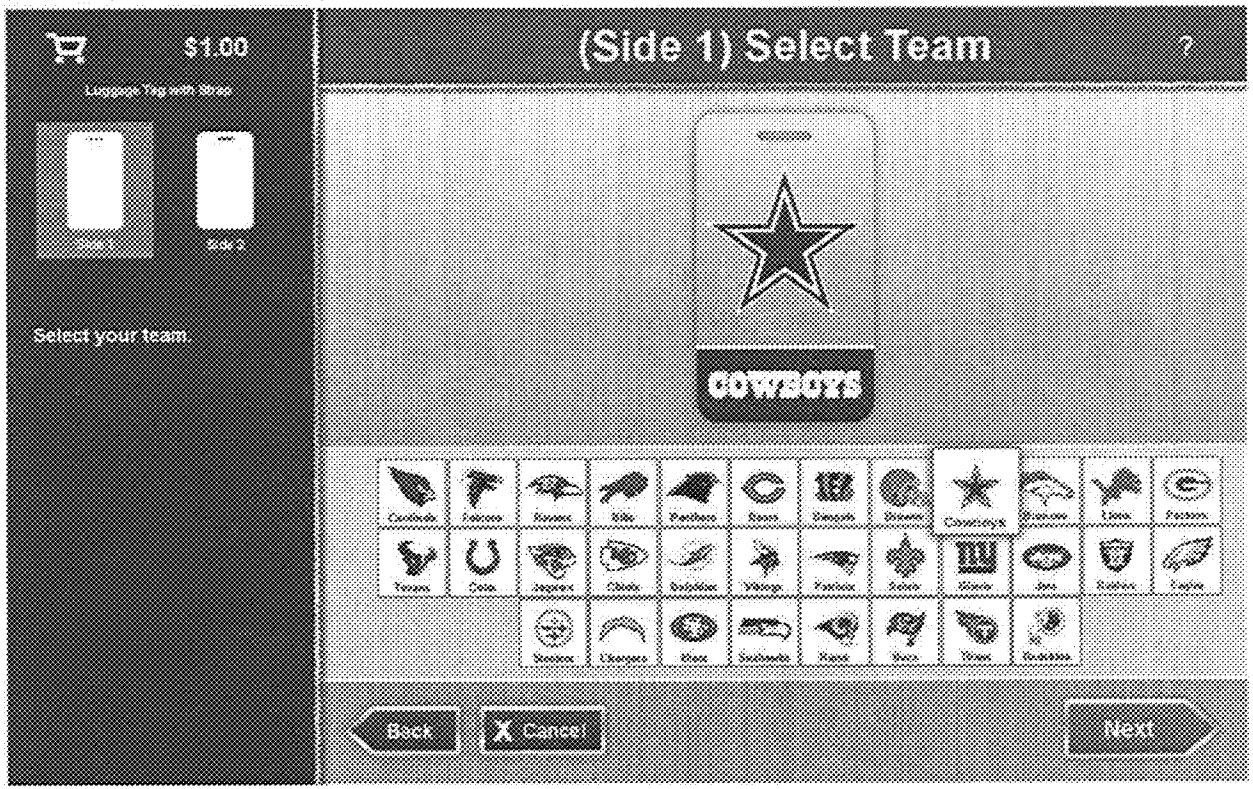
FIG. 31 is an example user interface associated with a vending apparatus for customizing a product, consistent with disclosed embodiments.
Figure 32:
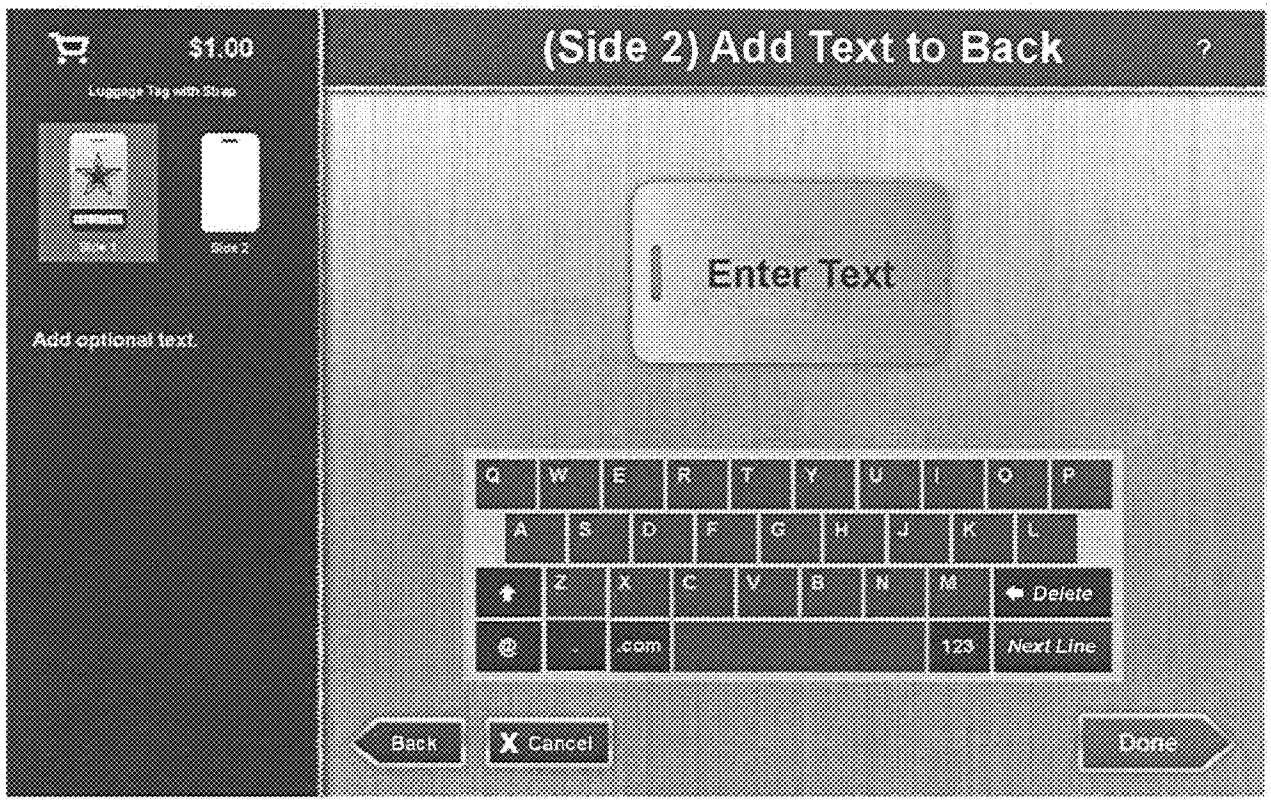
FIG. 32 is an example user interface associated with a vending apparatus for customizing a product, consistent with disclosed embodiments.
Figure 33:
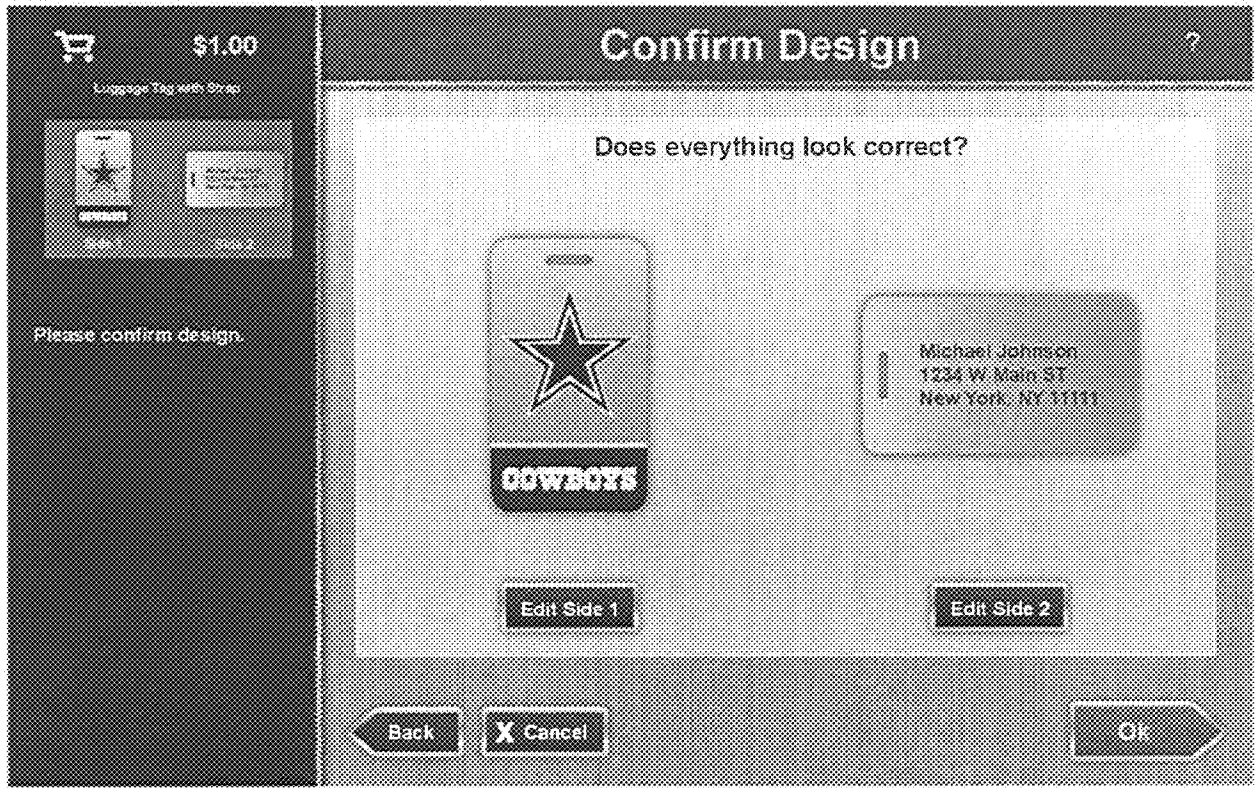
FIG. 33 is an example user interface associated with a vending apparatus for confirming customizable features to be sublimated onto a product, consistent with disclosed embodiments.

In FIG. 27, the user has chosen the option of "ID Tags" as a desired product to sublimate on the GUI of FIG. 26. FIG. 27 is an example GUI that may be configured to assist a user in selecting a further subtype of the product. For example, the user is given the choice of a luggage tag, a military dog tag, or a bone-shaped pet tag. Different embodiments of vending apparatus 500 may display different options for selection based on the current configuration and inventory levels of one or more storage containers that may be associated with apparatus 500. For example, in the illustration of FIG. 27, circle tags and paw-shaped tags are displayed in a manner indicating to the user that they are "out of stock." In some embodiments, this display may indicate that vending apparatus 500 contains no storage containers configured to dispense these products, and thus they are not available at all for purchase via that particular vending apparatus 500. In other embodiments, storage containers configured to dispense the circle tags and paw tags may be present within inventory system 1700 and vending apparatus 500, but end effector 70 may determine via sensor 2406 as described above that the inventory for those items is depleted. Upon detection that a storage container associated with an item is empty, inventory system 1700, via associated controls and/or computer systems, may initiate changes to the GUI shown to a user to indicate than an item is no longer available, as shown in FIG. 27.

FIGS. 28-33 are example GUIs that may be configured to walk a user through the process of selecting customized images or text to be sublimated onto a product, such as a product 1706. Vending apparatus 500 may provide a variety of different options for customization depending on a number of factors, such as the time of year, location of the apparatus, business agreements, or other such criteria. Images and text available for customization may be stored locally within user interface device 50 as described previously, or may be accessible by user interface device 50 over a network connection.

Figure 34:
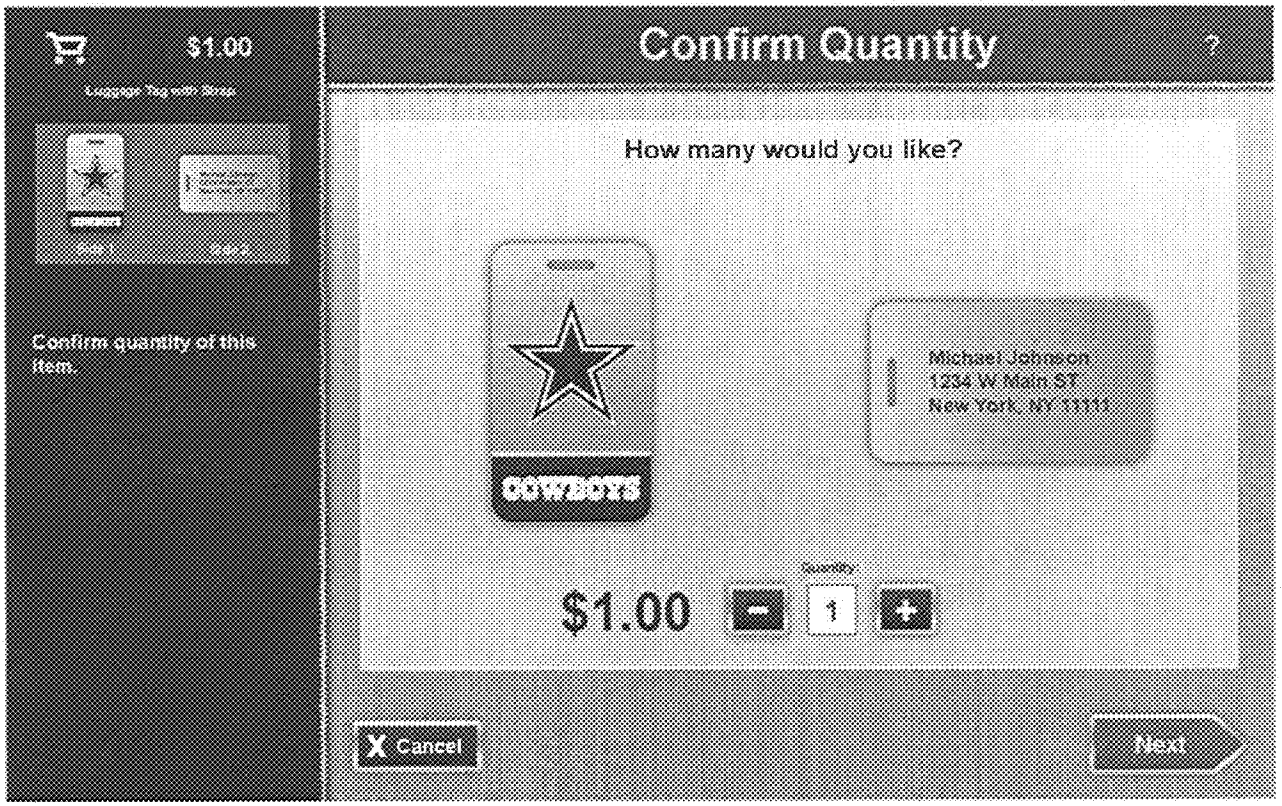
FIG. 34 is an example user interface associated with a vending apparatus for confirming quantities of customized products, consistent with disclosed embodiments.

FIG. 34 is an example GUI that may be configured to assist the user in confirming quantities and pricing of customized products. Much in the manner described above in association with FIG. 27, inventory system 1700 may be configured to provide information to user interface device 50 to assist in the configuration and presentation of the quantities shown in the GUI of FIG. 34. For example, if inventory system 1700 determines that only four luggage tags remain in the storage container of vending apparatus 500, the GUI of FIG. 34 may not permit selection of a quantity more than four. Alternatively, if a quantity of more than four is desired, the GUI may be configured to display the locations of other nearby vending apparatuses 500, or may have the items produced at a remote location and shipped to the user. In some embodiments, user interface device 50 may be configured as discussed previously to provide discounts to the user based on the quantity of products ordered. For example, one luggage tag may be $1.00 as shown in FIG. 34, but three tags may be available at a discounted price of $2.50 instead of the unit price of $3.00.

Figure 35:
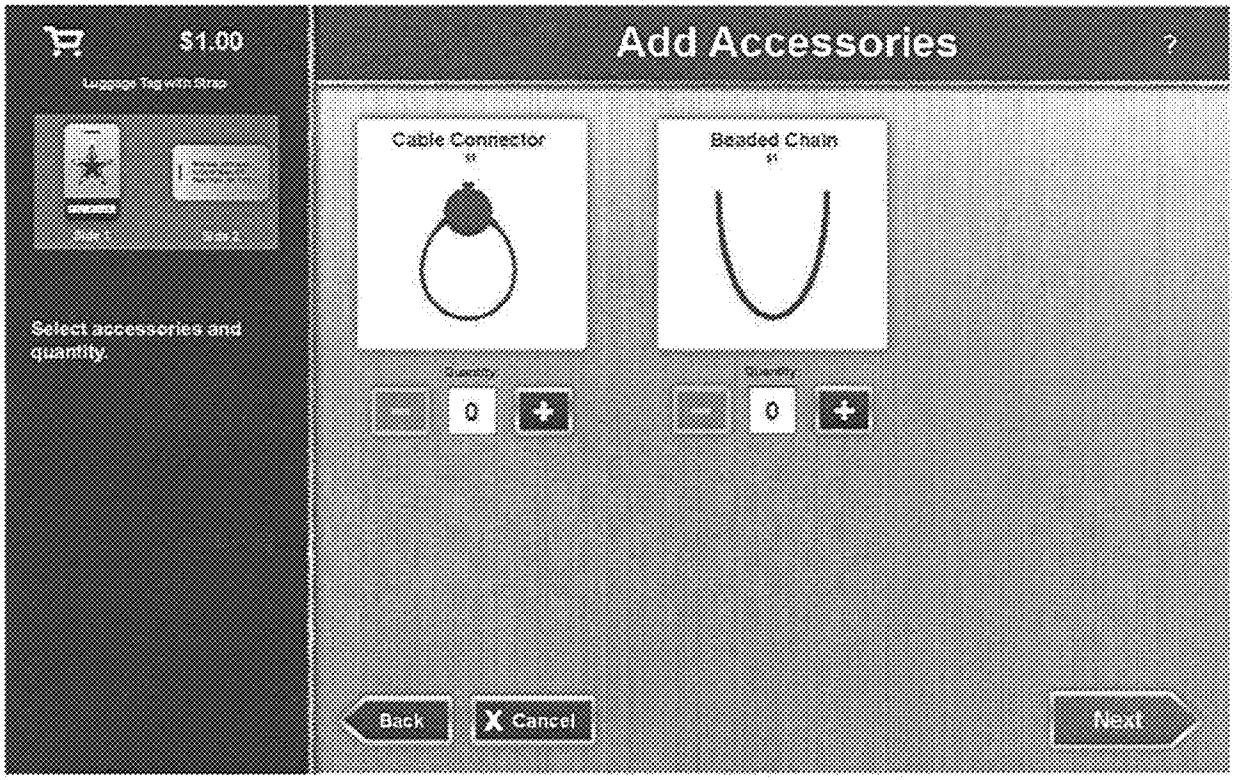
FIG. 35 is an example user interface associated with a vending apparatus for selecting optional accessories, consistent with disclosed embodiments.

FIG. 35 is an example GUI that may be configured to assist the user in selecting optional accessories to accompany a sublimated product. In the example of FIG. 35, the product to be sublimated is a luggage tag, so accessories presented to the user include a cable connector and/or a beaded chain for the tag. Different accessories may be displayed in the GUI for FIG. 35 depending on the product selected and based on the inventory of accessory storage containers within vending apparatus 500, as determined by inventory management system 1700. Depending on the configuration of user interface device 50 and display screen 52, the different options illustrated as square boxes in FIG. 35 may be operable as touch-screen buttons, or may be selectable using an optional mouse/trackball and/or keyboard associated with user interface device 50.

Figure 36:
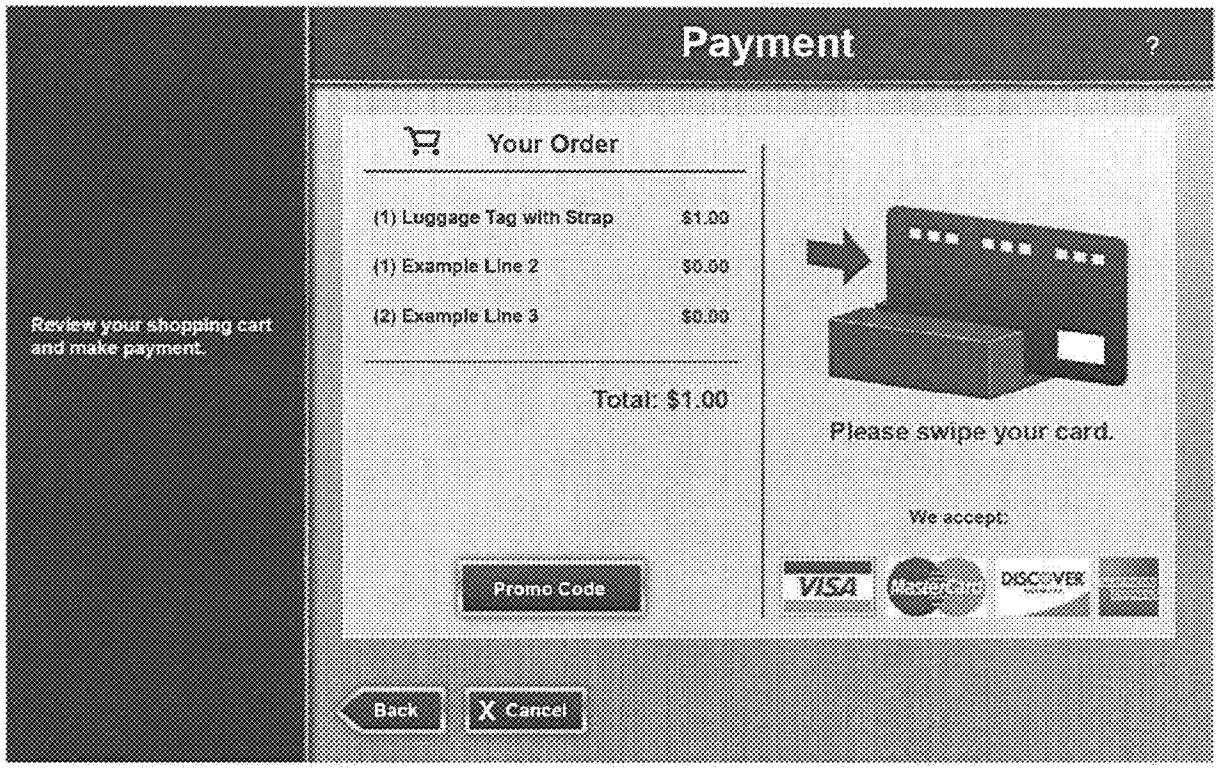
FIG. 36 is an example user interface associated with a vending apparatus for facilitating payment for one or more customized products, consistent with disclosed embodiments.
Figure 37:
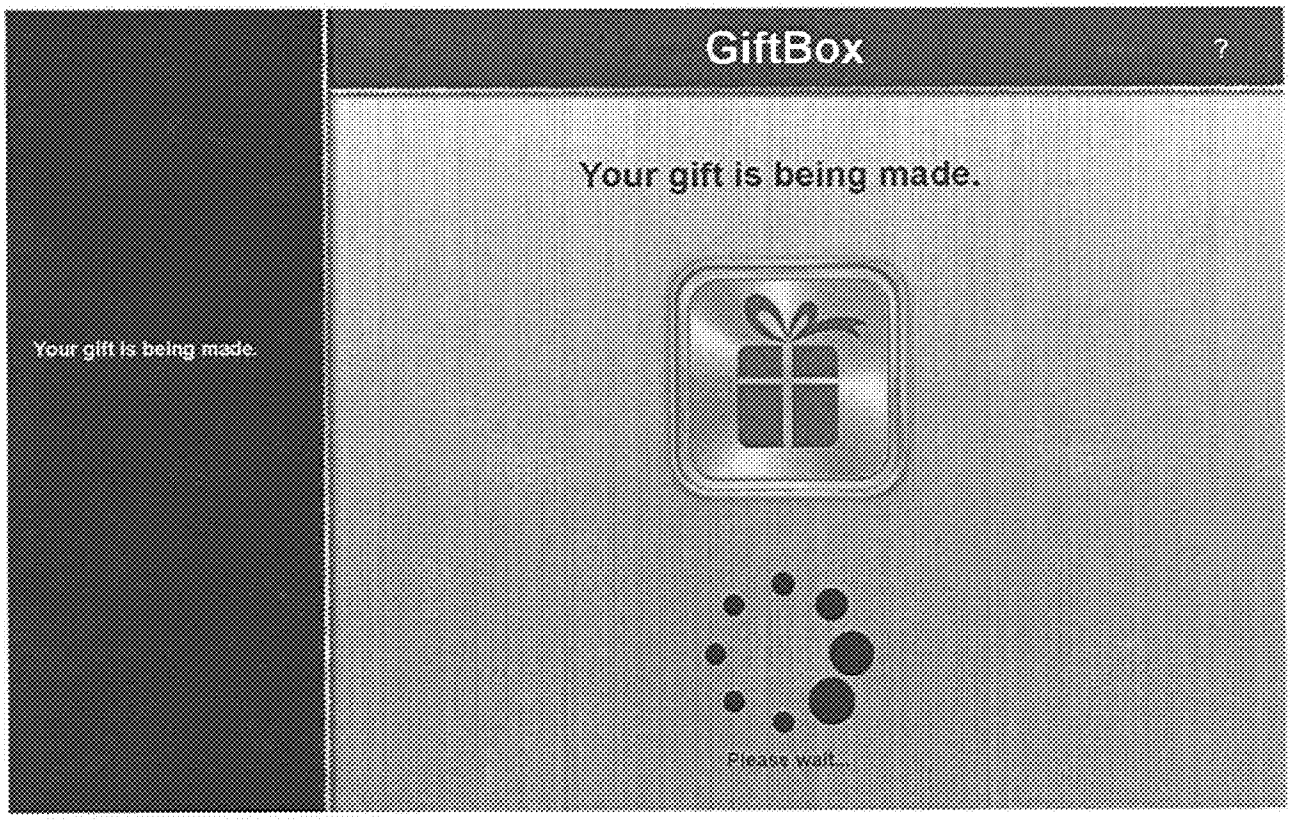
FIG. 37 is an example user interface associated with a vending apparatus for providing confirmation that customization of a product is in progress, consistent with disclosed embodiments.

FIG. 36 is an example GUI that may be configured to facilitate payment for one or more customized products and/or accompanying accessories. The GUI may be configured to show the purchased items to allow for review of the purchase by the user. The GUI may be further configured to allow the customer to remove purchases from the order, or to add additional purchases. In some embodiments, the GUI may be configured to assist the user in processing payment for the order, such as via credit card. The user may be prompted to additional details after swiping a credit card in a receptacle associated with user interface device 50 via the GUI of FIG. 36, or in embodiments where no such receptacle is present, the GUI may be configured to receive input of a credit card number and related information. As shown in FIG. 36, the system may be configured to receive additional information, such as a promotional code, customized message, or other information. Upon receiving payment, a GUI such as that illustrated in FIG. 37 may be displayed, confirming successful payment and informing the user that the sublimation task is in progress.

As configured, the systems and apparatuses contemplated by the disclosed embodiments allow consumers to create personalized products on demand in a more accessible, flexible, and efficient manner than ever before. The system can be operated automatically by a completely untrained operator, and most importantly, can be operated in a safe manner with all potentially hazardous components enclosed in a protective housing. The apparatus takes full advantage of digital technology, allowing all manners of contemporary image acquisition, processing, and social media integration. For retail establishments, the apparatus presents a vast array of new products and market opportunities, with minimal inputs of labor, training, and inventory management. Deployable in a wide range of configurations due to its modular subsystem design, the apparatus can be individually configured and customized for the needs of a given user or application. Aspects of the apparatus design revolutionize the sublimation process, and allow faster, more productive marketing of sublimated products with less wear on the machine components.

Other embodiments of the invention will be apparent to those skilled in the art from consideration of the specification and practice of the invention disclosed herein. It is intended that the specification and examples be considered as examples only, with a true scope and spirit of the invention being indicated by the following claims.

What is claimed is:

1. A method for sublimating images on a product, comprising:

printing one or more images identified by a customer for the product on a transfer media;

positioning the transfer media on a substrate;

positioning at least one product onto the transfer media;

folding the transfer media to substantially surround the product, wherein at least one printed image is positioned onto one or more opposing sides of the product to be sublimated;

configuring a single thermal cycle for a single heating platen such that the images will be sublimated substantially simultaneously onto each side of the product in a single thermal cycle, wherein configuring a single thermal cycle comprises configuring a programmed pressure of about 30 to about 40 psi, and wherein the programmed pressure is applied via a press ram comprising one or more springs with a known spring constant and a sensor configured to measure the spring displacement;

bringing the single heating platen and transfer media into contact; and sublimating at least one image from the transfer media to each side of the product using the configured single thermal cycle of the single heating platen.

2. The method of claim 1, wherein positioning the transfer media on a substrate further comprises securing at least a portion of the transfer media into contact with the substrate with one or more clamps.

3. The method of claim 1, further comprising translating the substrate from a home position into alignment with the single heating platen.

4. The method of claim 1, wherein bringing the single heating platen and transfer media into contact further comprises translating one or more of the substrate and the single heating platen.

5. The method of claim 4, wherein the single heating platen and transfer media are brought into contact by one of a mechanical cam system, hydraulic system, or pneumatic system.

6. The method of claim 1, wherein configuring a single thermal cycle further comprises configuring at least one of a programmed temperature or duration.

7. The method of claim 1, wherein positioning the transfer media on a substrate further comprises transporting the transfer media from a printer that printed the one or more images identified by a customer for the product on the transfer media to the substrate via a motorized feeder tray.

8. An automated sublimation apparatus for sublimating an image on a product, comprising:

a dye sublimation transfer printer configured to receive a digital image file representing an image, the dye sublimation transfer printer configured to print the received image on a transfer media;

a substrate configured to receive the transfer media;

one or more heating platens configured to sublimate the printed image onto one or more opposing sides of the selected product;

a housing substantially enclosing the dye sublimation transfer printer, substrate, and one or more heating platens in a manner that prevents a user from contacting the enclosed components; and a user interface device configured to permit the user to determine an image for printing.

9. The apparatus of claim 8, further comprising one or more clamps configured to secure at least a portion of the transfer media into contact with the substrate.

10. The apparatus of claim 8, wherein the substrate further comprises a linear motion stage, and the substrate is configured to translate, via the linear motion stage, from a home position to a position in alignment with the one or more heating platens.

11. The apparatus of claim 8, further comprising a motorized folding arm mechanism configured to:

fold the transfer media to substantially surround the product; and unfold the transfer media subsequent to sublimation of the image by the one or more heating platens.

12. The apparatus of claim 11, wherein the motorized folding arm mechanism is further configured to assist in removing the transfer media from the substrate.

13. The apparatus of claim 8, wherein the apparatus further comprises at least one of a motorized cam system, a hydraulic system, or a pneumatic system configured to bring the transfer media and one or more heating platens into contact.

14. The apparatus of claim 13, wherein the apparatus further comprises a hydraulic system, the hydraulic system comprises one or more of a pump, a regulator, a reservoir, a hydraulic actuator, and a control valve.

15. The apparatus of claim 14, wherein the apparatus further comprises:

one or more springs loaded by the hydraulic actuator with a known spring constant; and a sensor configured to measure the spring displacement of the one or more springs.

16. The apparatus of claim 8, wherein the dye sublimation transfer printer further comprises a motorized feeder tray that is configured to transport the transfer media to the substrate.

17. A vending apparatus for providing a user with a customized sublimated product, comprising:

a dye sublimation transfer printer configured to receive a digital image file representing an image from the user and further configured to print the received image on a transfer media;

a substrate configured to receive the transfer media;

one or more product storage containers configured to store a plurality of products;

a robotic transport mechanism configured to place the transfer media on the substrate, retrieve a selected product from a storage container, and position the product on the transfer media;

one or more heating platens configured to engage the transfer media and sublimate the printed image onto one or more opposing sides of the selected product in a single thermal cycle;

a cooling system configured to cool the sublimated product to at least about an ambient temperature;

a delivery opening configured to provide the cooled product to the user;

a housing substantially enclosing the dye sublimation transfer printer, substrate, one or more product storage containers, robotic transport mechanism, one or more heating platens, and cooling system in a manner that prevents a user from contacting the enclosed components; and a user interface device configured to permit the user to determine one or more images for printing, select one of the plurality of products on which to sublimate the one or more images, and facilitate payment by the user for the sublimated product.

18. The vending apparatus of claim 17, wherein the substrate further comprises a linear motion stage, and the substrate is configured to translate, via the linear motion stage, from a home position to a position in alignment with the one or more heating platens.

19. The vending apparatus of claim 17, wherein the robotic transport mechanism is configured to translate along an H-shaped track, and comprises a telescoping robotic arm.

20. The vending apparatus of claim 17, wherein the robotic transport mechanism comprises multiple end effectors.

21. The vending apparatus of claim 17, wherein the received image is modified to permit sublimation of the image onto the product.

22. The vending apparatus of claim 17, wherein the robotic transport mechanism comprises an end effector comprising one or more of a mechanical implement configured to interface with a product storage container and a sensor configured to determine information associated with the product storage container.

23. The vending apparatus of claim 22, wherein the end effector comprises a sensor configured to determine information associated with the product storage container.

24. The vending apparatus of claim 23, wherein the apparatus is configured to transmit the information to a remote server.

25. The vending apparatus of claim 23, wherein the determined information comprises a count of the inventory that the product storage container contains.

26. The vending apparatus of claim 25, wherein the apparatus is configured to alter the information displayed to a user on the user interface device based on the determined count of inventory.

27. The vending apparatus of claim 26, wherein the alteration comprises one or more of an indication that a product or accessory is out of stock or an indication that only a certain quantity of products or accessories less than or equal to the determined count of inventory are available.

28. The vending apparatus of claim 23, wherein the determined information comprises information associated with one or more of the vending apparatus, the product contained within the product storage container, the manufacturer of the vending apparatus, a retailer hosting the vending apparatus, or a third party.

29. The vending apparatus of claim 28, wherein the apparatus is configured to compile a report comprising the determined information.

30. The vending apparatus of claim 29, wherein the apparatus is further configured to display the report to a user via the user interface device.

31. The vending apparatus of claim 17, wherein the user interface device is configured to transmit or receive information from a mobile application associated with one or more of a manufacturer of the vending apparatus, a retailer hosting the vending apparatus, or a third party.

32. The vending apparatus of claim 31, wherein the information comprises one or more of information associated with the user's desired product to be sublimated, information associated with an image or text to be sublimated on the product, information associated with payment for the sublimated product, information comprising a location of the nearest vending apparatus, or a code configured to facilitate access by the user interface device to information associated with a saved transaction ordered from the mobile application.

33. The vending apparatus of claim 17, wherein the user interface device is configured to:

prompt the user to determine if additional sublimated products are desired;

provide the user with information enabling later orders of additional sublimated products; and transmit information associated with the sublimation task to a remote server to facilitate later orders of additional sublimated products.

34. The vending apparatus of claim 33, wherein the later orders are to be produced at a remote facility associated with one or more of a manufacturer of the vending apparatus, a retailer hosting the vending apparatus, or a third party and shipped to the user.

35. The vending apparatus of claim 17, further comprising one or more clamps configured to secure at least a portion of the transfer media into contact with the substrate.

36. The vending apparatus of claim 17, further comprising a motorized folding arm mechanism configured to:

fold the transfer media to substantially surround the product; and unfold the transfer media subsequent to sublimation of the image by the one or more heating platens.

37. The vending apparatus of claim 36, wherein the motorized folding arm mechanism is further configured to assist in removing the transfer media from the substrate.

38. The vending apparatus of claim 17, wherein the apparatus further comprises:

one or more springs loaded by a hydraulic actuator with a known spring constant configured to bring the transfer media and one or more heating platens into contact with a known pressing force; and a sensor configured to measure the spring displacement of the one or more springs.

39. The vending apparatus of claim 38, wherein the known pressing force is about 30 psi to about 40 psi.

40. The vending apparatus of claim 17, wherein the dye sublimation transfer printer further comprises a motorized feeder tray that is configured to transport the transfer media to the substrate.

41. The vending apparatus of claim 40, wherein the motorized feeder tray further comprises one or more sensors that detect when to stop feeding the transfer media to the substrate.

42. The vending apparatus of claim 17, wherein the cooling system comprises a heat sink in the form of a plate comprised of a thermally conductive material selected from the group consisting of copper, brass, aluminum, and steel.

43. The vending apparatus of claim 42, wherein the plate includes one or more grooves or slits.

44. The vending apparatus of claim 17, wherein one of the one or more storage containers contains a product comprising multiple sublimatable items etched onto the product that may be individually punched out.

* * * * *